US007571094B2

(12) United States Patent
Goudar

(10) Patent No.: US 7,571,094 B2
(45) Date of Patent: Aug. 4, 2009

(54) CIRCUITS, PROCESSES, DEVICES AND SYSTEMS FOR CODEBOOK SEARCH REDUCTION IN SPEECH CODERS

(75) Inventor: Chanaveeragouda V Goudar, Bangalore (IN)

(73) Assignee: Texas Instruments Incorporated, Dallas, TX (US)

( * ) Notice: Subject to any disclaimer, the term of this patent is extended or adjusted under 35 U.S.C. 154(b) by 504 days.

(21) Appl. No.: 11/311,976

(22) Filed: Dec. 21, 2005

(65) Prior Publication Data

US 2007/0067164 A1 Mar. 22, 2007

Related U.S. Application Data

(60) Provisional application No. 60/719,244, filed on Sep. 21, 2005.

(51) Int. Cl.
*G10L 19/12* (2006.01)
*G10L 11/04* (2006.01)

(52) U.S. Cl. ..... 704/221; 704/207; 704/223

(58) Field of Classification Search ..... None
See application file for complete search history.

(56) References Cited

U.S. PATENT DOCUMENTS

| | | | | |
|---|---|---|---|---|
| 6,073,092 | A | 6/2000 | Kwon | |
| 6,424,941 | B1 * | 7/2002 | Yu | 704/221 |
| 6,470,309 | B1 | 10/2002 | McCree | |
| 6,493,665 | B1 | 12/2002 | Su et al. | |
| 6,556,966 | B1 | 4/2003 | Gao | |
| 6,766,289 | B2 | 7/2004 | Kandhadai et al. | |
| 6,789,059 | B2 | 9/2004 | Kandhadai et al. | |
| 2001/0053972 | A1 | 12/2001 | Amada et al. | |
| 2002/0007269 | A1 | 1/2002 | Gao | |
| 2002/0016161 | A1 * | 2/2002 | Dellien et al. | 455/403 |
| 2002/0095284 | A1 | 7/2002 | Gao | |
| 2002/0103638 | A1 * | 8/2002 | Gao | 704/207 |
| 2003/0078771 | A1 | 4/2003 | Jung et al. | |
| 2003/0097258 | A1 | 5/2003 | Thyssen | |
| 2003/0200092 | A1 | 10/2003 | Gao et al. | |
| 2004/0098254 | A1 | 5/2004 | Lee et al. | |
| 2004/0181400 | A1 * | 9/2004 | Kannan et al. | 704/223 |
| 2005/0065785 | A1 * | 3/2005 | Bessette | 704/211 |

OTHER PUBLICATIONS

3GPP2, "Selectable Mode Vocoder Service Option for Wideband Spread Spectrum Communication Systems," Dec. 2001, C.S0030-0, Version 2.0, pp. 3-4, 13-14, 61, 143-145, 159-178, Figs. 5.3-1 and 5.6-1,2.

Baron, "Five Chips From TI—Or, Is It Six?" Microprocessor Report, Instat-MDR, Mar. 17, 2003, Figs. 1, 3, 4.

* cited by examiner

*Primary Examiner*—David R Hudspeth
*Assistant Examiner*—Matthew J Sked
(74) *Attorney, Agent, or Firm*—Wade J. Brady, III; Frederick J. Telecky, Jr.

(57) ABSTRACT

An electronic circuit includes storage circuitry and a speech coder coupled with the storage circuitry to have a codebook with sets of track location numbers for respective pulses, the speech coder operable to identify a group of track location numbers in the codebook substantially equally spaced from each other by a pitch lag amount, and make a selection from the group of track location numbers of a selected track location number. Other electronic circuits, processes, methods, devices and systems are disclosed and claimed.

35 Claims, 18 Drawing Sheets

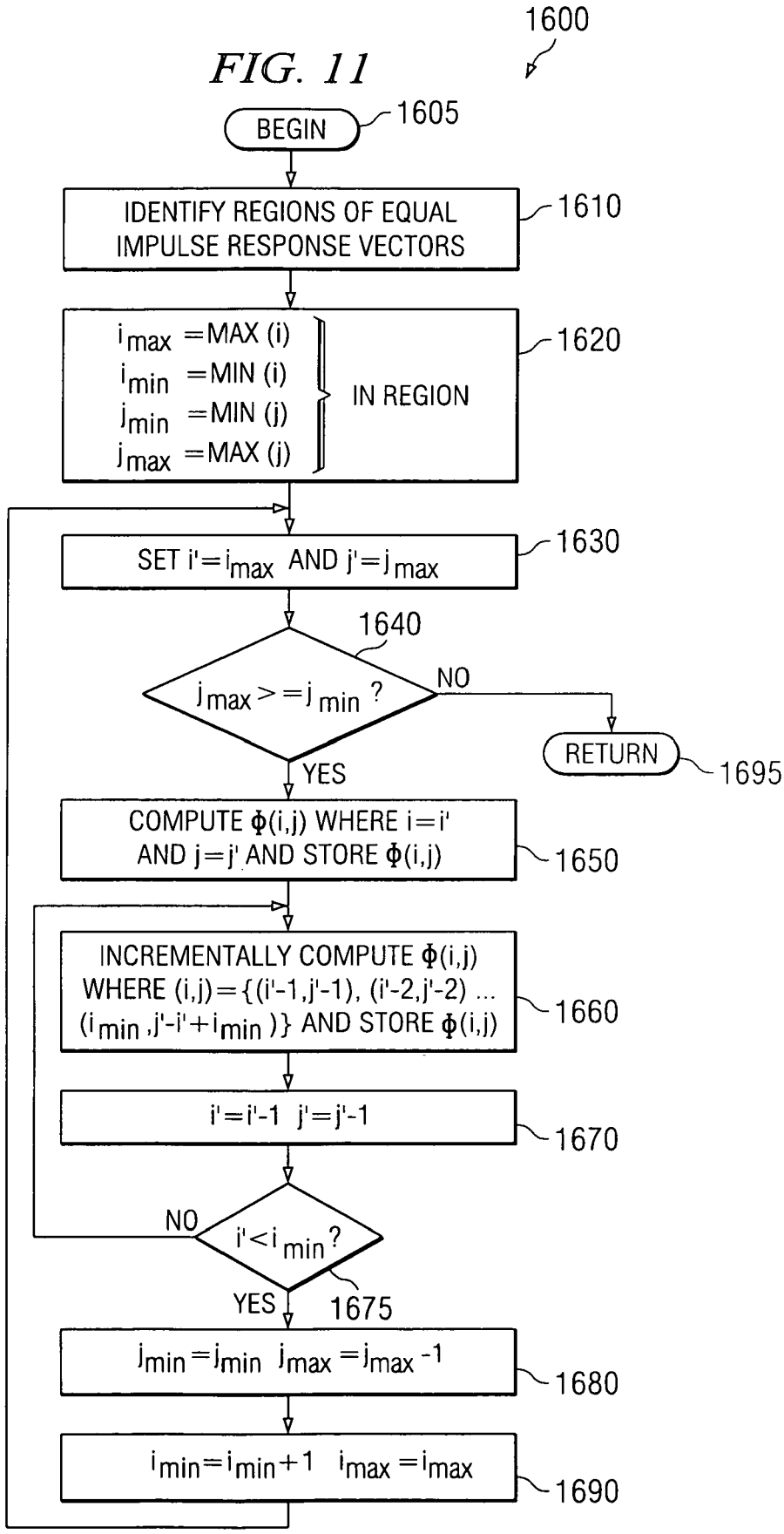
1600
FIG. 11
BEGIN
1605
IDENTIFY REGIONS OF EQUAL IMPULSE RESPONSE VECTORS
1610
$i_{max}$ =MAX (i)
$i_{min}$ =MIN (i)
$j_{min}$ =MIN (j)
$j_{max}$ =MAX (j)
IN REGION
1620
SET i'=$i_{max}$ AND j'=$j_{max}$
1630
1640
$j_{max}$ >=$j_{min}$ ?
NO
RETURN
1695
YES
COMPUTE Φ(i,j) WHERE i=i' AND j=j' AND STORE Φ(i,j)
1650
INCREMENTALLY COMPUTE Φ(i,j) WHERE (i,j)={(i'-1,j'-1), (i'-2,j'-2) ... ($i_{min}$ ,j'-i'+$i_{min}$ )} AND STORE Φ(i,j)
1660
i'=i'-1 j'=j'-1
1670
NO
i'<$i_{min}$ ?
YES
1675
$j_{min}$ =$j_{min}$ $j_{max}$ =$j_{max}$ -1
1680
$i_{min}$=$i_{min}$+1 $i_{max}$ =$i_{max}$
1690

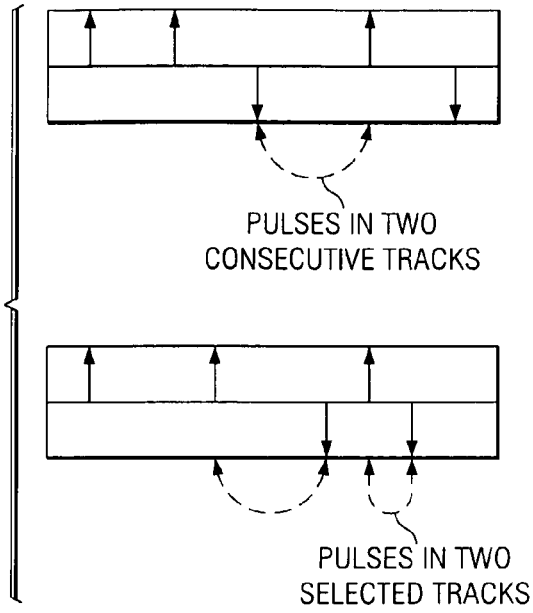
FIG. 15
FIG. 16A
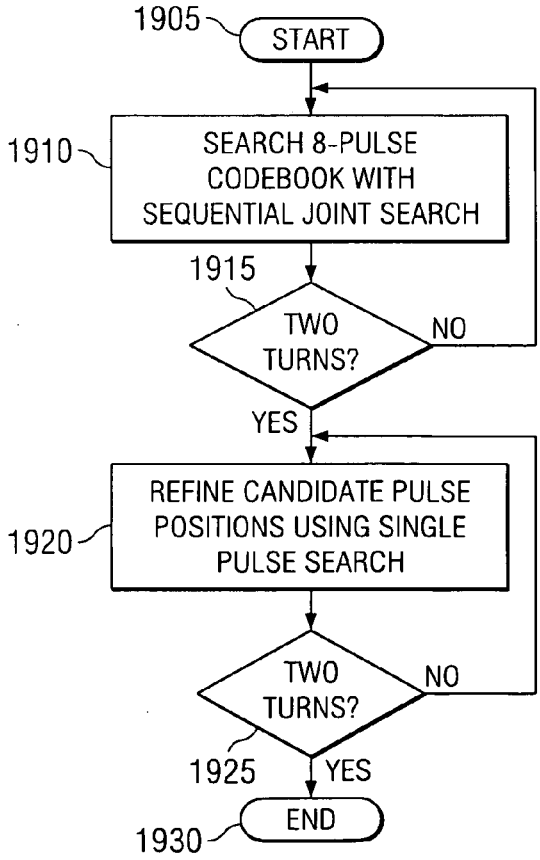
FIG. 16B
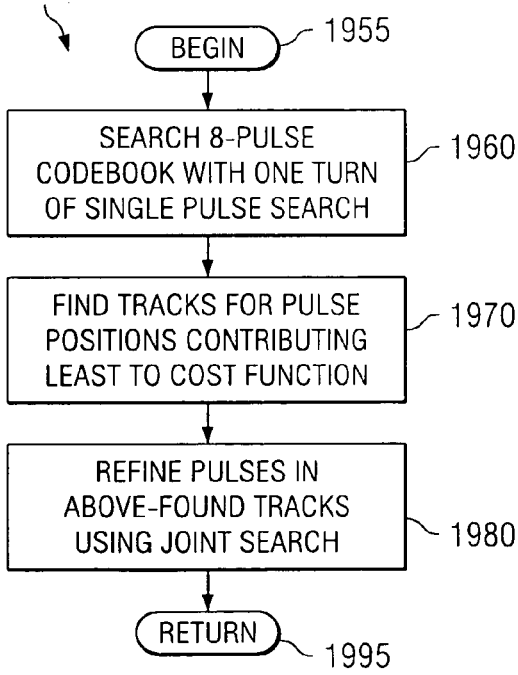

CIRCUITS, PROCESSES, DEVICES AND SYSTEMS FOR CODEBOOK SEARCH REDUCTION IN SPEECH CODERS

CROSS-REFERENCE TO RELATED APPLICATIONS

This application is related to provisional U.S. Patent Application Ser. No. 60/719,244, (TI-39675PS) filed Sep. 21, 2005, titled "Circuits, Processes, Devices and Systems for Algebraic Codebook Search Space Reduction In Stationary Voiced Frames," for which priority under 35 U.S.C. 119(e)(1) is hereby claimed and which is hereby incorporated herein by reference.

This application is related to co-assigned non-provisional U.S. patent application Ser. No. 11/231,643, (TI-38348) filed Sep. 21, 2005, titled "Methods, Devices and Systems for Improved Codebook Search for Voice Codecs," which is hereby incorporated herein by reference.

This application is related to co-assigned non-provisional U.S. patent application Ser. No. 11/231,686, (TI-38349) filed Sep. 21, 2005, titled "Methods, Devices And Systems For Improved Pitch Enhancement And Autocorrelation In Voice Codecs," which is hereby incorporated herein by reference.

STATEMENT REGARDING FEDERALLY SPONSORED RESEARCH OR DEVELOPMENT

Not applicable.

BACKGROUND OF THE INVENTION

This invention is in the field of information and communications, and is more specifically directed to improved processes, circuits, devices, and systems for information and communication processing, and processes of operating and making them. Without limitation, the background is further described in connection with wireless and wireline communications processing.

Wireless and wireline communications of many types have gained increasing popularity in recent years. The mobile wireless (or "cellular") telephone has become ubiquitous around the world. Mobile telephony has recently begun to communicate video and digital data, in addition to voice. Wireless devices, for communicating computer data over a wide area network, using mobile wireless telephone channels and techniques are also available. Wireline communications such as DSL and cable modems and wireline and wireless gateways to other networks are proliferating.

The market for portable devices such as cell phones and PDAs (personal digital assistants) is expanding with many more features and applications. More features and applications call for microprocessors to have high performance but with low power consumption. Thus, keeping the energy consumption for the microprocessor and related cores and chips to a minimum, given a set of performance requirements, is very important. In both the wireless and wireline areas, high efficiency of performance and in operational processes is essential to make affordable products available to a wider public.

Voice over Packet (VoP) communications are further expanding the options and user convenience in telephonic communications. An example is Voice over Internet Protocol (VoIP) enabling phone calls over the Internet.

Wireless and wireline data communications using wireless local area networks (WLAN), such as IEEE 802.11 compliant, have become especially popular in a wide range of installations, ranging from home networks to commercial establishments. Other wireless networks such as IEEE 802.16 (WiMax) are emerging. Short-range wireless data communication according to the "Bluetooth" and other IEEE 802.15 technology permits computer peripherals to communicate with a personal computer or workstation within the same room.

In very general terms, a speech coder or voice coder is based on the idea that the vocal chords and vocal tract are analogous to a filter. The vocal chords and vocal tract generally make a variety of sounds. Some sounds are voiced and generally have a pitch level or levels at a given time. Other sounds are unvoiced and have a rushing or whispering or sudden consonantal sound to them. To facilitate the voice coding process, voice sounds are converted into an electrical waveform by a microphone and analog to digital converter. The electrical waveform is conceptually cut up into successive frames of a few milliseconds in duration called a target signal. The frames are individually approximated by voice coder electronics.

In speech or voice coder electronics, pulses can be provided at different times to excite a filter. Each pulse has a very wide spectrum of frequencies which are comprised in the pulse. The filter selects some of the frequencies such as by passing only a band of frequencies, thus the term bandpass filter. Circuits and/or processes that provide various pulses, more or less filtered, excite the filter to supply as its output an approximation to the voice sounds of a target signal. Finding the appropriate pulses to use for the excitation pulses for the voice coder approximation purposes is involved in the subject of codebook search herein.

The filter(s) are characterized by a set of numbers called coefficients that, for example, may represent the impulse response over time when a filter is excited with a single pulse. Information identifying the appropriate pulses, and the values of the filter coefficients, and such other information as is desired, together compactly represent the speech in a given frame. The information is generated as bits of data by a processor chip that runs software or otherwise operates according to a speech coding procedure. Generally speaking, the output of a voice coder is this very compact representation which advantageously substitutes in communication for the vastly larger number of bits that would be needed to directly send over a communications network the voice signal converted into digital form at the output of the analog to digital converter were there no speech coding.

A speech or voice decoder is a coder in reverse in the sense that the decoder responds to the compact information sent over a network from a coder and produces a digital signal representing speech that can be converted by a digital-to-analog converter into an analog signal to produce actual sound in a loudspeaker or earphone.

Voice coders and decoders (codecs) run on RISC (Reduced Instruction Set Computing) or other processors and digital signal processing (DSP) chips and/or other integrated circuit devices that are vital to these systems and applications. Reducing the computer burden of voice codecs and increasing the efficiency of executing the software applications on these microprocessors generally are very important to achieve system performance and affordability goals. These goals become even more important in hand held and mobile applications where small size is so important, to control the real-estate, memory space and the power consumed.

SUMMARY OF THE INVENTION

Generally, a form of the invention involves an electronic circuit that includes storage circuitry and a speech coder coupled with the storage circuitry to have a codebook with sets of track location numbers for respective pulses, the speech coder operable to identify a group of track location numbers in the codebook substantially equally spaced from each other by a pitch lag amount, and make a selection from the group of track location numbers of a selected track location number.

Generally, another form of the invention involves an electronic circuit that includes storage circuitry and a speech coder coupled with the storage circuitry to have an original codebook with sets of track location numbers for respective pulses, the speech coder operable to reduce redundancy in the codebook by identifying groups of different track location numbers in the codebook regardless of set that have approximately the same evaluation, and to select a track location number from each group, and wherein the speech coder is further operable to store the selected track location numbers to subsets of track location numbers respectively corresponding to the sets of track location numbers for the respective pulses, whereby to store a reduced-size codebook.

Generally, a further form of the invention involves an electronic circuit that includes storage circuitry and a speech coder coupled with the storage circuitry and having a codebook and wherein the speech coder is operable to determine a parameter of speech and to perform a first type of search on the codebook and alternatively a pre-search of the codebook followed by a second type of search on results of the pre-search, the pre-search conferring a process efficiency advantage in a portion of cases identifiable by a condition on the parameter of speech, and the speech coder is further operable to determine the existence of the condition on the parameter of speech and activate the pre-search followed by the second type of search, and otherwise determine that the condition on the parameter of speech is absent, and bypass the pre-search and perform the first type of search process on that codebook instead.

Other forms of the invention involve systems, circuits, devices, wireline and wireless communication devices, processes and methods of operation, as disclosed and claimed.

BRIEF DESCRIPTION OF THE DRAWINGS

Here and in Ser. No. 11/231,686:

FIG. 11 is a flow chart representing an inventive method for operating a processor to generate each of several regions of the Phi matrix data structure of FIGS. 9, 10A, 10B, 10C for use in the inventive method for Pitch Enhancement of FIG. 8.

Figure 4:
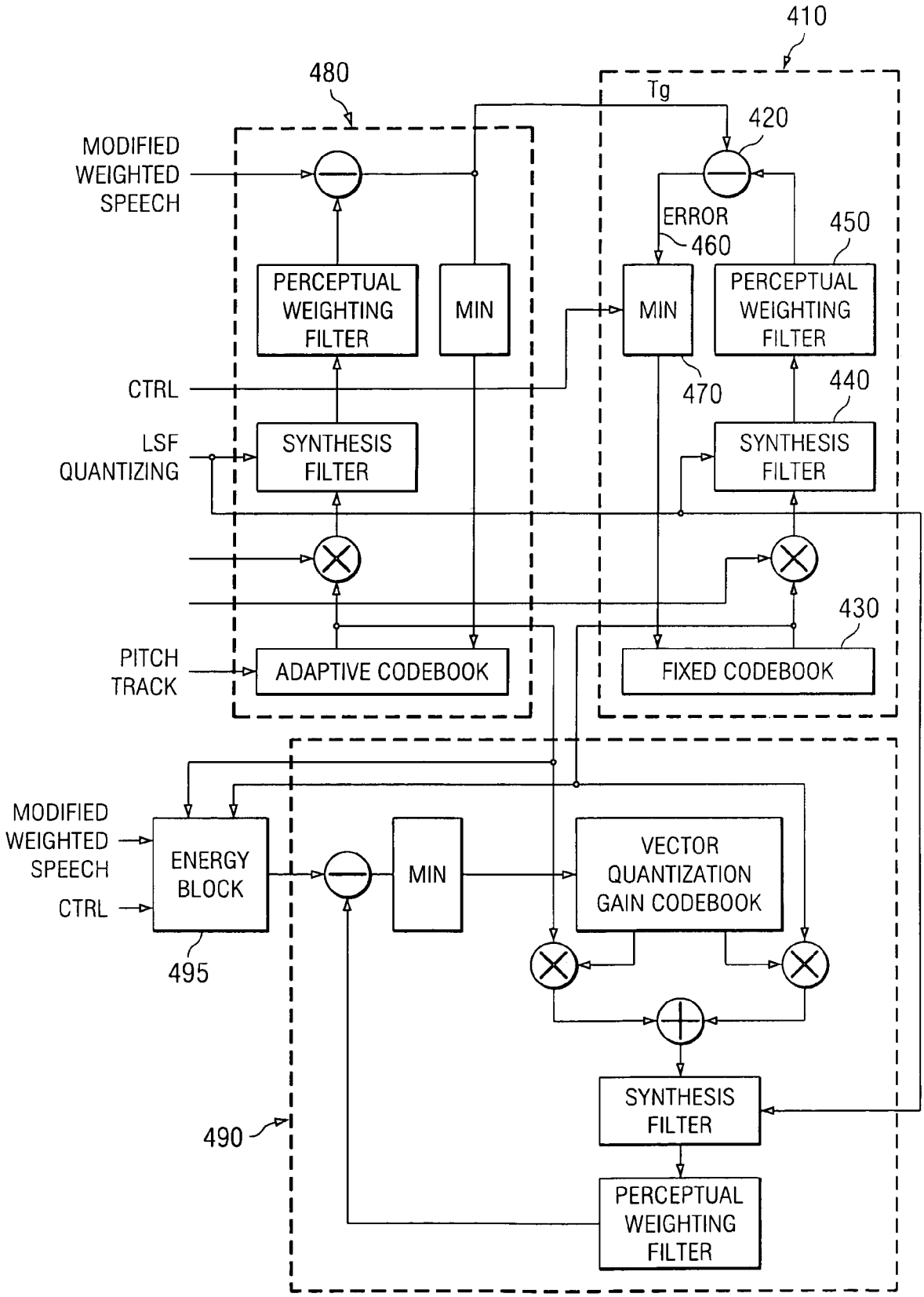
FIG. 4 is a more detailed process block diagram of a Rate and Type Dependent Processing block in FIG. 3, and having codebooks searched according to inventive improvements herein for exciting filter operation to approximate a target signal $T_g$.
Figure 5:
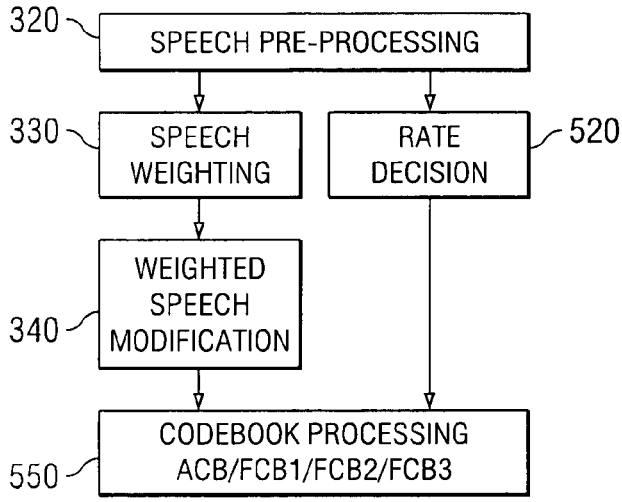
FIG. 5 is a process block diagram of SMV as example platform for inventive improvements to codebook searching as taught herein resulting in an inventive vocoder for the systems, devices and processes of FIGS. 1-4.
Figure 6:
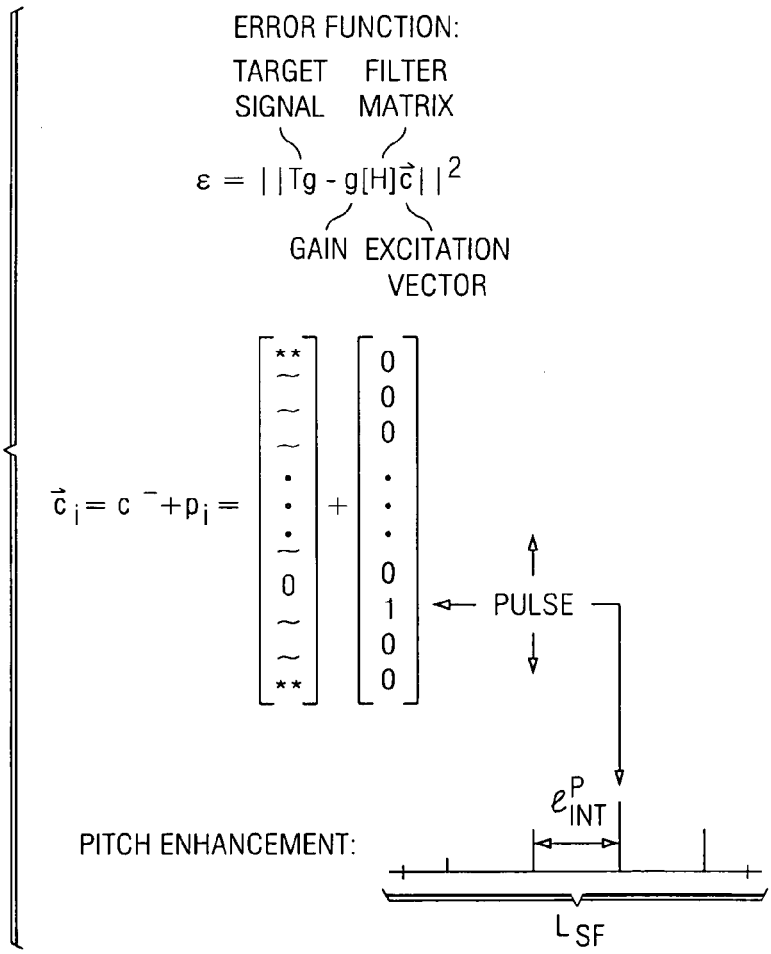
FIG. 6 is an illustration of a symbolic representation of data structures in which a target signal, filter, excitation, and pulses are used in the inventive improvements to the processes of FIGS. 3-6.
Figure 12:
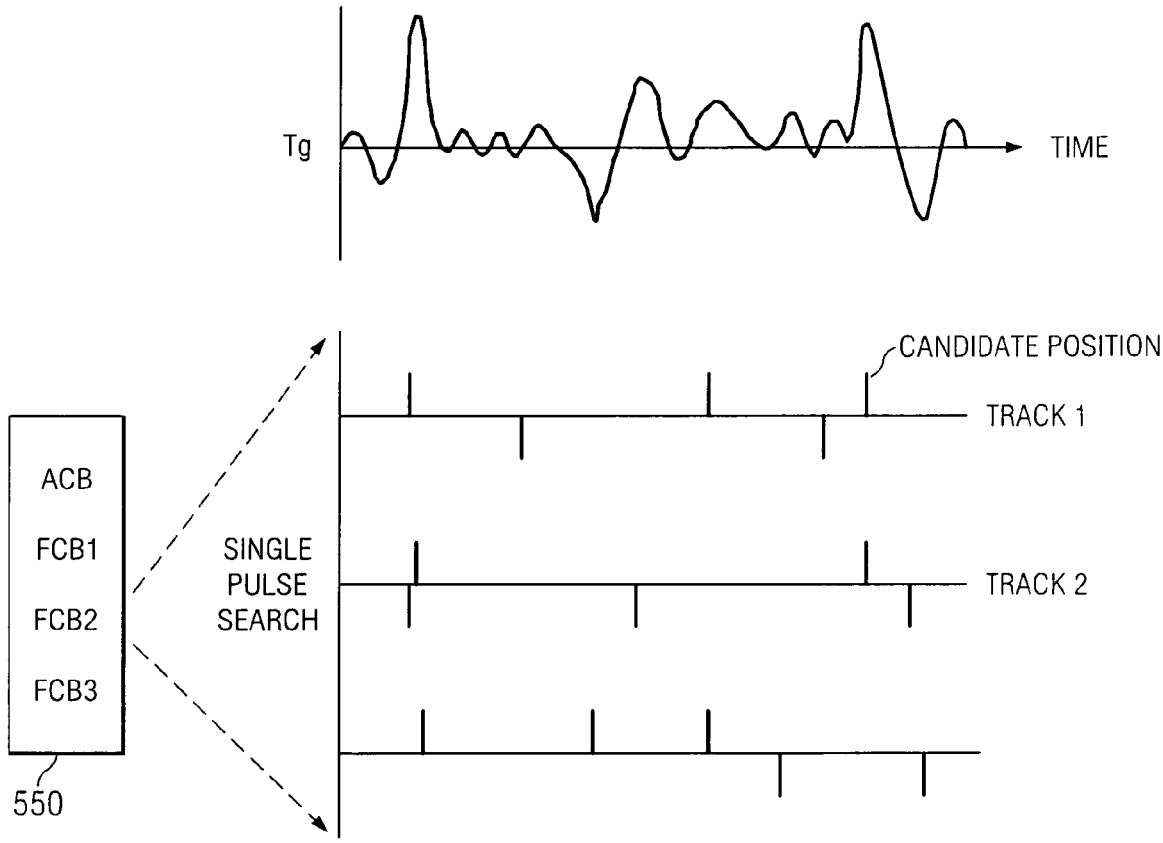

Here and in Ser. No. 11/231,643:

FIG. 12 is a composite illustration of a codebook block of FIG. 5 next to pulse tracks in a pulse search to find excitation pulses used with the filter of FIGS. 4 and 6 to approximate a target signal $T_g$.

Figure 13:
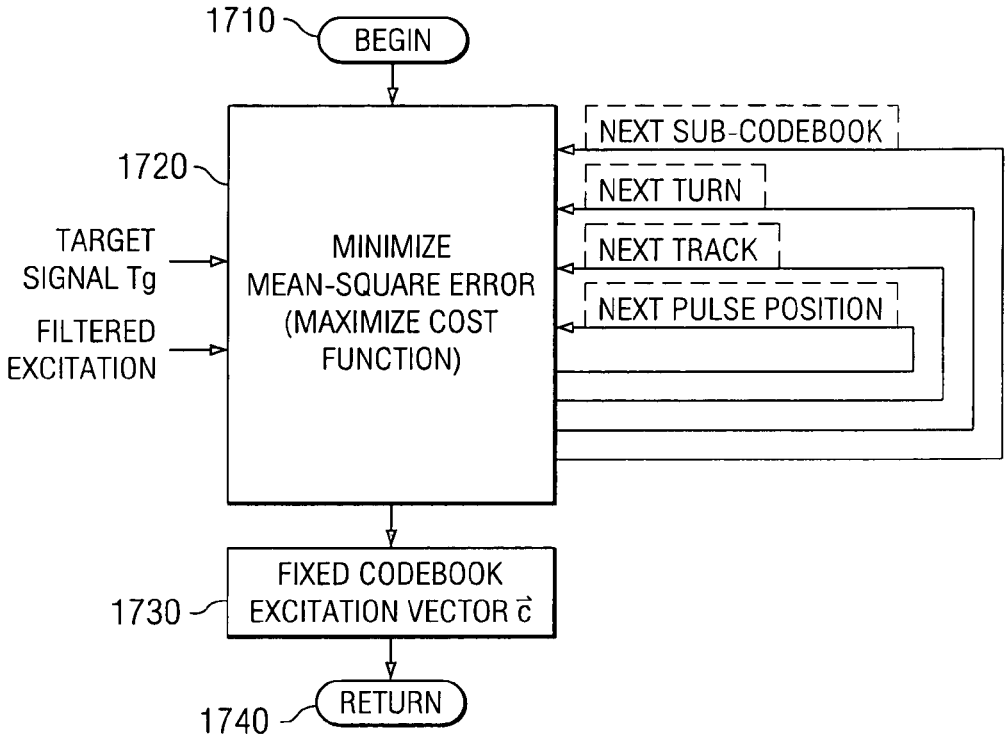

FIG. 13 is a process flow diagram of a single-pulse search procedure for finding excitation pulses in FIGS. 3-6 and FIG. 12.

Figure 14:
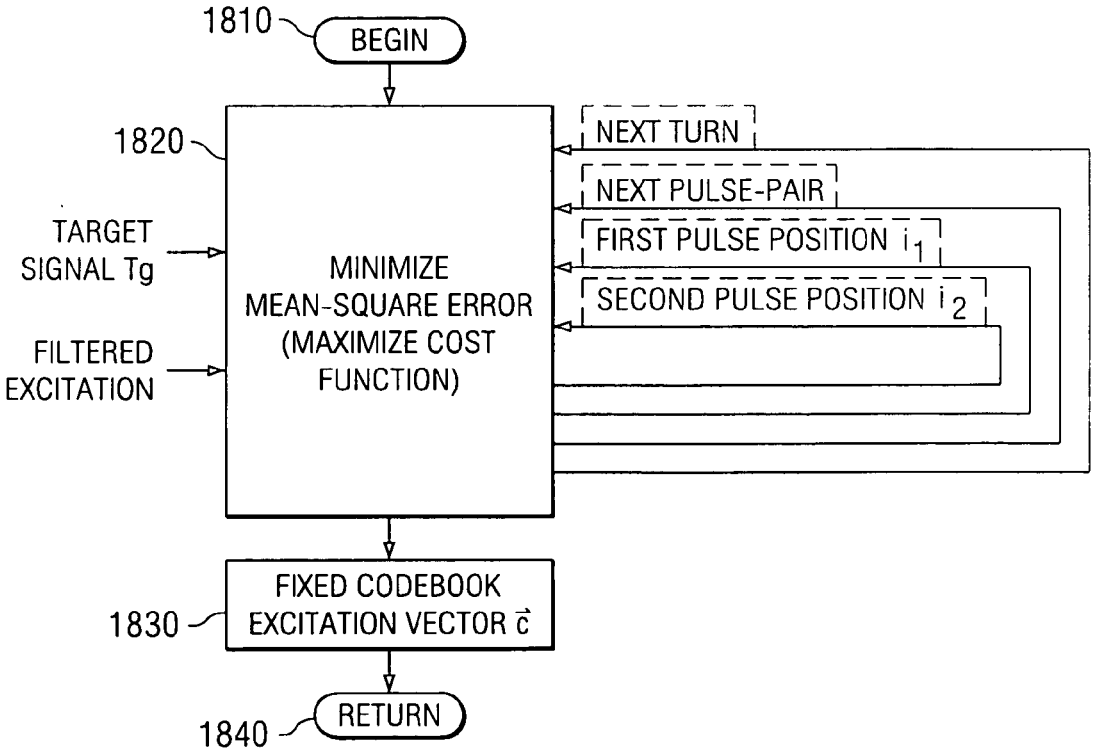

FIG. 14 is a process flow diagram of a 2-pulse sequential joint position search procedure for finding excitation pulses in FIGS. 3-6 and FIG. 12.

FIG. 15 is a composite diagram of pulses in tracks for illustrating an inventive Sequential Joint Search procedure for finding or determining excitation pulses in FIGS. 3-6 and FIG. 12.

FIG. 16A is a flow diagram of a standard SMV method of searching for pulses for Rate 1, voiced-stationary (Type 1) frames.

FIG. 16B is a flow diagram of an inventive method of finding or determining excitation pulses in FIGS. 3-6 and FIG. 12 for Rate 1, voiced-stationary (Type 1) frames.

Figure 17A:
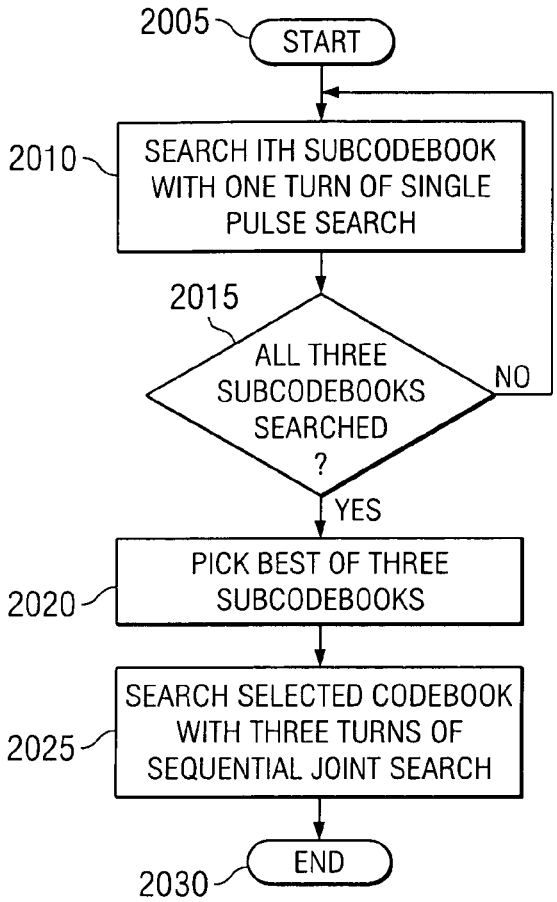

FIG. 17A is a flow diagram of a standard SMV method of searching for pulses for Rate 1, voiced non-stationary (Type 0) frames.

Figure 17B:
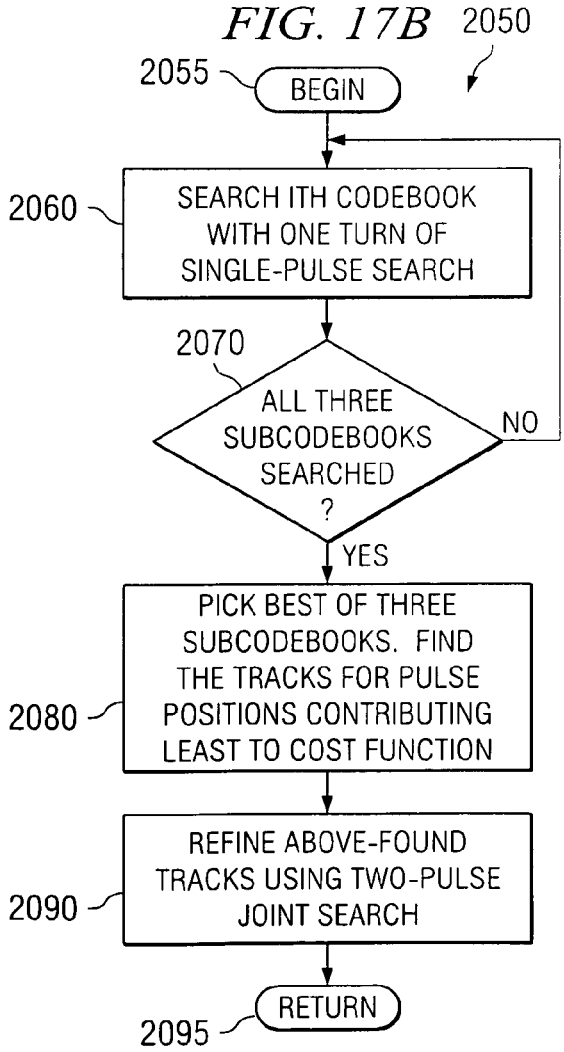

FIG. 17B is a flow diagram of an inventive method of finding or determining excitation pulses in FIGS. 3-6 and FIG. 12 for Rate 1, voiced non-stationary (Type 0) frames.

Figure 18:
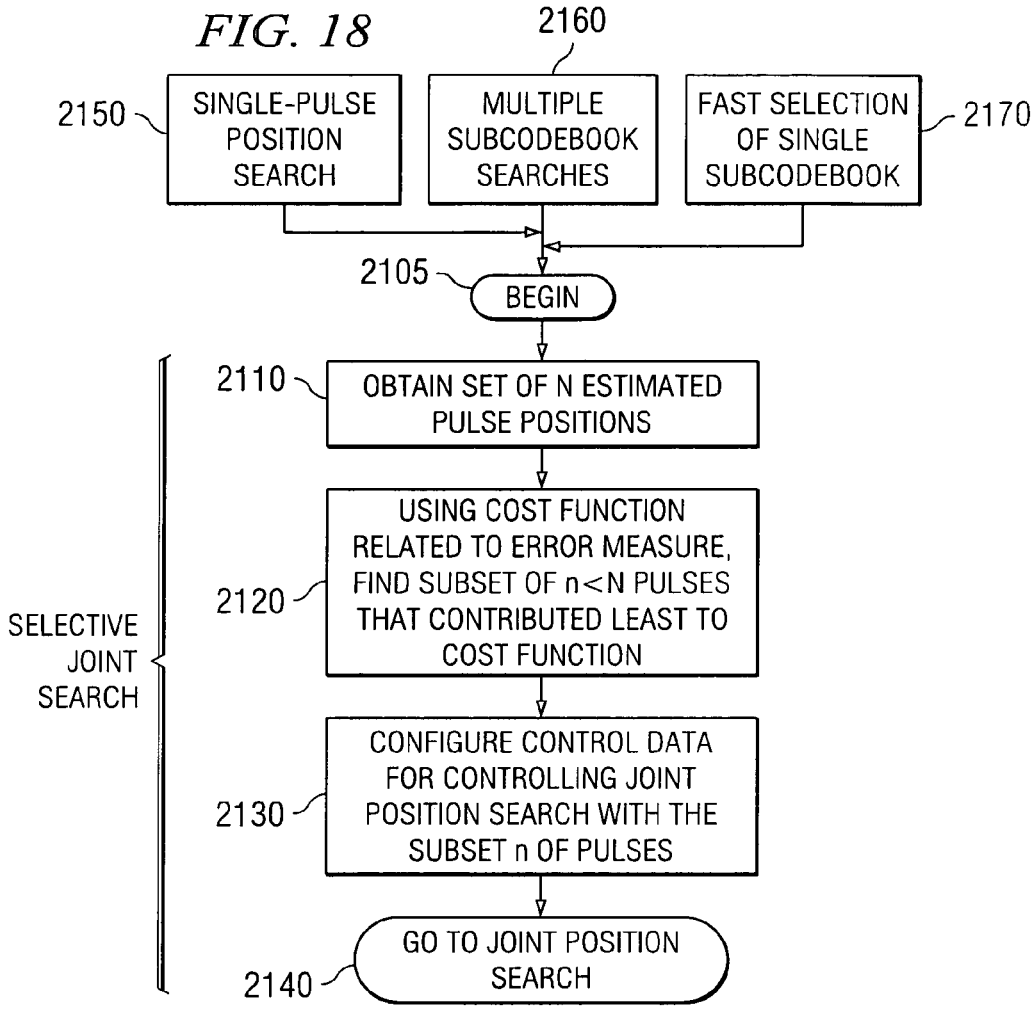

FIG. 18 is a flow diagram of an inventive method of finding or determining excitation pulses in FIGS. 3-6 and FIG. 12 for voiced frames wherein the flow diagram shows some inventive features common to inventive processes in FIGS. 16B, 17B, 19 and 20.

Figure 19:
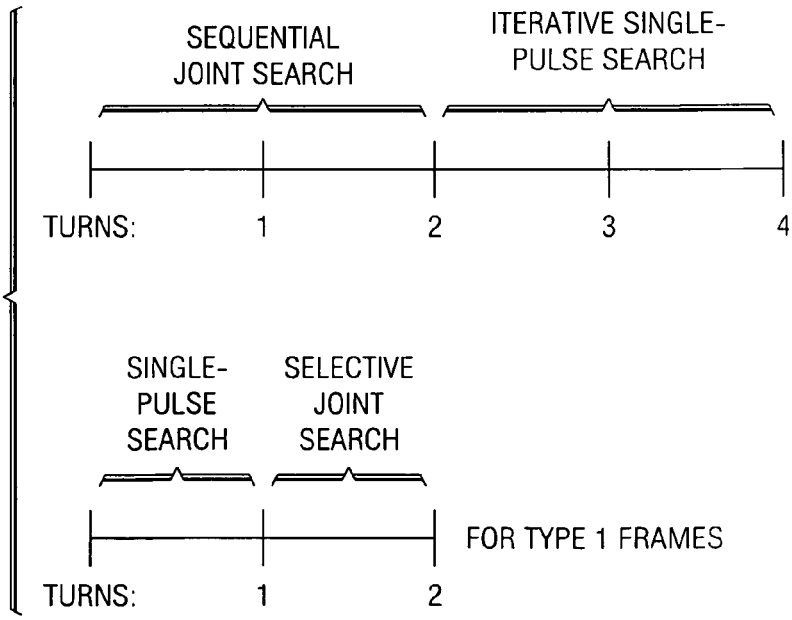

FIG. 19 is a timing diagram of an inventive method of finding or determining excitation pulses in FIGS. 3-6 and FIG. 12 for voiced stationary (Type 1) frames.

Figure 20:
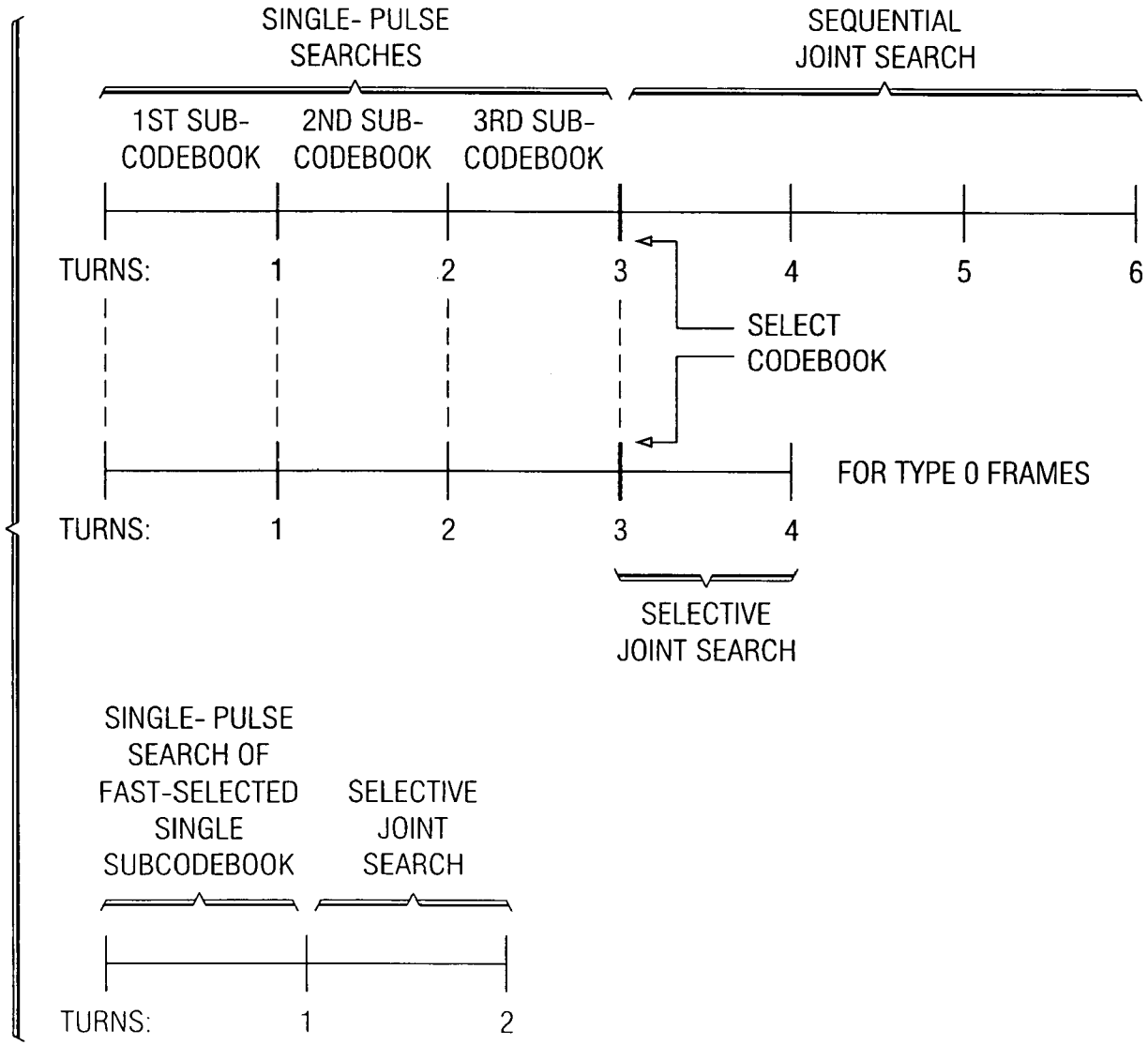

FIG. 20 is a timing diagram of an inventive method of finding or determining excitation pulses in FIGS. 3-6 and FIG. 12 for voiced non-stationary (Type 0) frames.

Further Herein

Figure 21:
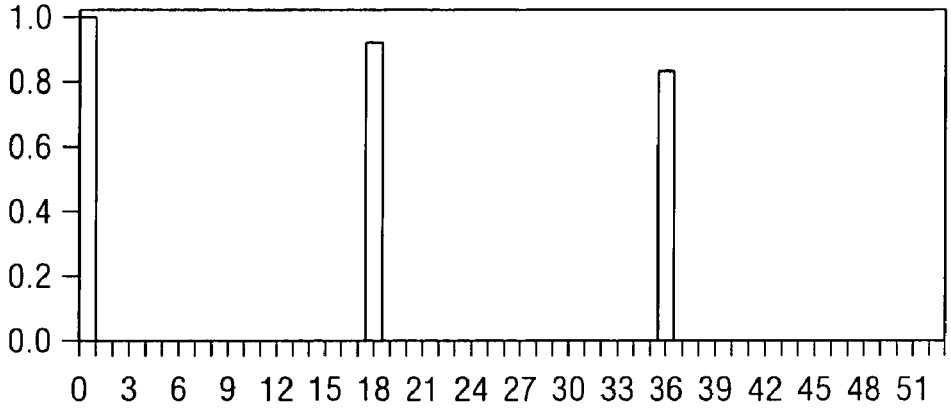
Figure 22:
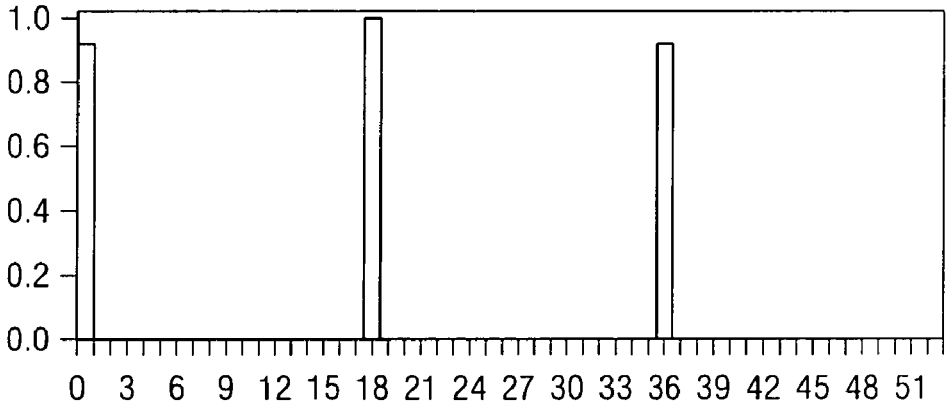
Figure 23:
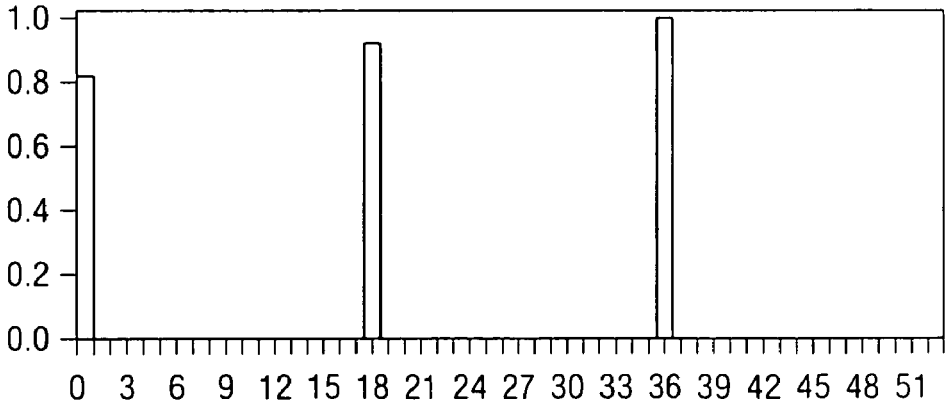

FIGS. 21, 22 and 23 are timing diagrams of nearly equivalent pulse trains of differently positioned main pulses and their pitch enhancement pulses.

Figure 24:
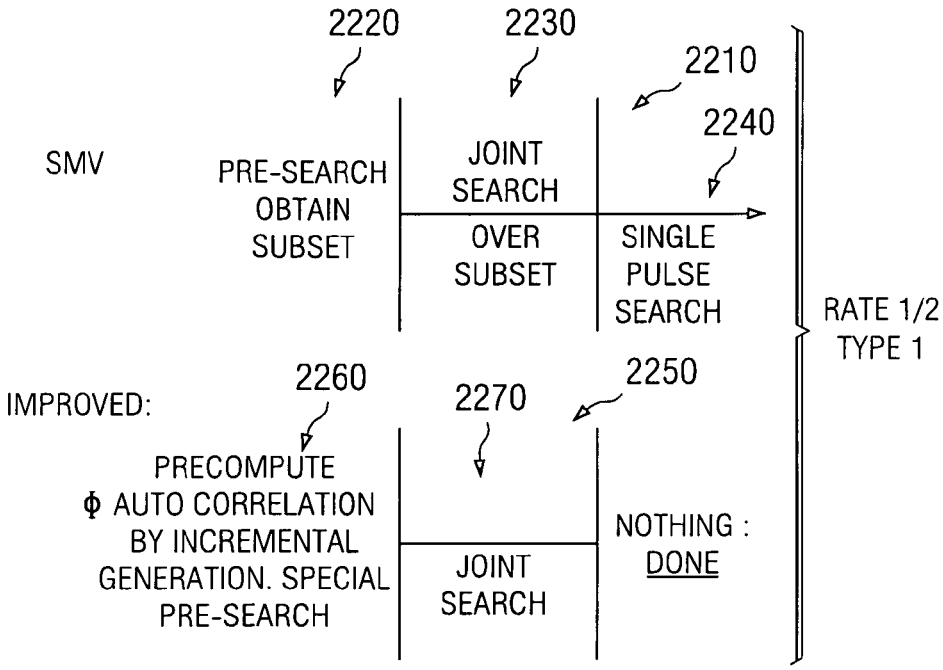

FIG. 24 is a timing diagram of inventive method of Half Rate Two-Pulse fixed codebook search used when pitch lag is less than 49.

Figure 25:
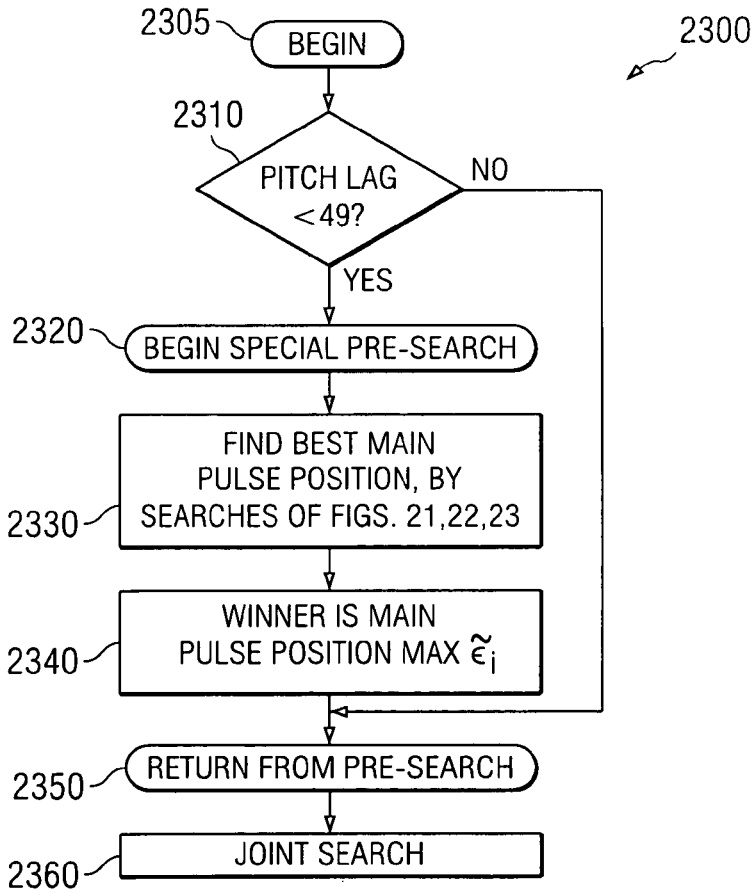

FIG. 25 is a flow diagram of inventive method of Half Rate Two-Pulse fixed codebook search used when pitch lag is less than 49.

Figure 26:
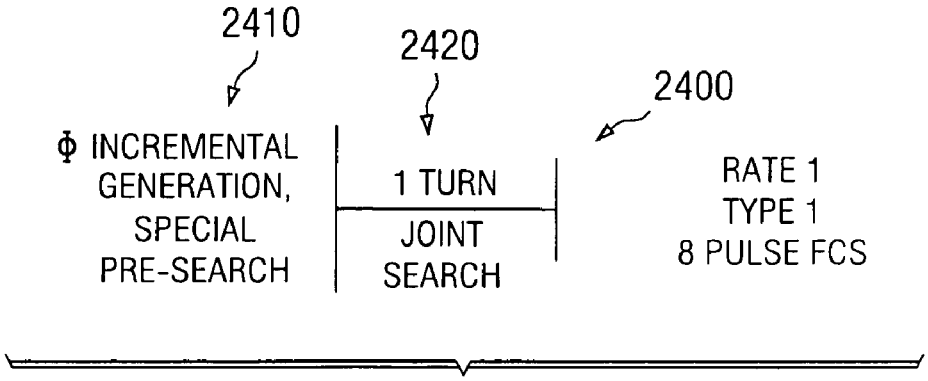

FIG. 26 is a timing diagram of inventive method of Full Rate Eight-Pulse fixed codebook search used when pitch lag is less than 33.

Figure 27:
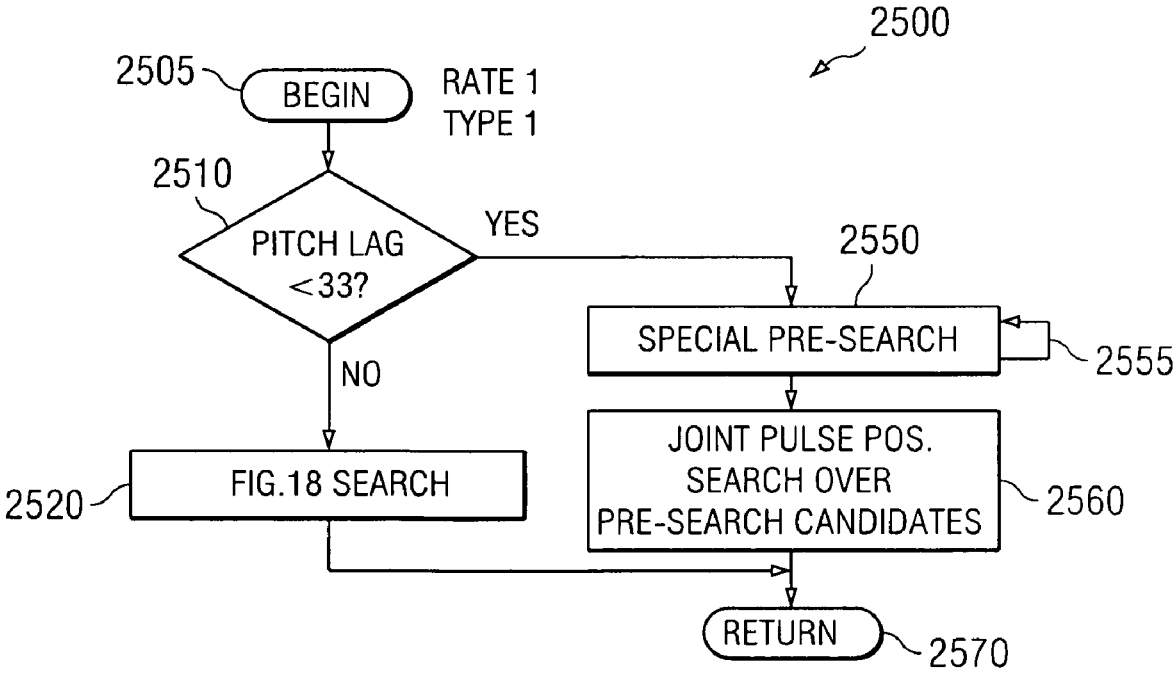

FIG. 27 is a flow diagram of inventive method of Full Rate Eight-Pulse fixed codebook search used when pitch lag is less than 33.

Corresponding numerals ordinarily identify corresponding parts in the various Figures of the drawing except where the context indicates otherwise.

DETAILED DESCRIPTION

Figure 1:
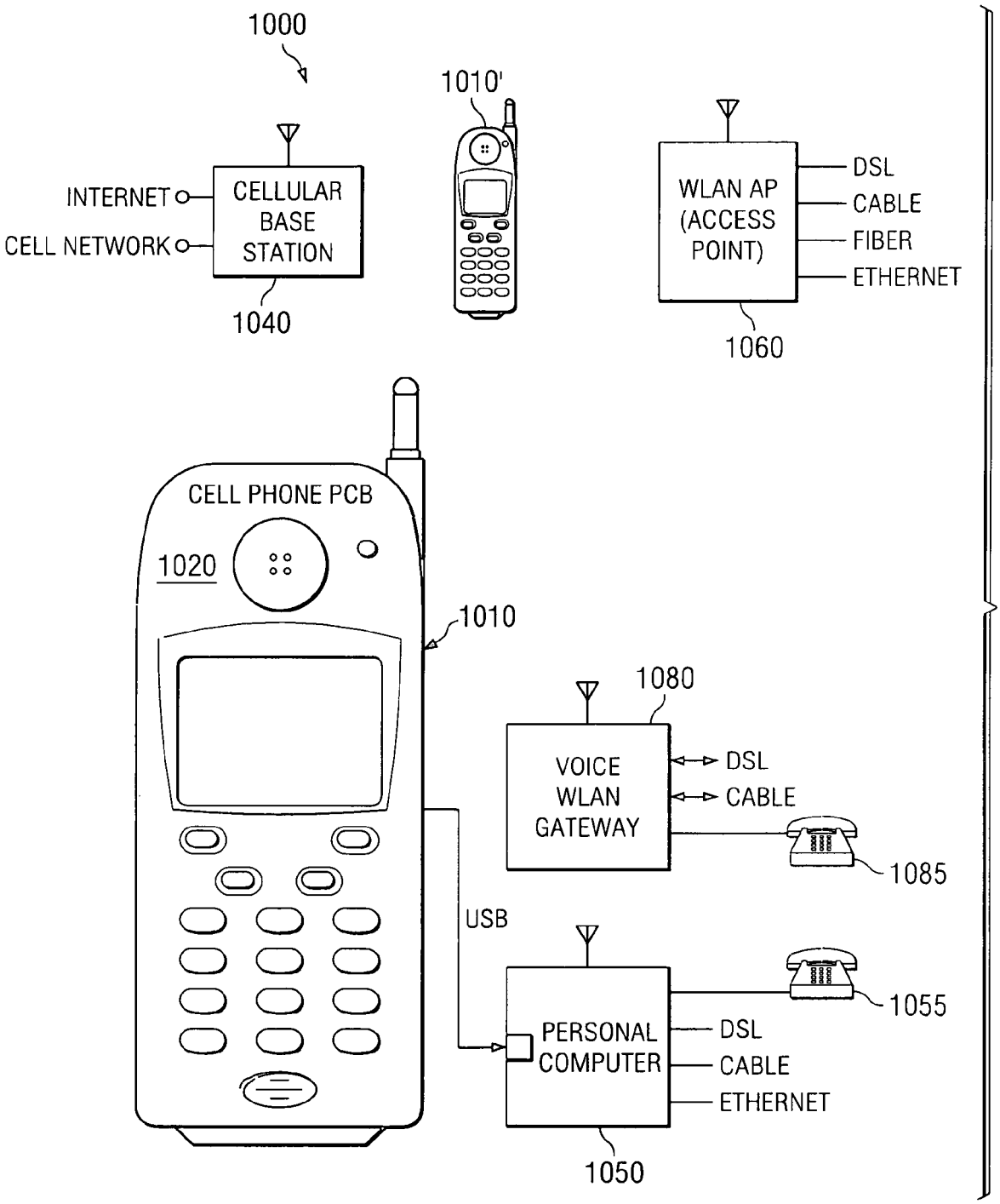
FIG. 1 is a pictorial diagram of a communications system including a cellular base station, two cellular telephone handsets, a WLAN AP (wireless local area network access point), a WLAN gateway with VoP phone, a personal computer (PC) with VoP phone, a WLAN station on the PC, and any one, some or all of the foregoing improved according to the invention.

In FIG. 1, an improved communications system 1000 has system blocks as described next. Any or all of the system blocks, such as cellular mobile telephone and data handsets 1010 and 1010', a cellular (telephony and data) base station 1040, a WLAN AP (wireless local area network access point, IEEE 802.11 or otherwise) 1060, a Voice WLAN gateway 1080 with user voice over packet telephone 1085, and a voice enabled personal computer (PC) 1050 with another user voice over packet telephone 1055, communicate with each other in communications system 1000. Each of the system blocks 1010, 1010', 1040, 1050, 1060, 1080 are provided with one or more PHY physical layer blocks and interfaces as selected by the skilled worker in various products, for DSL (digital subscriber line broadband over twisted pair copper infrastructure), cable (DOCSIS and other forms of coaxial cable broadband communications), premises power wiring, fiber (fiber optic cable to premises), and Ethernet wideband network. Cellular base station 1040 two-way communicates with the handsets 1010, 1010', with the Internet, with cellular communications networks and with PSTN (public switched telephone network).

In this way, advanced networking capability for services, software, and content, such as cellular telephony and data, audio, music, voice, video, e-mail, gaming, security, e-commerce, file transfer and other data services, internet, world wide web browsing, TCP/IP (transmission control protocol/Internet protocol), voice over packet and voice over Internet protocol (VoP/VoIP), and other services accommodates and provides security for secure utilization and entertainment appropriate to the just-listed and other particular applications.

The embodiments, applications and system blocks disclosed herein are suitably implemented in fixed, portable, mobile, automotive, seaborne, and airborne, communications, control, set top box, and other apparatus. The personal computer (PC) 1050 is suitably implemented in any form factor such as desktop, laptop, palmtop, organizer, mobile phone handset, PDA personal digital assistant, internet appliance, wearable computer, personal area network, or other type.

Figure 2:
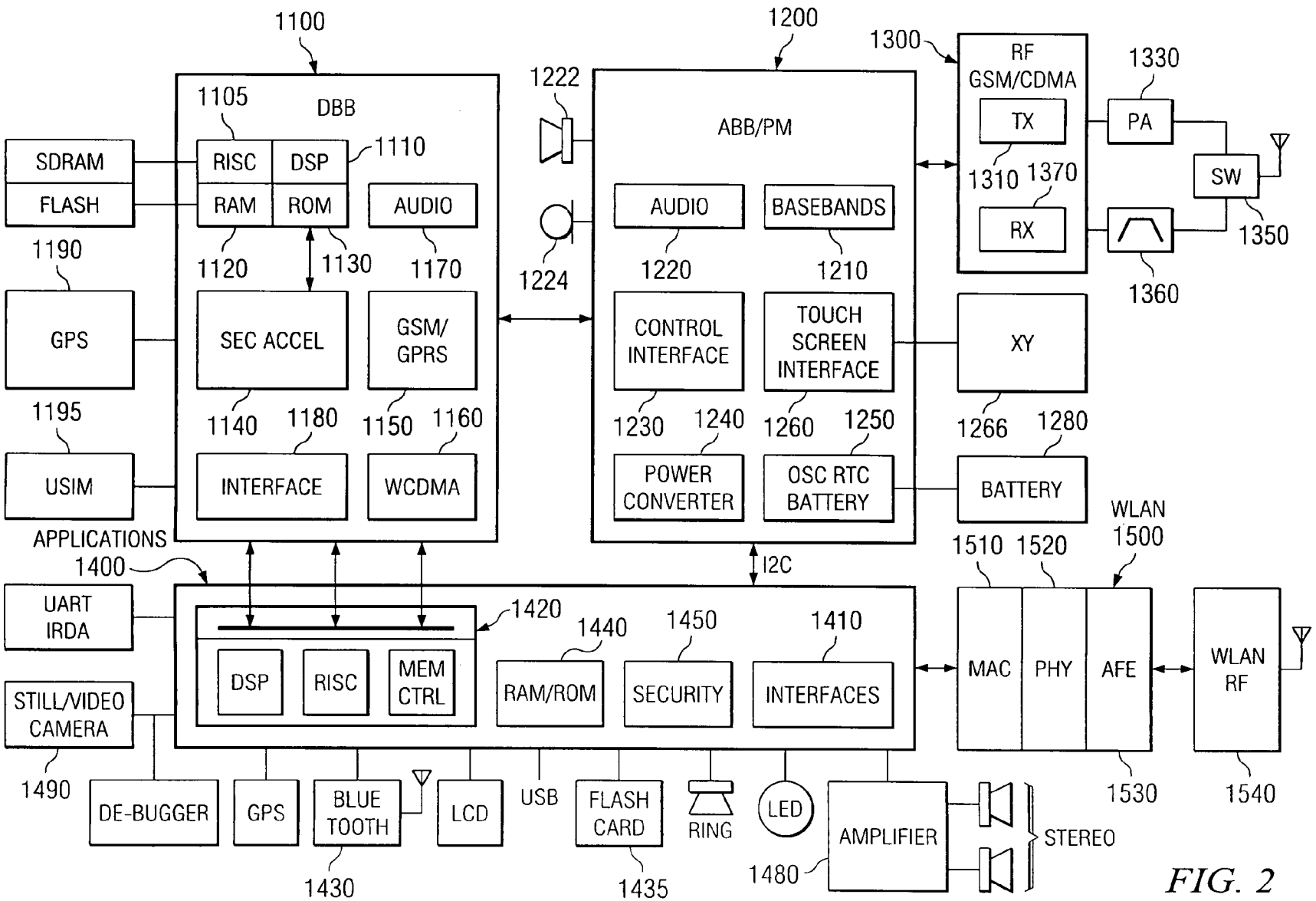
FIG. 2 is a block diagram of an inventive integrated circuit chip device with any subset or all of the chip circuits for use in the blocks of the communications system of FIG. 1 and improved according to the invention.

For example, handset 1010 is improved and remains interoperable and able to communicate with all other similarly improved and unimproved system blocks of communications system 1000. On a cell phone printed circuit board (PCB) 1020 in handset 1010, FIGS. 1 and 2 show a processor integrated circuit and a serial interface such as a USB interface connected by a USB line to the personal computer 1050. Reception of software, intercommunication and updating of information are provided between the personal computer 1050 (or other originating sources external to the handset 1010) and the handset 1010. Such intercommunication and updating also occur automatically and/or on request via WLAN, Bluetooth, or other wireless circuitry.

FIG. 2 illustrates inventive integrated circuit chips including chips 1100, 1200, 1300, 1400, 1500 for use in the blocks of the communications system 1000 of FIG. 1. The skilled worker uses and adapts the integrated circuits to the particular parts of the communications system 1000 as appropriate to the functions intended. For conciseness of description, the integrated circuits are described with particular reference to use of all of them in the cellular telephone handsets 1010 and 1010' by way of example.

It is contemplated that the skilled worker uses each of the integrated circuits shown in FIG. 2, or such selection from the complement of blocks therein provided into appropriate other integrated circuit chips, or provided into one single integrated circuit chip, in a manner optimally combined or partitioned between the chips, to the extent needed by any of the applications supported by the cellular telephone base station 1040, personal computer(s) 1050 equipped with WLAN, WLAN access point 1060 and Voice WLAN gateway 1080, as well as cellular telephones, radios and televisions, fixed and portable entertainment units, routers, pagers, personal digital assistants (PDA), organizers, scanners, faxes, copiers, household appliances, office appliances, combinations thereof, and other application products now known or hereafter devised in which there is desired increased, partitioned or selectively determinable advantages next described.

In FIG. 2, an integrated circuit 1100 includes a digital baseband (DBB) block that has a RISC processor 1105 (such as MIPS core, ARM processor, or other suitable RISC or CISC processor) and a digital signal processor (or DSP core) 1110, communications software and security software for any such processor or core, security accelerators 1140, and a memory controller. The memory controller interfaces the RISC core and the DSP core to Flash memory and SDRAM (synchronous dynamic random access memory). The memories are improved by any one or more of the processes herein. On chip RAM 1120 and on-chip ROM 1130 also are accessible to the processors 1110 for providing sequences of software instructions and data thereto.

Digital circuitry 1150 on integrated circuit 1100 supports and provides wireless interfaces for any one or more of GSM, GPRS, EDGE, UMTS, and OFDMA/MIMO (Global System for Mobile communications, General Packet Radio Service, Enhanced Data Rates for Global Evolution, Universal Mobile Telecommunications System, Orthogonal Frequency Division Multiple Access and Multiple Input Multiple Output Antennas) wireless, with or without high speed digital data service, via an analog baseband chip 1200 and GSM transmit/receive chip 1300. Digital circuitry 1150 includes ciphering processor CRYPT for GSM ciphering and/or other encryption/decryption purposes. Blocks TPU (Time Processing Unit real-time sequencer), TSP (Time Serial Port), GEA (GPRS Encryption Algorithm block for ciphering at LLC logical link layer), RIF (Radio Interface), and SPI (Serial Port Interface) are included in digital circuitry 1150.

Digital circuitry 1160 provides codec for CDMA (Code Division Multiple Access), CDMA2000, and/or WCDMA (wideband CDMA or UMTS) wireless with or without an HSDPA/HSUPA (High Speed Downlink Packet Access, High Speed Uplink Packet Access) (or 1xEV-DV, 1xEV-DO or 3xEV-DV) data feature via the analog baseband chip 1200 and an RF GSM/CDMA chip 1300. Digital circuitry 1160 includes blocks MRC (maximal ratio combiner for multipath symbol combining), ENC (encryption/decryption), RX (downlink receive channel decoding, de-interleaving, viterbi decoding and turbo decoding) and TX (uplink transmit convolutional encoding, turbo encoding, interleaving and channelizing.). Block ENC has blocks for uplink and downlink supporting confidentiality processes of WCDMA.

Audio/voice block 1170 supports audio and voice functions and interfacing. Speech/voice codec(s) are suitably provided in memory space in audio/voice block 1170 for processing by processor(s) 1110. Applications interface block 1180 couples the digital baseband chip 1100 to an applications processor 1400. Also, a serial interface in block 1180 interfaces from parallel digital busses on chip 1100 to USB (Universal Serial Bus) of PC (personal computer) 1050. The serial interface includes UARTs (universal asynchronous receiver/transmitter circuit) for performing the conversion of data between parallel and serial lines. Chip 1100 is coupled to location-determining circuitry 1190 for GPS (Global Positioning System). Chip 1100 is also coupled to a USIM (UMTS Subscriber Identity Module) 1195 or other SIM for user insertion of an identifying plastic card, or other storage element, or for sensing biometric information to identify the user and activate features.

In FIG. 2, a mixed-signal integrated circuit 1200 includes an analog baseband (ABB) block 1210 for GSM/GPRS/EDGE/UMTS/HSDPA which includes SPI (Serial Port Interface), digital-to-analog/analog-to-digital conversion DAC/ADC block, and RF (radio frequency) Control pertaining to GSM/GPRS/EDGE/UMTS and coupled to RF (GSM etc.) chip 1300. Block 1210 suitably provides an analogous ABB for CDMA wireless and any associated 1xEV-DV, 1xEV-DO or 3xEV-DV data and/or voice with its respective SPI (Serial Port Interface), digital-to-analog conversion DAC/ADC block, and RF Control pertaining to CDMA and coupled to RF (CDMA) chip 1300.

An audio block 1220 has audio I/O (input/output) circuits to a speaker 1222, a microphone 1224, and headphones (not shown). Audio block 1220 has an analog-to-digital converter (ADC) coupled to the voice codec and a stereo DAC (digital to analog converter) for a signal path to the baseband block 1210 including audio/voice block 1170, and with suitable encryption/decryption activated or not.

A control interface 1230 has a primary host interface (I/F) and a secondary host interface to DBB-related integrated circuit 1100 of FIG. 2 for the respective GSM and CDMA paths. The integrated circuit 1200 is also interfaced to an I2C port of applications processor chip 1400 of FIG. 2. Control interface 1230 is also coupled via access arbitration circuitry to the interfaces in circuits 1250 and the baseband 1210.

A power conversion block 1240 includes buck voltage conversion circuitry for DC-to-DC conversion, and low-dropout (LDO) voltage regulators for power management/sleep mode of respective parts of the chip regulated by the LDOs. Power conversion block 1240 provides information to and is responsive to a power control state machine shown between the power conversion block 1240 and circuits 1250.

Circuits 1250 provide oscillator circuitry for clocking chip 1200. The oscillators have frequencies determined by one or more crystals. Circuits 1250 include a RTC real time clock (time/date functions), general purpose I/O, a vibrator drive (supplement to cell phone ringing features), and a USB On-The-Go (OTG) transceiver. A touch screen interface 1260 is coupled to a touch screen XY 1266 off-chip.

Batteries such as a lithium-ion battery 1280 and backup battery provide power to the system and battery data to circuit 1250 on suitably provided separate lines from the battery pack. When needed, the battery 1280 also receives charging current from a Battery Charge Controller in analog circuit 1250 which includes MADC (Monitoring ADC and analog input multiplexer such as for on-chip charging voltage and current, and battery voltage lines, and off-chip battery voltage, current, temperature) under control of the power control state machine.

In FIG. 2 an RF integrated circuit 1300 includes a GSM/GPRS/EDGE/UMTS/CDMA RF transmitter block 1310 supported by oscillator circuitry with off-chip crystal (not shown). Transmitter block 1310 is fed by baseband block 1210 of chip 1200. Transmitter block 1310 drives a dual band RF power amplifier (PA) 1330. On-chip voltage regulators maintain appropriate voltage under conditions of varying power usage. Off-chip switchplexer 1350 couples wireless antenna and switch circuitry to both the transmit portion 1310, 1330 and the receive portion next described. Switchplexer 1350 is coupled via band-pass filters 1360 to receiving LNAs (low noise amplifiers) for 850/900 MHz, 1800 MHz, 1900 MHz and other frequency bands as appropriate. Depending on the band in use, the output of LNAs couples to GSM/GPRS/EDGE/UMTS/CDMA demodulator 1370 to produce the I/Q or other outputs thereof (in-phase, quadrature) to the GSM/GPRS/EDGE/UMTS/CDMA baseband block 1210.

Further in FIG. 2, an integrated circuit chip or core 1400 is provided for applications processing and more off-chip peripherals. Chip (or core) 1400 has interface circuit 1410 including a high-speed WLAN 802.11a/b/g interface coupled to a WLAN chip 1500. Further provided on chip 1400 is an applications processing section 1420 which includes a RISC processor (such as MIPS core, ARM processor, or other suitable processor), a digital signal processor (DSP), and a shared memory controller MEM CTRL with DMA (direct memory access), and a 2D (two-dimensional display) graphic accelerator. Speech/voice codec functionality is suitably processed in chip 1400, in chip 1100, or both chips 1400 and 1100.

The RISC processor and the DSP in section 1420 have access via an on-chip extended memory interface (EMIF/CF) to off-chip memory resources 1435 including as appropriate, mobile DDR (double data rate) DRAM, and flash memory of any of NAND Flash, NOR Flash, and Compact Flash. On chip 1400, the shared memory controller in circuitry 1420 interfaces the RISC processor and the DSP via an on-chip bus to on-chip memory 1440 with RAM and ROM. A 2D graphic accelerator is coupled to frame buffer internal SRAM (static random access memory) in block 1440. A security block 1450 includes secure hardware accelerators having security features and provided for accelerating encryption and decryption of any one or more types known in the art or hereafter devised.

On-chip peripherals and additional interfaces 1410 include UART data interface and MCSI (Multi-Channel Serial Interface) voice wireless interface for an off-chip IEEE 802.15 ("Bluetooth" and high and low rate piconet and personal network communications) wireless circuit 1430. Debug messaging and serial interfacing are also available through the UART. A JTAG emulation interface couples to an off-chip emulator Debugger for test and debug. Further in peripherals 1410 are an I2C interface to analog baseband ABB chip 1200, and an interface to applications interface 1180 of integrated circuit chip 1100 having digital baseband DBB.

Interface 1410 includes a MCSI voice interface, a UART interface for controls, and a multi-channel buffered serial port (McBSP) for data. Timers, interrupt controller, and RTC (real time clock) circuitry are provided in chip 1400. Further in peripherals 1410 are a MicroWire (u-wire 4 channel serial port) and multi-channel buffered serial port (McBSP) to off-chip Audio codec, a touch-screen controller, and audio amplifier 1480 to stereo speakers. External audio content and touch screen (in/out) and LCD (liquid crystal display) are suitably provided. Additionally, an on-chip USB OTG interface couples to off-chip Host and Client devices. These USB communications are suitably directed outside handset 1010 such as to PC 1050 (personal computer) and/or from PC 1050 to update the handset 1010.

An on-chip UART/IrDA (infrared data) interface in interfaces 1410 couples to off-chip GPS (global positioning system) and Fast IrDA infrared wireless communications device. An interface provides EMT9 and Camera interfacing to one or more off-chip still cameras or video cameras 1490, and/or to a CMOS sensor of radiant energy. Such cameras and other apparatus all have additional processing performed with greater speed and efficiency in the cameras and apparatus and in mobile devices coupled to them with improvements as described herein. Further in FIG. 2, an on-chip LCD controller and associated PWL (Pulse-Width Light) block in interfaces 1410 are coupled to a color LCD display and its LCD light controller off-chip.

Further, on-chip interfaces 1410 are respectively provided for off-chip keypad and GPIO (general purpose input/output). On-chip LPG (LED Pulse Generator) and PWT (Pulse-Width Tone) interfaces are respectively provided for off-chip LED and buzzer peripherals. On-chip MMC/SD multimedia and flash interfaces are provided for off-chip MMC Flash card, SD flash card and SDIO peripherals.

In FIG. 2, a WLAN integrated circuit 1500 includes MAC (media access controller) 1510, PHY (physical layer) 1520 and AFE (analog front end) 1530 for use in various WLAN and UMA (Unlicensed Mobile Access) modem applications. PHY 1520 includes blocks for BARKER coding, CCK, and OFDM. PHY 1520 receives PHY Clocks from a clock generation block supplied with suitable off-chip host clock, such as at 13, 16.8, 19.2, 26, or 38.4 MHz. These clocks are compatible with cell phone systems and the host application is suitably a cell phone or any other end-application. AFE 1530 is coupled by receive (Rx), transmit (Tx) and CONTROL lines to WLAN RF circuitry 1540. WLAN RF 1540 includes a 2.4 GHz (and/or 5 GHz) direct conversion transceiver, or otherwise, and power amplifer and has low noise amplifier LNA in the receive path. Bandpass filtering couples WLAN RF 1540 to a WLAN antenna. In MAC 1510, Security circuitry supports any one or more of various encryption/decryption processes such as WEP (Wired Equivalent Privacy), RC4, TKIP, CKIP, WPA, AES (advanced encryption standard), 802.11i and others. Further in WLAN 1500, a processor comprised of an embedded CPU (central processing unit) is connected to internal RAM and ROM and coupled to provide QoS (Quality of Service) IEEE 802.11e operations WME, WSM, and PCF (packet control function). A security block in WLAN 1500 has busing for data in, data out, and controls interconnected with the CPU. Interface hardware and internal RAM in WLAN 1500 couples the CPU with interface 1410 of applications processor integrated circuit 1400 thereby providing an additional wireless interface for the system of FIG. 2. Still other additional wireless interfaces such as for wideband wireless such as IEEE 802.16 "WiMAX" mesh networking and other standards are suitably provided and coupled to the applications processor integrated circuit 1400 and other processors in the system.

Further described next are improved voice codecs, structures and processes and improving the systems and devices of FIGS. 1 and 2 with them. In the subsequent Figures, Selectable Mode Vocoder (SMV standard of 3GPP2 organization) is used without limitation as an example platform for improvements. It is emphasized that the improvements are generally applicable in voice codec search procedures and all other search procedures to which the advantages of the improvements herein commend their use. ACELP-based FCB searches (Algebraic Code Excited Linear Prediction Fixed CodeBook search procedures) and other procedures with pitch enhancement and otherwise are suitably improved by the inventive structures and processes taught herein.

SMV is a variable-rate eX-CELP based speech codec. The quality of the speech attained by SMV and its multimodal operation capability makes it quite suitable for wireless mobile communication. The multi-mode feature of SMV varies the Rate and trades off channel bandwidth and voice quality as the Rate is changed. Applications include wireline and wireless voice gateways and 3G third generation and higher generation cell phone wireless handsets as well as other products shown in FIG. 1. Minimum performance specifications are defined for SMV by subjective and objective comparison with respect to a floating point reference. SMV speech quality is believed to be better than EVRC (Enhanced Variable Rate Codec)(TIA IS-127) at the same average data rate (mode 0) and equivalent to EVRC at a lower data rate (mode 1). The complexity of SMV in MIPS (millions of instructions per second) is the highest among CDMA speech codecs.

SMV processing involves frame processing and rate-dependent excitation coding. The frame processing includes speech pre-processing, computation of spectral Envelope Parameters, signal modification, and rate selection. The SMV encoder frame processing which includes speech pre-processing, LPC analysis, signal modification and LSF quantization has complexity of about 50% or half the complexity of the SMV encoder. The rate-dependent excitation coding involves an adaptive codebook search, a fixed codebook search with complexity of about 40% that of the encoder in the worst case, and gain quantization. Overall, the SMV encoder rate-dependent excitation coding is about 50% or half of the complexity of the SMV encoder.

The computational complexity of the SMV speech codec is higher than other CDMA speech codecs. A significant portion of the computational complexity in the SMV speech codec can be attributed to a fixed codebook search that is done using multiple codebooks. Some embodiments of fixed codebook search procedure for improving SMV and other voice coding processes are based on a special approach called Selective Joint Search herein.

SMV encodes each 20 millisecond speech frame at one of four different bit rates: full-rate (1), half-rate (½), quarter-rate (¼) and one-eighth-rate (⅛). The bit rate chosen depends on the mode of operation and the type of speech signal.

Frames assigned to full-rate (Rate 1) are further classified as Voiced-Stationary (Type 1) and Voiced-Non-Stationary (Type 0). Each of these two classes is associated with one or more "fixed codebooks" (FCB). Each fixed codebook consists of a list of pulse positions or a set of pulse combinations. One important step in the process of encoding speech is choosing the best pulse position(s) or combination from a codebook. The best pulse combination in the one that results in the lowest value of an error function and the highest value for a Cost function (herein referring to a data structure or function having a value that goes up as the error function goes down) among the pulse combinations that are searched. The Cost function increases with the goodness of fit, or goodness of approximation of the coded speech to the real speech being coded. Thus, the Cost function is high when an error function, such as the difference between the coded speech and the real speech being coded in weighted error measure, is small.

In the codebook search, the Cost function is maximized so that the error function is minimized. For example, suppose pulse positions from first and second tracks (lists of pulse positions in a codebook) contribute respective amounts X and Y to the Cost function and provide a combined contribution to the Cost function. Further suppose X exceeds or is greater than Y, (X>Y). Hence the second track contributes less to the Cost function, and the second track is probably underperforming and hence it is to be refined. The process refines the underperforming tracks because that is where refinement can contribute the greatest improvement or increase to the Cost function. Note that the term "track" is sometimes used herein slightly differently than may be the case in the SMV spec. Herein, "track" can refer to the list or set of pulse positions available to a respective pulse, even when another pulse may have an identical list or set of pulse positions available to it. In case a choice needs to be made about refinement as between pulses having an identical list, the pulse having a pulse position in a previous search that contributed less to the Cost function ranks higher or more in need of refinement than a second pulse having the identical list of pulse positions available to it.

In the voiced-stationary case (Type 1) of SMV Full Rate 1, a single codebook of eight (8) pulse tracks is used. In the case of eight tracks, after the refinement is over, the result is that the target $T_g$ is now approximated by all eight (8) pulse position in eight tracks, i.e., one pulse position from each of the eight tracks, namely the two (2) highest-contributing tracks plus six (6) underperforming tracks that got refined and put through filter H. The two highest tracks are included because they were the original best two performers out of the eight. Usually, not all the track candidates are underperformers. In this example, six (6) underperforming tracks are chosen as a trade-off between computational complexity versus best possible track choice pulse position quality. Embodiments suitably vary for different applications, and different implementations of the same application, in the numbers of tracks that are selected for refinement.

In the voiced-non-stationary case (Type 0) of SMV Full Rate 1, any one of three codebooks are used, and this choice is based on secondary excitation characteristics maximizing the Cost function.

In the description herein, the term "Cost function" is used to refer to a degree of approximation for improving and increasing voice coding quality. The term "Cost function" is not herein referring to financial or monetary expense nor to technological complexity, any of which can be reduced by the improvements herein even though the Cost function is increased.

Figure 3:
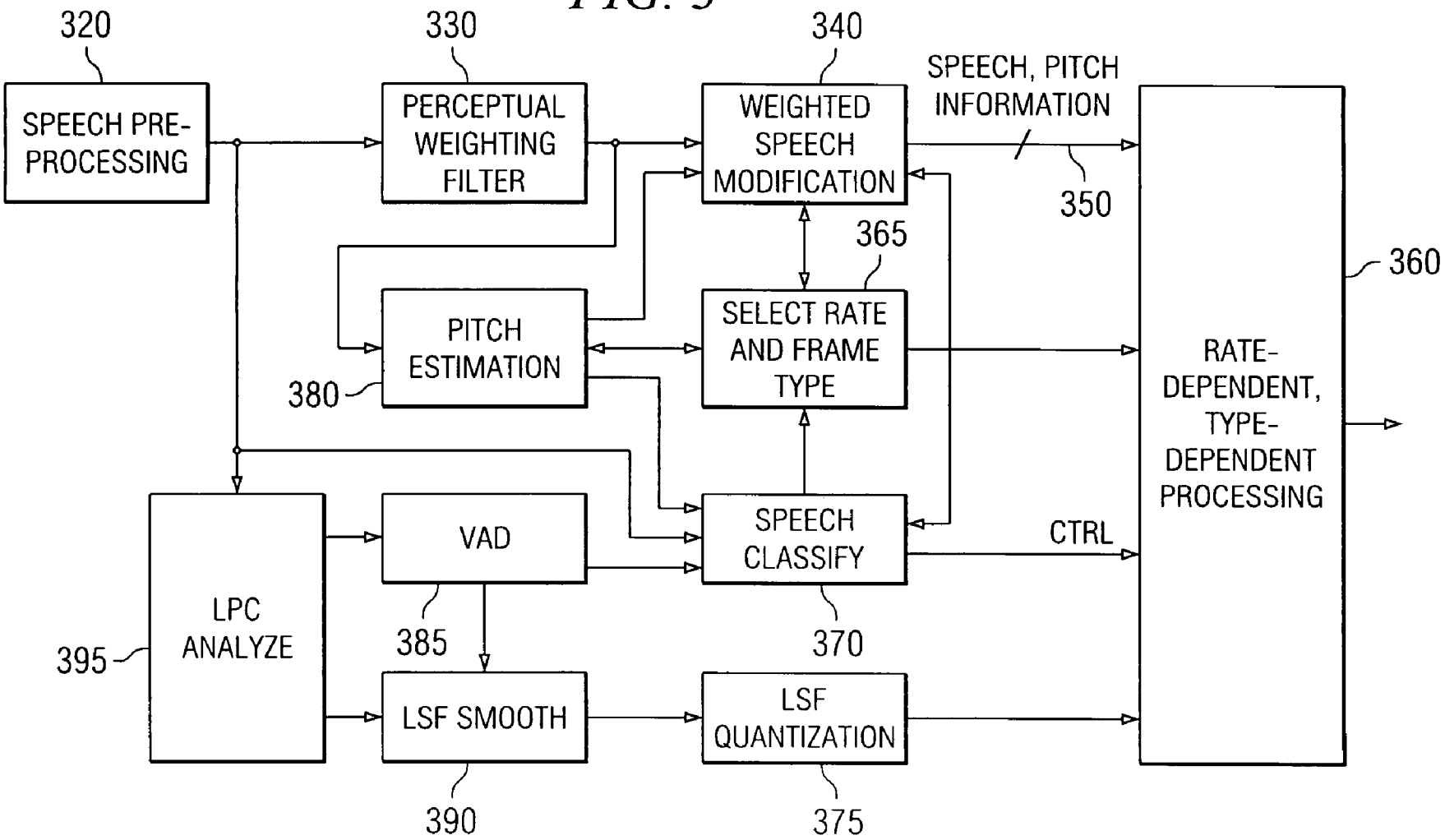
FIG. 3 is a process block diagram of SMV (Selectable Mode Vocoder) as example platform for inventive improvements to blocks as taught herein resulting in an inventive vocoder for the systems and devices of FIGS. 1 and 2.

FIG. 3 shows a method 310 for frame processing which provides the context for improvements over Selectable Mode Vocoder (SMV). Reference is made to "Selectable Mode Vocoder Service Option for Wideband Spread Spectrum Communication Systems," 3GPP2 C.S0030-0, Version 2.0, December, 2001 for background, which is hereby incorporated herein by reference.

A Speech Pre-processor 320 provides pre-processed speech as input to a Perceptual Weighting Filter 330 that produces weighted speech as input to Signal Modification block 340. Block 340 in turn supplies modified weighted speech to a line 350 to Rate and Type Dependent Processing 360. Further blocks 365, 370, 375 supply inputs to Rate and Type Dependent Processing 360. Block 365 provides Rate and Frame Type Selection. Also, blocks 365 and 370 each interact bi-directionally with Weighted Speech Modification block 340. Block 370 provides controls CTRL pertaining to speech classification. Block 375 supplies LSF (Line Spectral Frequency) Quantization information. Line Spectral Frequencies (LSFs) represent the digital filter coefficients in a pseudo-frequency domain for application in the Synthesis Filter 440.

A Pitch Estimation block 380 is fed by Perceptual Weighting Filter 330, and in turn supplies pitch estimation information to Weighted Speech Modification 340, to Select Rate and Frame Type block 365 and to Speech Classify block 370. Speech Classify block 370 is fed with pre-processed speech from Speech Pre-processing block 320, and with controls from a Voice Activity Detection (VAD) block 385. VAD 385 also feeds an output to an LSF Smoothing block 390. LSF Smoothing block 390 in turn is coupled to an input of LSF Quantization block 375. An LPC (Linear Predictive Coding) Analyze block 395 is responsive to Speech Pre-processing 320 to supply LPC analysis information to VAD 385 and to LSF Smoothing 390.

FIG. 4 shows greater detail of Rate and Type Dependent Processing 360 of FIG. 3. FIG. 4, among other things, illustrates a method for excitation coding for Rate 1 (full-rate) and Rate 1/2 (Half Rate). Note in particular a Fixed-Codebook-based analysis-by-synthesis feedback circuit 410. This circuit 410 is related to the subject of the improvements discussed herein. Circuit 410 receives a "target signal" $T_g$ at a subtractor 420. Target signal $T_g$ represents the speech (remaining after adaptive codebook operations in a block 480 near block 410) to be optimally coded by block 410. The fixed codebook block 410 includes a Fixed Codebook operations block 430 followed by a synthesis filter 440. A perceptual weighting filter 450 couples synthesis filter 440 to subtractor 420. An error signal line 460 and Minimization block 470 couple subtractor 420 to fixed codebook block 430 to complete a feedback loop. Minimization block 470 is fed with control parameters CTRL from Speech Classify block 370 of FIG. 3. Synthesis Filter 440 is fed with LSF Quantization information from block 375. Fixed Codebook 430 has an output that is multiplied by optimal fixed codebook gain.

In FIG. 4, an Adaptive Codebook filter block 480 is organized similarly to Fixed Codebook filter block 410 and has a similar loop of Adaptive Codebook, multiplier, Synthesis Filter, Perceptual Weighting Filter, subtractor, and minimization looping back to Adaptive Codebook. Block 480 has a subtractor input for Modified Weighted Speech from block 340. Block 480 has a multiplier input for pitch gain multiplication of Adaptive Codebook output. LSF Quantization from block 375 is provided to the Synthesis Filter in block 480. Completion of the block 480 loop with a minimization block applies to voiced non-stationary (Type 0) frames. Minimization is omitted from the block 480 loop for processing voiced stationary (Type 1) frames.

Further in FIG. 4, an Energy block 495 is fed with Modified Weighted Speech from block 340 of FIG. 3, and with respective outputs from Adaptive Codebook ACB and Fixed Codebook FCB of FIG. 4.

A Vector Quantization Gain Codebook filter block 490 is organized somewhat similarly to Fixed Codebook filter block 410 and has a similar loop, except the Vector Quantization Gain Codebook feeds multipliers respectively fed by Adaptive Codebook and Fixed Codebook 430. In block 490 a Synthesis Filter receives a sum of the multiplier outputs, responds to LSF Quantization input, and is followed by Perceptual Weighting Filter, subtractor, and minimization looping back to Vector Quantization Gain Codebook. Block 490 has a subtractor input fed by the Energy block 495.

FIG. 5 summarizes an aspect of the process of finding the right pulses to excite a filter to approximate the target signal $T_g$. Pre-processed speech from block 320 is weighted by block 330 and is modified by block 340 and sent to code book processing 550. A fixed codebook has predetermined information that designates pulse positions (time points in a frame or subframe) for each of a predetermined number of pulses that are allowed to excite the filter(s) for a given type of voice frame. Rate and Type decision signals from block 520 are coupled to the Codebook Processing block 550 in response to processed speech frames originated at block 320. Codebook Processing block 550 has adaptive codebook ACB and fixed codebook FCB. For instance, for analyzing Rate 1 frames, a fixed codebook is provided for analyzing Type 1 frames. Multiple sub-codebooks FCB1, FCB2, FCB3 are provided for analyzing Type 0 frames.

Each of multiple excitation pulses for use in speech excitation approximation is allocated a "track" in the codebook (or sub-codebook). The track for a respective pulse has a list of numbers that designates the set of alternative time positions, i.e., pulse positions that the codebook allows that pulse to occupy. "Codebook searching" involves finding the best number in a given track, and the best combination of pulses with which to define the set or subset of pulses which are identified and selected to excite the filter(s) of the analysis-by-synthesis feedback circuit 410. In this way, the process homes in on the approximation to a target signal $T_g$, for instance.

Various embodiments herein pertain to and improve fixed codebook search in full-rate SMV and other codebook searching applications in voice codecs and otherwise. The existing and inventive methodologies are described below. Certain aspects of the search method are also described and illustrated in the incorporated patent application Ser. No. 11/231,643.

"Refinement" means search each of the pairs with joint search (except where the context specifically refers to single-pulse search) and, in the search process, pick the pulses which maximize the Cost function. "Search," "refine" and "refinement" are often used synonymously herein. Searching includes accessing codebook tracks and picking the pulses which maximize the Cost function, which thereby improves the approximation that is the goal of the procedure.

Rate 1 Voiced-Stationary (Type 1):

a) Standard SMV Methodology: The FCB for SMV Full Rate 1 consists of a combination of eight (8) pulses. The FCB search procedure consists of a sequence of repeated refinements referred to as "turns".

Each turn consists of several iterations. In each iteration for a given "turn," the process searches for a best pulse position of each pulse or a pair of pulses, while keeping all the other pulses at their previously determined positions.

The eight (8) pulse codebook is searched in two (2) turns using a sequential joint search procedure. A sequential joint search finds out best two (2) pulses position from the given set of candidate pulse positions specified by two adjacent tracks in the FCB. Here each track consists of candidate pulse positions. This is followed by two (2) turns of iterative single pulse search. This described search procedure is computationally very demanding. An efficient alternative to this search procedure is described below.

b) Method Embodiment: In an embodiment, single pulse search is done in the first turn unlike the two (2) turns of sequential joint search in the standard SMV methodology. This gives the initial estimation of the pulse positions. This is followed by a special process herein called Selective Joint Search unlike the two (2) turns of iterative single pulse search in the standard methodology. In the Selective Joint Search procedure the search is restricted to six tracks in the codebook. These six tracks correspond to the pulses that contribute least to a Cost function that is maximized when the error function is minimized. The error function is based on a mean squared error criterion.

Using this search method embodiment reduces the computational complexity of the fixed codebook search by around 50% without affecting the perceptual quality with respect to standard SMV decoded speech.

2. Rate 1 Voiced-Non-Stationary (Type 0):

a) Standard SMV Methodology: SMV Full Rate 1 uses three (3) sub-codebooks in this case. One of the three sub-codebooks that best models the present secondary excitation is chosen. "Secondary excitation" herein refers to excitation pulses which would be a best selection to drive the filter in block 410 to approximate the target signal $T_g$. "Secondary" refers to block 410 being coupled second electronically after block 480 in FIG. 4. In order to determine the best sub-codebook, a single pulse search procedure is adopted for all the three sub-codebooks.

The sub-codebook that minimizes the error criterion (maximizes the Cost function) is selected. The chosen sub-codebook is refined further using three turns of sequential joint search procedure.

b) Method Embodiment: In a further embodiment, one of the three sub-codebooks is chosen using a single pulse search. Further refinement of the selected best sub-codebook is done using Selective Joint Search instead of sequential joint search procedure. The same Selective Joint Search procedure as described in Voiced-Stationary (Type 1) case is used for selecting the tracks for further refinement. In the Selective Joint Search procedure the search is restricted to a few tracks (e.g., four) in the codebook. These tracks correspond to the pulses that contribute least to a Cost function that is maximized when the error function is minimized. The error function is based on a mean squared error criterion.

c) Second Method Embodiment: Fast-select one sub-codebook, single-pulse search it, then Selective Joint Search is used to search that sub-codebook. The procedure of selecting one among three sub-codebooks is eliminated. This eliminates the complexity of searching additional two more sub-codebooks. The sub-codebook chosen is a priori decided, or dynamically predetermined prior to the single-pulse search, based on input parameters to the sub-codebook search.

The just-described Method Embodiments reduce the computational complexity of the fixed codebook search by 66% without affecting the perceptual quality with respect to standard SMV decoded speech.

Selective Joint Search is used to improve the voice coding by restricting the search procedure to a reduced number of tracks in the codebook. The tracks associated with the pulses that contribute least to a Cost function criterion are selected as they are more likely to be modified in further refinements.

Among other advantages, the method embodiment is computationally more efficient as it reduces the computational complexity up to 66% with respect to the standard fixed codebook search in SMV without affecting the perceptual quality of speech. The speech quality for the described method embodiment is perceptually same with respect to standard SMV. Hence, this procedure can make the implementation of SMV computationally more efficient than the standard SMV.

A high density code upgrade embodiment reduces the computational complexity substantially. Greater channel density in channels per DSP core (9 vs. 7 for SMV) is provided by the embodiment at the same speech quality as SMV. Moreover, the embodiment provides higher speech quality at the same channel density as EVRC.

Reduced complexity fixed codebook search is based on Selective Joint Search as taught herein, compared to the higher complexity of fixed codebook search in SMV. In the SMV standard approach, high-complexity searches for best sub-codebook and best pulse positions are used. In an embodiment, a low complexity intelligent search best-guesses the pulse tracks for refinement. Also, the remarkable Selective Joint Search provides a simpler procedure to find the best pulse position.

FIG. 6 shows an error function epsilon as a composite data structure or function of target signal $T_g$, gain g, filter matrix H, and excitation vector c. The error function is the mean square of the difference signal 460 (recall subtractor 420 of FIG. 4) produced as the subtraction difference between the target signal $T_g$ and the approximation of the codebook pulses-excited filter(s). (The error function somewhat resembles error variance, also known as mean square of residuals, as used in the terminology of regression analysis in statistics, but here a very rapidly occurring time series of data comprised in the frame is involved.) That approximation is represented by matrix multiplication product "g H c" in FIG. 6, where c is the excitation vector including several of the pulses $p_i$, H is an impulse response matrix representing the filter(s), and g is a gain or multiplier.

For purposes of FIG. 6, codebook search involves proper selection of the pulses $p_i$ that, summed together, compose the column vector c. (The impulse response filter matrix H is lower-triangular when backward pitch enhancements are folded into the code-vector. The impulse response matrix is not necessarily lower-triangular when backward pitch enhancements are folded into the impulse response matrix.) Here the approach is to break up vector c into a single pulse $p_i$ (lower right one "1" in column of zeroes) added to a vector of everything else ("c-") that may have so far resulted from codebook search to determine vector c. The "c-" vector correspondingly has a zero in the row entry where single pulse $p_i$ has a one (1). The rows of vector c correspond to pulse positions.

Much of this discussion is devoted to improving the process of searching to find how many "ones" (or pulses) should be entered into which rows (estimated pulse positions) of vector c.

To reduce the computational complexity, some embodiments perform the search using the Cost function epsilon tilde as a goodness of fit metric. Instead of squaring many differences, the processor is operated to generate a bit-representation of a number and then square it to obtain a numerator, and then computes a bit-representation of a denominator number and then performs a division of the numerator by the denominator.

A goal in Fixed Codebook search is to minimize the epsilon (error function) in the equation (1)

$$\epsilon = \|T_g - gHc\|^2 \tag{1}$$

Alternatively this is equivalent to maximizing epsilon tilde as follows. Epsilon tilde is an example of what is called a "Cost function" herein.

$$\tilde{\varepsilon} = \frac{((T_g)^T Hc)^2}{\|Hc\|^2} = \frac{((H^T T_g)^T c)^2}{c^T H^T Hc} = \frac{((Tg^T H)c)^2}{(Hc)^T Hc} \tag{2}$$

Substituting symbols $b_{Tg} = (H^T T_g)^T$ and y=Hc, also yields the form:

$$\tilde{\varepsilon} = \frac{(b_{Tg} c)^2}{y^T y} = \frac{(b_{Tg} c)^2}{\|y^2\|} \tag{3A}$$

In some of the fixed codebook search embodiments herein, the Cost function epsilon tilde $\tilde{\epsilon}$ is maximized. Maximizing that Cost function is computationally simpler than and equivalent to minimizing the error function $\epsilon$ itself. In the description herein, the term "Cost function" is used to refer to a degree of approximation for improving and increasing voice coding quality. The term "Cost function" is not herein referring to financial or monetary expense nor to technological complexity, any of which can be reduced by the improvements herein even though the Cost function is increased.

Maximizing Cost function epsilon tilde is described next and elsewhere herein. Note that generating the denominator $\|y^2\|$ is an important part of the processing. The process of generating the denominator $\|y^2\|$ involves an autocorrelation matrix called Phi Matrix $\Phi$.

$$\|y^2\| = \sum_{i=0}^{N-1} \Phi(p_i, p_i) + 2\sum_{i=0}^{N-2} \sum_{j=i+1}^{N-1} \Phi(p_i, p_j) \tag{3B}$$

In words, Equation (3B) represents a process of squaring many quantities identified in the output of Filter matrix H when excited with a sum of pulses at pulse positions $p_i$ selected from a codebook and making up code-vector c of FIG. 6. Note that Equation (3B) uses the symbol "$p_i$" to represent the numerical position of the singleton one (1) surrounded by zeroes in a corresponding pulse vector $p_i$ of FIG. 6. Since FIG. 6 illustrates a pulse vector, and Equation 3B) uses the scalar numerical position of the singleton one (1) in that pulse vector to index into the Phi Matrix, so that the use of the same symbol $p_i$ facilitates description of this process.

This squaring process in Equation (3B) produces a sum of many squared terms represented by the first summation (at left) over Phi on various values in its main diagonal. Added to the left sum, there follows on the right in Equation (3B) a double summation of many cross-product terms between the linear filter H impulse responses to the various pulses. In other words, the double summation sums up various off-diagonal values in the Phi Matrix. Since the autocorrelation compactly provides the various terms, the Phi Matrix is quite useful herein.

In Equation (3B), the letter N represents the number of pulse vectors in code-vector c of Equation 1.

The pulses can have either a positive (+) or negative (−) sign S. Such pulse signs are included in the pulse combination represented by vector c. Thus, vector c contains the sign information. The sign information is used in the computation of Phi Matrix when sign information for each pulse is pre-computed. The sign information is included during computation of denominator $\|y^2\|$ which is described in Equation (3B). Since SMV also adds pitch enhancements, the symbols $S_i$ and $S_j$ used in SMV are suitably used as a multiplier inside the double-summation of Equation (3B). In such case, letter S represents the Sign value of plus one (+1) or minus one (−1) corresponding to the plus or minus value of a pre-computed product ($b_{Tg}pi$) of the target signal $T_g$ by filter matrix H by a particular pulse $p_i$.

In some embodiments as described herein, the process of generating the autocorrelation matrix Phi Matrix Φ via Equation (3B) for use in obtaining the Cost function via Equation (3A), and using Phi Matrix anywhere else that Phi Matrix is suitably used, is greatly simplified and thereby processing is made swifter and more efficient. In this way, generating and maximizing the Cost function epsilon tilde is greatly facilitated. The advantages are even more critical when a voice coding feature called Pitch Enhancement is used, as described elsewhere herein. Still further improvements are also herein described for processes generating data structures when Pitch Enhancement is used.

The improvements taught herein have a domino effect of making processing swifter and more efficient for the voice coder as a whole. An ultimate result is that cell telephones and other wireless telecommunications devices using the embodiments operate with comparable voice quality, and save power consumption due to voice coding and voice codec operation, burden the processor less, increase channel density, and make processor time available for other applications.

Before describing Pitch Enhancement and generating the autocorrelation matrix Phi Matrix Φ, this description first describes, without limitation methods by which the Cost function epsilon tilde is maximized after it is generated.

In fixed codebook FCB search, finding the best combination of pulse positions in tracks which maximize the Cost function $\tilde{\epsilon}$ is more important than, finding the combination of individual best pulses from each track T. In the Selective Joint Search approach herein, the contribution C(Tx) from a particular track Tx is defined, for one example and one type of method embodiment, as the difference in Cost function $\tilde{\epsilon}$ after eliminating the candidate pulse position from the initial state before Selective Joint Search. For example, let x,y,z,w be candidate pulse positions from different tracks Tx, Ty, Tz, Tw before the start of selective joint search. The overall Cost function is $\tilde{\epsilon}(x,y,z,w)$. The contribution C of position x to the Cost function is defined as $$Cx=\tilde{\epsilon}(x,y,z,w)-\tilde{\epsilon}(y,z,w). \tag{4X}$$

Similarly, $$Cy=\tilde{\epsilon}(x,y,z,w)-\tilde{\epsilon}(x,z,w), \tag{4Y}$$

$$Cz=\tilde{\epsilon}(x,y,z,w)-\tilde{\epsilon}(x,y,w) \text{ and} \tag{4Z}$$

$$Cw=\tilde{\epsilon}(x,y,z,w)-\tilde{\epsilon}(x,y,z). \tag{4W}$$

Now if Cx is highest among Cx, Cy, Cz, Cw, then eliminating candidate pulse position x will result in high error. In other words, the candidate pulse position x is already well fitted with other selected pulse positions to minimize the error, that is, deliver a highest possible value of the Cost function $\tilde{\epsilon}$. Hence, this track Tx containing candidate pulse position x need not be refined. If, for another instance, contribution Cz is least, then refining the track Tz containing pulse position z is expected to improve the Cost function $\tilde{\epsilon}$ in a manner which best combines or gels with other candidate pulse positions to give high Cost function measure $\tilde{\epsilon}$ (x,y,z',w) where z' is candidate pulse position refined from the track same as z. (Symbol prime (') on a pulse letter here represents refinement.)

Note that any selecting the "least contribution" can be accomplished using any data structure or function that either increases as the differences of Equations (4) increase or, alternatively, decreases as the differences of Equations (4) increase.

Still another example recognizes that the Cost function value $\tilde{\epsilon}(x,y,z,w)$ is the same in all the difference Equations (4). Accordingly, in this example, operations in the processor suitably select first for refinement the track T (or track pair as the case may be) that corresponds to the highest value of in a set of Cost function values $\{\tilde{\epsilon}(x,y,z), \tilde{\epsilon}(w,y,z), \tilde{\epsilon}(w,x,z), \tilde{\epsilon}(w,x,y)\}$ when the pulse having the pulse position from that track is omitted.

$$\text{Track Selection Ts=track with Max}(\{\tilde{\epsilon}(x,y,z), \tilde{\epsilon}(w,y,z), \tilde{\epsilon}(w,x,z), \tilde{\epsilon}(w,x,y)\} \tag{5}$$

The selection of Equation (5) is made because the track Ts, when omitted, is revealed to have been making the least contribution because the Cost function value, with that track Ts omitted is the highest of any of the Cost function values even though that track Ts is omitted. Also, in some embodiments the refinement of tracks occurs in rigorous order of least contribution, and in other embodiments as simulation tests may suggest, another approximately-related order based on some selection of lower-contribution track(s) suitably guides the processor operations.

Accordingly, applying the important selection method of "least contribution" as taught herein comprehends a variety of alternative embodiments of operational methods which may involve selecting a highest or lowest value of a function with track omitted, or a highest or lowest value of a difference-related function between values with none, fewer and more subset(s) of track(s) omitted.

Pitch Enhancement and Autocorrelation

SMV uses pitch enhancement for the fixed codebook FCB in order to increase the speech quality. Some SMV-based terms are described next. A "main pulse" is a pulse at a position selected from a list in a pulse codebook. "Pitch enhancement" refers to insertion of one or more additional pulses before or after the main pulse in a subframe in a manner repeating the main pulse and spaced from the main pulse or nearest one of the additional pulses by an interval equal to an integer number called the "pitch lag" of the subframe. The integer (INT) Pitch (P) lag (lower case ell "l") is symbolized $l^P_{INT}$. "Forward pitch enhancement" inserts the one or more additional pulses after the main pulse. "Backward pitch enhancement" inserts the one or more additional pulses before the main pulse.

CELP (Code Excited Linear Prediction) based codecs can use some form of pitch enhancement for the fixed codebook excitation. In some CELP codecs, forward pitch enhancement is used and not backward pitch enhancement. SMV uses both forward pitch enhancement and backward pitch enhancement to increase the speech quality. The computational complexity increases significantly with increased backward pitch enhancements. The improved methods herein cut down this higher computational complexity by approaches which do not need to adversely affect the perceptual speech quality.

The Selectable Mode Vocoder (SMV) uses a subframe strategy to encode the pitch and secondary excitation. SMV uses variable subframe length (also called subframe size), based on the speech classification Type. Subframe length is symbolized $L_{SF}$ (which is not to be confused with the symbol LSF for line spectral frequency).

A particular embodiment described herein is associated with the encoder when the analysis subframe size $L_{SF}$ is 53 or 54 samples. The SMV speech codec chooses sub-frame sizes 53 or 54 for Rate ½ Type 1 (voiced stationary) speech frames. The choice of this sub-frame size increases the computational complexity of the search algorithm.

When subframe length $L_{SF}$ is 53/54 and the pitch lag $l^P_{INT}$ is small (17 or 18), SMV inserts up to a maximum of three backward enhanced pulses with exponentially decaying amplitudes. It is noted herein that under these circumstances the contribution of the last enhancement pulse is very minimal. Hence, this pulse contribution can be advantageously and effectively removed for sub-frame size 53/54 with low pitch lag values.

An improvement Aspect 1 herein called Conditional Elimination Backward Pitch Enhancement, for which an example is just given, reduces the computational complexity in calculation of energy correlations (compare Phi Matrix Φ for generating the denominator $\|y^2\|$ for Cost function epsilon tilde) for impulse response used in fixed codebook search. The improvement is different and advantageous, among other reasons, because conditional elimination of backward pitch enhancement for certain specific cases of speech simplifies backward pitch enhancement processing substantially.

The Conditional Elimination Backward Pitch Enhancement method described herein remarkably achieves fully comparable voice quality by an advantageously approximate approach for backward pulse enhancement using only up to two pitch enhancement pulses. Efficient pre-computation with overlaid memory usage hence effectively and further reduces computational burden without any memory penalty.

The complexity of the search procedure in standard half rate SMV for Type 1 frames is very high, because it involves complex conditional logic in the search procedure. An improved method embodiment described herein uses pre-computed correlations of the impulse response and an improvement called Incremental Generation. This Pre-computed Correlations and Incremental Generation, or Aspect 2, improvement is used in various pitch enhancement embodiments independently of whether Aspect 1 or Conditional Elimination Backward Pitch enhancement is used or not.

This Pre-computed Correlations and Incremental Generation improvement advantageously reduces the number of Multiply Accumulates (MACs) up to 25% in the computation of impulse response energy correlations Phi Matrix. The usage of Pre-computed Correlations and Incremental Generation contributes up to 10%, in the computation of impulse response energy correlations Phi Matrix, (3 MIPS in one application and currently-typical clock frequency) for additional process simplification and computational savings.

Among its other advantages, the improved method reduces the computational complexity of impulse response energy correlations by around 25% without affecting the quality compared to the standard SMV. The improvements provide greater channel density at the same voice quality as SMV, and moreover provide at least as much channel density as another standard called EVRC but at higher voice quality.

Summarizing some of the improved method aspects herein:

Limit the backward pitch enhancement to a maximum of only two exponentially decaying amplitudes when the subframe length is 53/54 or otherwise more than two times the pitch lag.

Pre-compute the impulse response correlations Phi Matrix to eliminate redundant computation.

Reduce the number of Multiply Accumulates up to 25% by Incremental Generation of impulse response correlations by dividing Phi Matrix into special regions where double nested loop processing is applicable and then executing the double nested loop processing.

Obviate and eliminate significant amounts of control code by the improved process of supplying values of Phi Matrix in regions by Incremental Generation.

Figure 7:
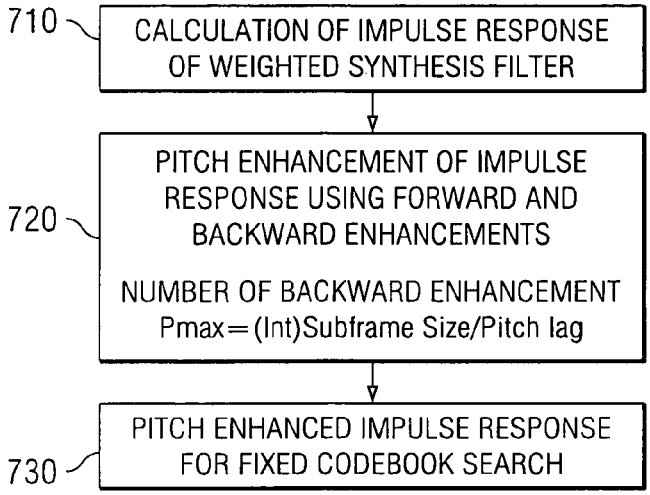
FIG. 7 is a flow diagram of an SMV method for SMV pitch enhancement.

FIG. 7 depicts a flow of conventional SMV pitch enhancement. Conventional SMV Pitch Enhancement is described at the 3GPP2 C.S0030-0 Version 2.0 "Selectable Mode Vocoder Service Option for Wideband Spread Spectrum Communication Systems" document in sections 5.6.11.4 and 5.6.11.5 which sections are incorporated herein by reference.

In FIG. 7, at step 710, calculation of the impulse response of the weighted synthesis filter of the fixed codebook loop 410 (FIG. 4) occurs.

Next, in a step 720 pitch enhancement of the filter impulse response is performed using forward and backward pitch enhancements. The number of backward enhancements is an integer given by Pmax=(Int) Subframe Size/Pitch Lag.

Then in a step 730, there results the pitch-enhanced filter impulse response for use in fixed codebook search.

Figure 8:
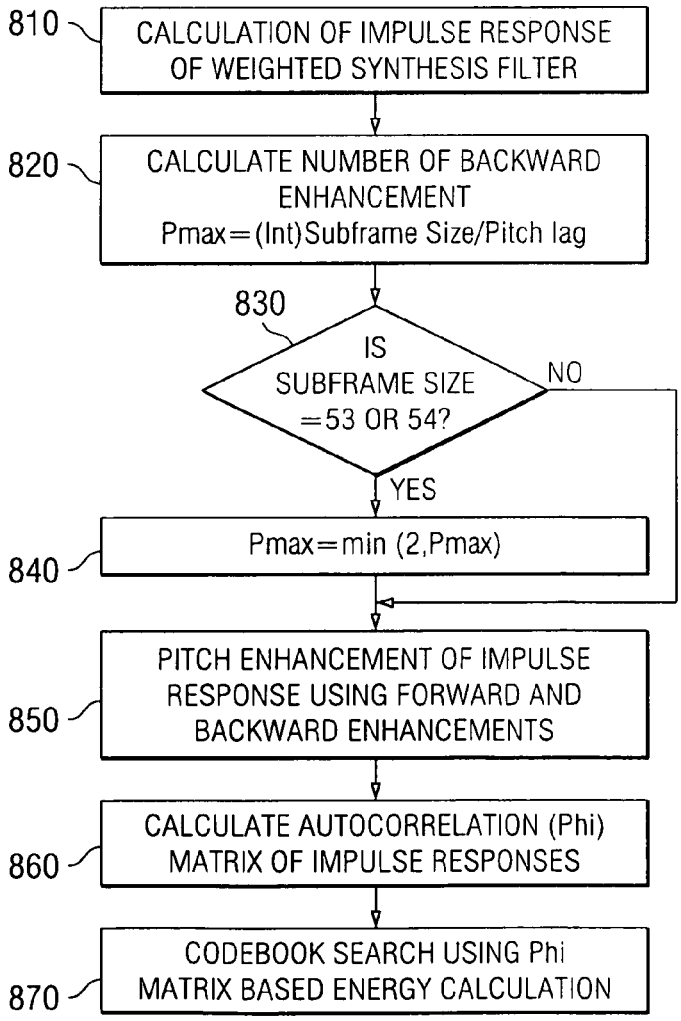
FIG. 8 is a flow diagram of an inventive method for Pitch Enhancement for inventive improvements to codebook searching as taught herein resulting in an inventive vocoder for the systems, devices and processes of FIGS. 1-5.

FIG. 8 depicts the flow of an improved method embodiment here. Operations in a step 810 calculate the impulse response of the weighted synthesis filter of the fixed codebook loop 410 (FIG. 4.)

Next, pitch enhancement of the filter impulse response is performed in a step 820 using forward and backward pitch enhancements, providing a number of backward enhancements that is an integer given as greatest integer less than or equal (integer function "INT( )") to the ratio of Subframe Size divided by integer Pitch lag delivered to block 360 of FIG. 3 among the control parameters CTRL.

$$P\max = INT(L_{SF}/l^P_{INT}) \tag{6}$$

Then in FIG. 8, a decision step 830 determines whether the subframe size $L_{SF}$ has been selected to be 53 or 54 (i.e., a 160 sample subframe is divided in thirds of 53, 53, and 54 samples).

If yes, then operations branch to a step 840 and there limit the number of backward pitch enhancements to the lesser of two (2) or Pmax from Equation (6). This is what is meant in FIG. 8 by the notation Pmax=min(2, Pmax). ("min" stands for the minimum.) In this way, the case of three pitch enhancements otherwise permitted by standard SMV is prevented from occurring when the pitch lag is a third or less of the subframe size.

In general, various embodiments of this Conditional Elimination Backward Pitch Enhancement method establish a maximum number (e.g., 2) backward pitch enhancements Q when the ratio of subframe size to integer pitch lag is equal to or greater than (Q+1), i.e., the ratio equals at least one more than the maximum number of backward pitch enhancements.

After step 840 when subframe size is 53/54, (or also after step 830 when subframe size is not 53/54), operations proceed to a step 850.

Step 850 performs pitch enhancement using the forward and backward enhancements. In this improved way, there results the pitch-enhanced filter impulse response $H_p^{Pm}$ of hereinbelow Equation (7A) for use in fixed codebook FCB search.

Moreover, the Conditional Elimination Pitch Enhancement improvements are advantageously combined with the improvements to codebook searching disclosed in application Ser. No. 11/231,643 and FIGS. 12-27 herein to yield still further improved methods, devices and systems for pitch enhancement and codebook search for voice codecs. Another embodiment combines embodiments in said application and FIGS. 12-27 for Rate 1 with an embodiment herein for Rate ½ stationary voiced (Type 1) frames. Thus, the inventive embodiments are applied in two different Rate paths of a combined process. Advantageously, this provides a complexity reduction. In other words, the Selective Joint Search improvements of said application and FIGS. 12-27 are applied to codebook searching, and the Conditional Elimination Pitch Enhancement improvements are allocated to different paths and this allocated structure provides improvements that are balanced and allocated over plural rates in a voice codec. Advantageously, the Pre-Computed correlations and Incremental Generation improvement is applied over both the Full Rate 1 and Half Rate (½) modes.

Complexity of codebook searches in general is reduced. Having a conditionally-limited number of backward pitch enhancements results in fewer non-causal impulse response vectors used in the computation of the impulse response correlations matrix (autocorrelation Phi Matrix). The complexity of computing impulse response correlation increases exponentially with number of backward pitch enhancements. Hence, conditionally limiting the number of backward pitch enhancements has the effect of reducing complexity substantially.

As noted hereinabove for one embodiment for SMV, the codebook search improvements of application Ser. No. 11/231,643 and the Conditional Elimination Pitch Enhancement improvements herein are used in different paths. In SMV the subframe length $L_{SF}$ for Rate 1 frames is 40 samples and for Rate ½ stationary voiced (Type 1) frames the subframe length is either 53 or 54. In Rate 1 since the subframe length is 40 it does not have more than two (2) backward pitch enhancements (i.e., integer of (40/17)=2). On the Rate ½ side the maximum number of backward pitch enhancements is three (3) (i.e, integer part of 54/17).

Note that from a process standpoint, Rate 1 and Rate ½ codebook search processes involve different codebooks, different subframe lengths and different numbers of backward pitch enhancements. Hence, these operations are referred to as performed in different process paths.

The embodiment noted limits the maximum number of backward pitch enhancements to two (2) for Rate ½ Type 1 SMV frames. SMV otherwise would operate to constrain the decoder to replicate the $3^{rd}$ backward pulse enhancement if particular pulse positions are selected for Rate ½ Type 1 frame with Pitch Lag equaling 17/18 . Accordingly, the embodiment may limit the backward pitch enhancements to two in the speech decoder as well. Since the significance of the third backward pitch enhancement is limited, it will operate with third backward pitch enhancement without problems at the decoder without any modifications.

In general, other embodiments of Conditional Elimination Pitch Enhancement in a generalized framework are unlimited in the particular paths used and the number of pitch enhancements and suitably provide an appropriate conditionally-limited number of backward pitch enhancements (and also forward pitch enhancements) for each pulse based on some constraints which can be understood at the decoder side. The word "understood" is used in the sense that the decoder can be successfully and correspondingly implemented to decode the coded voice produced by the voice coder that is using such constraints or assumptions. In Conditional Elimination Pitch Enhancement, the conditional limitation number may vary with different pulses in different codebooks and in different voice codecs. Advantageously, the improvements confer a reduction in computational complexity of codebook searches in general.

The constraints which can be understood at the decoder side are as follows. For example, suppose the speech encoder were designed in such a way where the conditionally-limited maximum number of backward pitch enhancements was one. This would imply that for every one main pulse there could be only one backward pitch enhancement pulse. Then at the decoder there would be at most one backward pitch enhancement vector provided for reconstruction of the fixed codebook vector (i.e., secondary excitation) for every main pulse position index that is received. Operating according to identical assumptions at the encoder and decoder ensures that the speech/voice codec operates without mismatch in the number of backward pitch enhancements.

Note two important aspects among others herein: 1) Conditional Elimination Backward Pitch Enhancement, and 2) Pre-computed Correlations and Incremental Generation of Phi Matrix. The focus of Steps 830, 840 and 850 in FIG. 8 is Aspect 1) Conditional Elimination Pitch Enhancement. The focus of Steps 860 and 870 in FIG. 8 (and FIGS. 9-11) is Aspect 2) Pre-computed Correlations and Incremental Generation of Phi Matrix. In various embodiments, steps 830, 840 are included. For Half Rate stationary voiced frames, the steps 830, 840, 850 can be provided for computation of $\|y^2\|$ in an alternative embodiment without the Incremental Generation improvement.

A conventionally generated autocorrelation Phi Matrix is described at the 3GPP2 C.S0030-0 Version 2.0 "Selectable Mode Vocoder Service Option for Wideband Spread Spectrum Communication Systems" sections 5.6.11.5, 5.6.11.6.2, and 5.6.11.7.4 hereby incorporated herein by reference.

In FIG. 8, a succeeding step 860 performs autocorrelation of the impulse responses and generates a symmetric autocorrelation (Phi) Matrix of the autocorrelated impulse responses. An autocorrelation is a set of correlations, each one being a correlation of the impulse response with the impulse response itself lagged by a respective different integer amount of lag. (Do not confuse this lag for autocorrelation purposes with the separate concept of pitch lag $l^P_{INT}$ of pitch enhancement pulses in FIG. 6.)

Subsequent step 870 then performs codebook search using the Phi Matrix based process of obtaining denominator $\|y^2\|$ and then establishing the Cost Function to generate a best approximation to the target signal $T_g$. Notice that the Phi Matrix does not have to be burdensomely generated during step 870. Phi Matrix has advantageously been generated beforehand in step 860 so that step 870 thus advantageously and rapidly accesses values from Phi Matrix while step 870 searches the codebook and calculates Cost function values that facilitate the codebook searching.

FIGS. 9, 10A, 10B, and 10C show examples of the autocorrelation Phi Matrix depending on different values of control parameters CTRL, and specifically the subframe size $L_{SF}$ and integer pitch lag $l^P_{INT}$.

Figure 9:
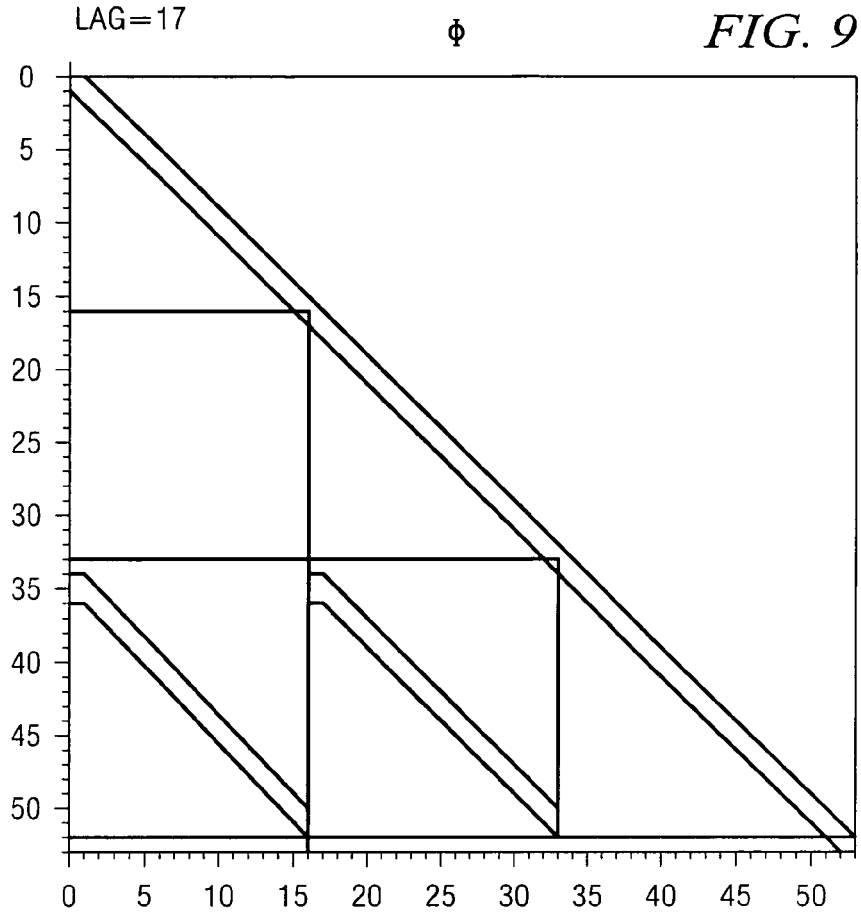
FIG. 9 is a data structure diagram of an autocorrelation matrix of impulse responses, or Phi Matrix, 53×53 for Pitch Lag equal to 17, for use in the inventive method for Pitch Enhancement of FIG. 8.

FIG. 9 depicts areas of the autocorrelation Phi Matrix in the case of subframe size 53/54 which is used for Half Rate Type 1 frames. Pitch Lag equals 17 in this example. Note that Phi Matrix has 54 rows (0-53) and 54 columns (0-53) corresponding to the larger number $L_{SF}$ of samples in the subframe. The Phi Matrix encompasses the one-smaller case of 53×53 autocorrelation matrix for subframe size 53.

Note further in FIG. 9 that the autocorrelation entries in Phi Matrix are grouped into triangular regions, a square rectangular region, and two ribbon-shaped parallelogram strip regions. The Phi Matrix $\Phi(i,j)$ is symmetric (meaning that $\Phi(j,i)=\Phi(i,j)$) so that depiction of symmetric regions and redundant cell values in the upper triangular region above the main diagonal of the Phi Matrix are omitted for brevity. These redundant cell values are suitably omitted to conserve memory space in some embodiments.

The main diagonal entries from cell (0,0) through cell (53, 53) are unlagged autocorrelation entries. For conciseness the boundaries between the various regions are indicated by pairs of column numbers and pairs of row numbers between each of which pairs the boundary lies. The boundary pairs for FIG. 9 are column number pairs (0,1), (16,17), (33,34), and (52,53); and row number pairs (0,1), (16,17), (33,34), (34,35), (35,36), (51,52), and (52,53). The strips are first, the set of cells at row-column locations {(35,0), (36,0-1), (37,1-2), (38,2-3), . . . (51,15-16), (52,16)}, and second, the set of cells at row-column locations {(35,17), (36,17-18), (37,18-19), (38,19-20), . . . (51,32-33), (52,33)}.

The vertices of the FIG. 9 ten pertinent regions for FIG. 11 double nested loop operation purposes, are as follows:

Triangle (0,0), (16,0), (16,16).
Square (17,0), (17,16), (33,0), (33,16).
Triangle (17,17), (33,17), (33,33)
Triangle (37,0), (52,0), (52,15)
Parallelogram strip (35,0), (36,0), (51,16), (52,16)
Triangle (34,0), (34,16), (50,16).
Triangle (37,17), (52,17), (52,32).
Parallelogram strip (35,17), (36,17), (51,33), (52,33)
Triangle (34,17), (34,33), (50,33)
Triangle (34,34), (52,34), (52,52)

Figure 10A:
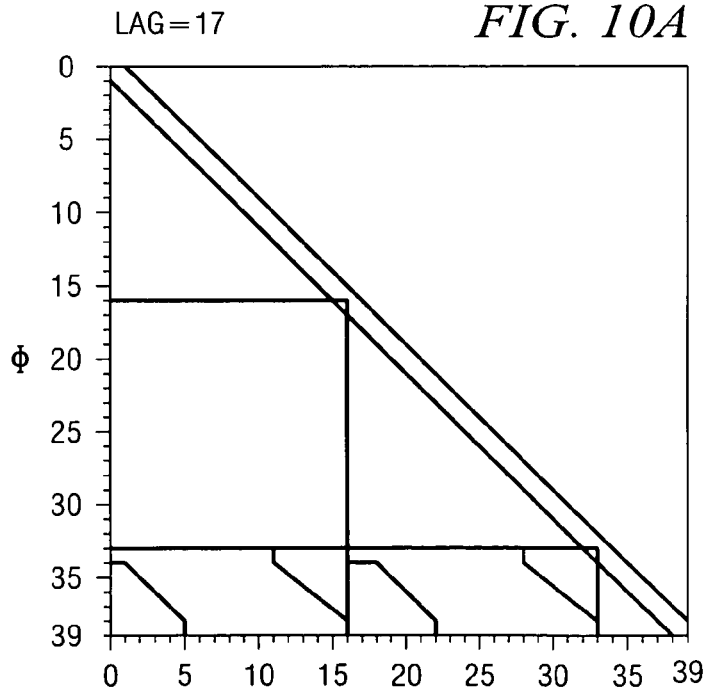
FIG. 10A is a data structure diagram of another autocorrelation matrix of impulse responses, or Phi Matrix, 39×39 for Pitch Lag equal to 17, for use in the inventive method for Pitch Enhancement of FIG. 8.
Figure 10B:
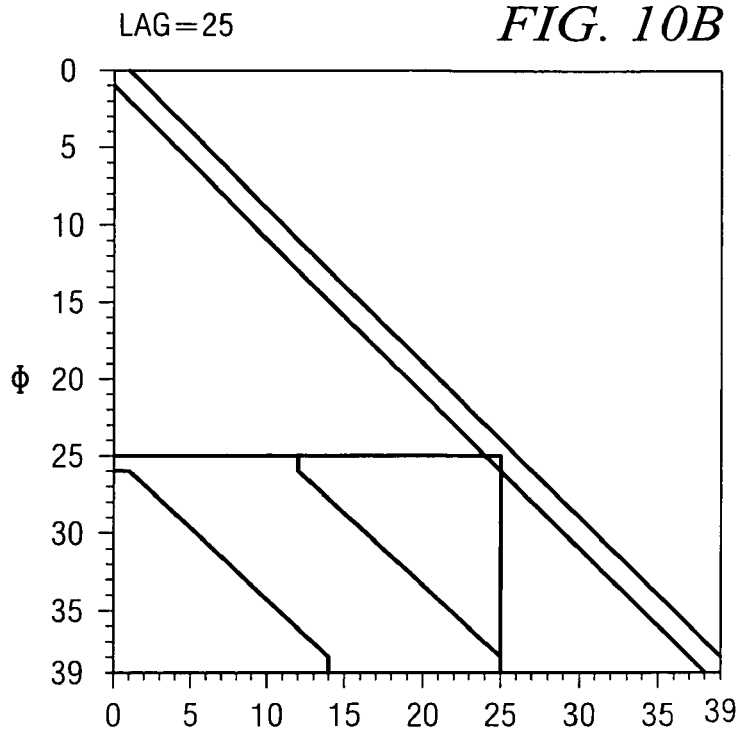
FIG. 10B is a data structure diagram of another autocorrelation matrix of impulse responses, or Phi Matrix, 39×39 for Pitch Lag equal to 25, for use in the inventive method for Pitch Enhancement of FIG. 8.
Figure 10C:
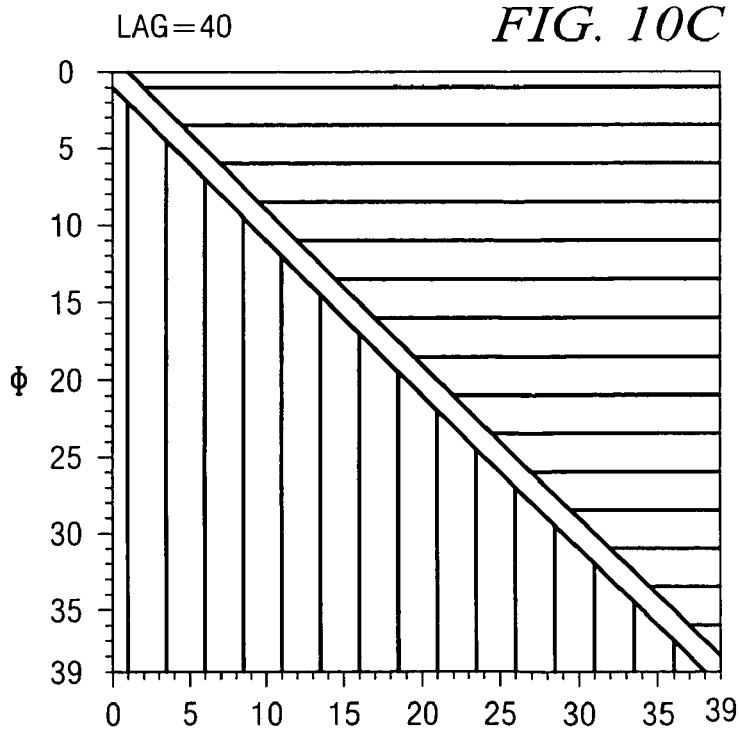
FIG. 10C is a data structure diagram of another autocorrelation matrix of impulse responses, or Phi Matrix, 39×39 for Pitch Lag greater than or equal to 40, for use in the inventive method for Pitch Enhancement of FIG. 8.

FIGS. 10A, 10B, and 10C respectively depict areas of the autocorrelation Phi Matrix in the Full Rate cases of subframe size 40 and Pitch Lag=17, Pitch Lag=25, and Pitch Lag greater than or equal to 40. Note that Phi Matrix has 40 rows (0-39) and 40 columns (0-39) corresponding to the number of samples in the subframe. For conciseness the boundaries between the various regions are again indicated by pairs of column numbers and pairs of row numbers between each of which pairs the boundary lies. The boundary pairs for FIG. 10A are column numbers (0,1), (4,5), (11,12), (16,17), (21, 22), (27,28), (33,34), and (38,39); and row numbers (0,1), (16,17), (33,34), and (38,39).

For FIG. 11 double nested loop operation purposes, vertex cell coordinates at index range limits (inclusive) are called vertices herein. Vertices of the FIG. 10A ten pertinent regions are as follows:

Triangle (0,0), (16,0), (16,16).
Square (17,0), (17,16), (33,0), (33,16).
Triangle (17,17), (33,17), (33,33)
Triangle (35,0), (39,0), (39,5)
Parallelogram (34,0), (34,11), (39,6), (39,16)
Triangle (34,12), (34,16), (38,16).
Triangle (35,17), (39,17), (39,21).
Parallelogram (34,17), (34,28), (39,22), (39,33)
Triangle (34,29), (34,33), (38,33)
Triangle (34,34), (39,34), (39,39)

Note further in FIG. 10A (Rate 1, Pitch Lag=17) that the autocorrelation entries in Phi Matrix are grouped into triangular regions, a square rectangular region, and two parallelogram regions. Again, the symmetrically located corresponding regions in the upper triangular region above the main diagonal are omitted for clarity. The main diagonal entries from cell (0,0) through cell (39, 39) are unlagged autocorrelation entries. For conciseness the boundaries between the various regions are again indicated by pairs of column numbers and pairs of row numbers between each of which pairs the boundary lies.

The boundary pairs for FIG. 10B are column numbers (0,1), (10,11), (13,14), (24,25) and (38,39); and row numbers (0,1), (24,25), (25,26), and (38,39). For FIG. 11 double nested loop operation purposes, the vertices of the five pertinent regions are as follows:

Triangle (0,0), (24,0), (24,24).
Triangle (26,0), (39,0), (39,13).
Parallelogram (25,0), (25,10), (39,14), (39,24)
Triangle (25,11), (25,24), (38,24)
Triangle (25,25), (39,25), (39,39)

Note further in FIG. 10B (Rate 1, Pitch Lag=25) that the autocorrelation entries in Phi Matrix are grouped into four triangular regions, and one parallelogram region. The symmetrically located corresponding regions in the upper triangular region above the main diagonal are omitted for clarity. The main diagonal entries from cell (0,0) through cell (39, 39) are unlagged autocorrelation entries. For FIG. 11 double nested loop operation purposes, the vertices of the five pertinent regions are as follows:

Triangle (0,0), (24,0), (24,24).
Triangle (26,0), (39,0), (39,13).
Parallelogram (25,0), (25,10), (39,14), (39,24)
Triangle (25,11), (25,24), (38,24)
Triangle (25,25), (39,25), (39,39)

In FIG. 10C, (Rate 1, Pitch Lag>=40) the autocorrelation entries in Phi Matrix are grouped into one triangular lower region and the symmetrically placed corresponding upper triangular region. Again, the main diagonal entries from cell (0,0) through cell (39, 39) are unlagged autocorrelation entries. For FIG. 11 double nested loop operation purposes, the vertices of the triangular lower region are (0,0), (39,39), (39,0).

Phi Matrix Computation

The purpose of Phi Matrix ($\Phi$) computation is to capture the correlation of impulse responses for various Pitch Lag values which are used in the fixed codebook search procedure.

In SMV, not only forward pitch enhancements but also backward pitch enhancements are used. The introduction of backward pitch enhancements results in non-causal contributions, that leads to multiple impulse response vectors depending in number on the pitch lag, the subframe size, and position of the main pulse.

Autocorrelation is a sum of multiplicative products of indexed values of the same time series multiplied times each other, and with the time series varied in lag with respect to itself over the range of index values that encompass the time series. This leads to autocorrelation computation of Phi Matrix elements at Section 5.6.11.5 of the incorporated SMV Spec. The Phi Matrix is written in somewhat different symbols as follows.

$$\Phi(i,j)=\sum_{k=\mathrm{MAX}0}^{LSF-1} H_p^{Pm(i)}(k-i)H_p^{Pm(j)}(k-j) \tag{7A}$$

The autocorrelation process multiplies vectors from filter matrix H by other vectors based on H and sums them up. In the Phi Matrix Equation (1), the resulting autocorrelation Phi Matrix $\Phi(i,j)$ has index i and index j that each independently range from zero (0) to $L_{SF}-1$ (subframe length $L_{SF}$ minus one). The range of summation that produces each cell value of the Phi Matrix is indexed on an index k which ranges between an upper value subframe size $L_{SF}$ minus one, and a lower value determined as the larger of two values according to:

$$k=\mathrm{MAX}((i-P_m(i).l^P{}_{INT}),(j-P_m(j).l^P{}_{INT})) \tag{7B}$$

Integer pitch lag $l^P_{INT}$ is multiplied by a small counting number given by a function $P_m$ applied to index i and index j respectively. Function $P_m$ specifies the number (0, 1, 2 or 3) of backward pitch enhancement pulses that can exist if the main pulse were at the index value (of i or j) given a value of the integer pitch lag. Each result is respectively subtracted from index i or index j. The greater of the two numbers establishes the lower end of the range of summation over summation index k.

Further consider the product summand $H_p^{Pm(i)}$ (k-i) $H_p^{Pm(j)}$ (k-j) in Equation (7A). Each of the symbols $H_p^{Pm(i)}$ (k-i) and $H_p^{Pm(j)}$(k-j) is called an "impulse response vector" herein because the singleton one in a pulse vector $p_i$ in effect selects a column or vector of values out of the filter matrix H of FIG. 6 when matrix H is matrix-multiplied by such pulse vector $p_i$. The impulse response vectors arise from the main pulse and the associated forward and backward pitch enhancement pulses.

Each impulse response vector represents the impulse response of the combination of a synthesis filter (e.g. filter 440 of FIG. 4) and weighting filter (e.g., 450). The impulse response appears, e.g., at the output of the weighting filter 450 when the input of the synthesis filter 440 is excited with an impulse corresponding to a main pulse $p_i$ of FIG. 6 at a pulse position selected from a codebook accompanied by a number of its backward pitch enhancement pulses given by the function $P_m$. Accordingly, in the description hereinbelow, $H_p^0$ represents an impulse response with no (zero) accompanying backward pitch enhancement pulses. $H_p^1$ represents an impulse response including one accompanying backward pitch enhancement pulse, and two for $H_p^2$ and so forth up to a maximum number of backward pitch enhancement pulses Pmax.

Qualitatively described, the relative values of index i and index j establish the relative positioning or autocorrelation lag between the two impulse response vectors that are variably positioned or variably lagged side-by-side relative to each other for purposes of generating the autocorrelation. Then the corresponding side-by-side numbers are multiplied to generate the products $H_p^{Pm(i)}$ (k-i) $H_p^{Pm(j)}$ (k-j) for each value of summation index k, and then all added up by summing over the summation index k to obtain the autocorrelation Phi value for the index pair or combination (i,j).

In the above approach the computation of summation index "k" itself in Equation (7B) for the above Equation (7A) for correlation element computation is quite intensive as it is repeated for each (i,j) index combination. Also, the processor identifies each impulse response vector $H_p^{Pm(i)}$ (k-i) and $H_p^{Pm(j)}$ (k-j) that is chosen for each index (i,j) combination. (Each impulse response vector is simply called a "vector" hereinbelow.) This results in significant burden for the computation complexity. Some processors when architecturally optimized for fast multiply-accumulates (MACs) in digital signal processing may be less efficient and consume a lot of computation power handling control code for controlling these indexes and choosing and retrieving from memory the appropriate vector for correlation computation.

However the index controlling computation can be greatly simplified or eliminated by isolating and identifying the range of index values (i,j) for which the choice of impulse vectors remains the same. The computational requirement for index "k" also is much-reduced or eliminated for those regions since the value for the maximum MAX function of Equation (7B) is the same for every pair of index values (i,j) in any one such region.

Consider the following example related to FIG. 10B in the Triangle of cells with vertices (0,0), (24,0),(24,24).

Let $L_{SF}$=40, and let integer pitch lag $l^P_{INT}$=25. For the given example $$P_m(i)=0, \text{ for } 0<=i<25 \text{ and} \tag{8}$$

$$P_m(i)=1, \text{ for } 25<=i<40. \tag{9}$$

For the given example there are two impulse response vectors $H^0_p$(i) and $H^1_p$(i).

Now using Equation (7A)

$$\Phi(24, 24) = H_p^0(15)*H_p^0(15) + H_p^0(14)*H_p^0(14) + \ldots + H_p^0(0)*H_p^0(0) \tag{10}$$

$$\Phi(23, 23) = H_p^0(16)*H_p^0(16) + H_p^0(15)*H_p^0(15) + H_p^0(14)*H_p^0(14) + \ldots + H_p^0(0)*H_p^0(0) \tag{11}$$

Considering Equation (10) and Equation (11) together reveals that once a first value of autocorrelation Phi Matrix Φ(i,j) such as Φ(24,24) of Equation (10) is computed at the upper end of an index range for a region, the subsequent values of Phi Matrix Φ(i,j) in the region are the same as $$\Phi(23, 23) = \Phi(24, 24) + H_p^0(16)*H_p^0(16) \tag{11A}$$

$$\Phi(22, 22) = \Phi(23, 23) + H_p^0(17)*H_p^0(17) \tag{12A}$$

$$\vdots$$

$$\Phi(0, 0) = \Phi(1, 1) + H_p^0(39)*H_p^0(39) \tag{13A}$$

Equations (11A), (12A), . . . (13A) are examples of what is called herein "Incremental Generation." In other words, instead of having to perform an extremely tedious repetition of extremely numerous multiplying and adding, as in Equation (11), a much-reduced single multiply-add operation of Equation (11A) is provided.

Similarly, $$\Phi(24, 23) = H_p^0(15)*H_p^0(16) + H_p^0(14)*H_p^0(15) + \ldots H_p^0(0)*H_p^0(1) \tag{14A}$$

$$\Phi(23, 22) = \Phi(24, 23) + H_p^0(16)*H_p^0(17) \tag{14B}$$

$$\Phi(22, 21) = \Phi(23, 23) + H_p^0(17)*H_p^0(18) \tag{14C}$$

$$\vdots$$

$$\Phi(1, 0) = \Phi(2, 1) + H_p^0(38)*H_p^0(39) \tag{14D}$$

Advantageously, comprehensive consideration of various index values now reveals a process wherein i=0, 1, . . . 24 & j=0, 1, . . . 24 the process uses vector $H^0_p$ for autocorrelation generation.

Similarly, for i=25, 26, . . . 39 & j=25, 26, . . . 39 the process uses vectors $H^1_p$ for autocorrelation.

For i=0, 1, . . . 24 &j=25, 26, . . . 39 the process uses vectors $H^0_p$(i) and $H^1_p$ (j) for autocorrelation.

From the above observations, note particular regions of Phi Matrix are identifiable in which the impulse response vector products $H_p^{Pm(i)}$ (k-i) $H_p^{Pm(j)}$ (k-j) have both superscripts unchanging in any given one such region. These regions can be identified, separated out or segregated for purposes of the remarkable processing operational method based on the region of index (i,j) combinations. For each such region or range of index (i,j) combinations, the computation and indexing is simplified and written in a simplified fashion. Then the process of operating the processor is performed and executed in a double nested loop structure applied to rapidly generate all the Phi matrix values in one of the regions. Then the double nested loop structure is applied to rapidly generate all the Phi Matrix values in another one of the regions, and so on until all the values for the entire Phi Matrix are rapidly obtained in this remarkable process.

Each Phi Matrix of FIGS. 9, 10A, 10B, 10C is shown and generated respectively to a given corresponding value of the Pitch Lag $l^P_{INT}$. Each such Phi Matrix has outlined regions drawn therein. Each outlined region represents the set or combination of indexes (i,j) for which the Phi Matrix Φ(i,j) can be efficiently computed with a single one of the double nested loop structures of FIG. 11. For each of these regions the lower limit of index k=MAX( ) in the auto-correlation Phi Matrix Φ(i,j) Equation (6) is very simple to determine or can be pre-computed. Thus, explicit computation is unnecessary and index k is advantageously established instead by incrementing or decrementing of registers in DSP instructions.

In FIG. 11, an improved process of operating the processor is performed and executed in a double nested loop structure. The flow chart of FIG. 11 represents an embodiment of operational process used to generate the triangular shaped region of indices (i,j) of the autocorrelation Phi Matrix Φ(i,j) in FIG. 10B defined hereinabove as Triangle (0,0), (24,0),(24,24). For example, in FIG. 10B and FIG. 11, the process generates Φ(24,24) . . . Φ(0,0) for $L_{SF}$=40 and integer pitch lag $l^P_{INT}$=25 in an inner loop. Then the process generates Φ(24,23) . . . Φ(1,0); Φ(24,22) . . . Φ(2,0); . . . down to Φ(24,1) . . . Φ(23,0) followed by value Φ(24,0).

In FIG. 11, a Phi Matrix generation process 1600 commences with BEGIN 1605 and proceeds to a step 1610 to identify regions of equal numbers of backward pitch enhancements such that Pm(i) and Pm(j) are each unvarying in the region. In this Triangle example, the backward pitch enhancement numbers are zero.

Then a step 1620 temporarily stores values $i_{max}$, $i_{min}$, $j_{max}$, $j_{min}$ defining the index range(s) that identify the region. In the Triangle, $i_{max}$=24, $i_{min}$=0, $j_{max}$=24, $j_{min}$=0.

A succeeding step 1630 next initializes decrementable loop indices i' and j' at the respective upper ends $i_{max}$, $j_{max}$ of the ranges defining the region.

A decision step 1640 determines whether outer loop index $j_{max}$ is still greater than or equal to the lower limit $j_{min}$ of its index range.

If so (Yes), then operations proceed to an operational process step 1650 that generates a cell value of the auto-correlation Phi Matrix Φ(i,j) where i=i' and j=j' according to summation Equation (7A) and stores that cell value of Phi Matrix Φ(i,j). For the Triangle example that value is Φ(24,24) from Equation (10) hereinabove.

Succeeding step 1660 uses Incremental Generation to incrementally compute and supply a cell value of the auto-correlation Phi Matrix Φ(i,j) where (i,j)=(i',j') and (i',j') is repeatedly decremented on both indices (i'−1, j'−1) by step 1670, and stores each resulting cell value of Phi Matrix Φ(i,j). Then a decision step 1175 checks whether index i-prime is less than its minimum value $i'<i_{min}$. If not, operations loop back to step 1660 generate another cell value of Phi Matrix Φ(i,j) by the remarkably efficient Incremental Generation method herein.

Steps 1660, 1670, 1675, 1660 thus constitute an inner loop back to step 1660 in the double loop structure of FIG. 11. In the inner loop step 1660, the set of indices (i,j) computed are given by the set {(i'−1, j'−1), (i'−2, j'−2), . . . ($i_{min}$, j'−i'+$i_{min}$)} whereupon each resulting cell value of Phi Matrix Φ(i,j) is determined by Incremental Generation and stored.

In process step 1660 Incremental Generation is performed by recalling brute-force Equation (7A)

$$\Phi(i,\ j) = \sum_{k=\mathrm{MAX}0}^{LSF-1} H_p^{Pm(i)}(k-i)H_p^{Pm(j)}(k-j) \tag{7A}$$

The next autocorrelation value (if any left) in the identified region is $$\Phi(i-1,\ j-1) = \sum_{k=\mathrm{MAX}0}^{LSF-1} H_p^{Pm(i-1)}(k-(i-1))H_p^{Pm(j-1)}(k-(j-1)) \tag{15}$$

Note that because the inner loop is following a trajectory from (i,j) to (i−1, j−1) in the same region, Pm(i−1) is still same as Pm(i), and Pm(j−1) is still same as Pm(j). Moreover, let the lower-end value of k for computing Phi Matrix cell (i,j) be designated $k_o$=MAX( ), same as from Equation (7B). But now, the lower end value of k for computing Phi Matrix cell (i−1, j−1) is, because of the identified region, just one less in Equation (15) than it was in Equation (7A).

Remaining in the identified region as taught herein allows Equation (15) to be rewritten $$\Phi(i-1,\ j-1) = \sum_{k=ko-1}^{LSF-1} H_p^{Pm(i)}(k-(i-1))H_p^{Pm(j)}(k-(j-1)) \tag{16}$$

Subtracting Φ(i,j) Equation (7A) from Equation (16) and rearranging, yields an Incremental Generation for process step 1660:

$$\Phi(i-1,\ j-1) = \Phi(i,\ j) + \sum_{k=ko-1}^{LSF-1} H_p^{Pm(i)}(k-(i-1))H_p^{Pm(j)}(k-(j-1)) - \sum_{k=ko}^{LSF-1} H_p^{Pm(i)}(k-i)H_p^{Pm(j)}(k-j) \tag{17}$$

Inspection of the two summations in Equation (17) shows that all terms except the top summand of the first summation are cancelled out by subtraction by the second summation. The H values with indices (k-(i−1)) and (k-(j−1)) in the first summation are cancelled because $$((k-1)-(i-1))=(k-i) \text{ and} \tag{18}$$

$$((k-1)-(j-1))=(k-j) \tag{19}$$

The result of subtraction in Equation (17) is a far-simplified Incremental Generation for process step 1660 as shown next:

$$\Phi(i-1,j-1)=\Phi(i,j)+H_p^{Pm(i)}(L_{SF}-i)H_p^{Pm(j)}(L_{SF}-j) \tag{20}$$

This Incremental Generation for autocorrelation Phi Matrix purposes is remarkable and advantageous for substantially reducing the burden on the processor. Simply by multiplying two H values and adding them to a previously-computed Phi Matrix cell value at indices (i,j) suffices with only one Multiply-Accumulate (1 MAC) to yield another cell value diagonally "northwest" of it, until the boundary of the identified region is reached.

In FIG. 11, the indices (i',j') are decremented equally with each loop of step 1660. Remember index i-prime i' starts out at value $i_{max}$ and index j-prime j'starts out at value $j_{max}$ Then when index i-prime i' reaches the lower end $i_{min}$ of its range in the region by operation of step 1670, the index j-prime reaches the corresponding value $$j_{min}=j'-(i'-i_{min})=j'-i'+i_{min}. \quad (21)$$

Accordingly, to define the loop ranges for the indices for the region, three index values such as $i_{max}$, $i_{min}$, $i_{max}$ are sufficient. The testing step 1675 simply tests one of the indices such as index i so that the inner loop of step 1660 ends when i-prime is decremented below the minimum value $i_{min}$. In the Triangle example, this initially occurs when i-prime i' is decremented below zero.

The decision step 1675 thus checks whether index i-prime is less than its minimum value $i'<i_{min}$. If so (Yes) at step 1675, operations proceed to a step 1680 to decrement the outer loop index $j_{max}=j_{max}-1$ in the case of a bottom-down triangle. In the cases of a bottom-up triangle or a parallelogram leave the outer loop index unchanged. This outer loop index represents a Phi Matrix column in which operations are to begin on the next inner loop cycle. The maximum row value $i_{max}$ is unchanged in this embodiment.

Next in a step 1690, the minimum row value $i_{min}$ or maximum row value $i_{max}$ is either left unchanged or altered in an advantageously uncomplicated manner that depends on the shape of the region. In general, the minimum and maximum row values are different functions of the maximum row and column values as follows:

$$i_{min}=f1(i_{max}j_{min}j_{max}) \quad (22)$$

$$i_{max}=f2(i_{min}j_{min}j_{max}) \quad (23)$$

In the case of a bottom-down triangle such as the Triangle here, leave the maximum row value $i_{max}$ unchanged and increment the minimum row value $i_{min}=i_{min}+1$. Also, in that case of bottom-down triangle, $$i_{min}=i_{max}-j_{max}. \quad (22A)$$

In the case of a bottom-up triangle or parallelogram canted left as in the illustrations, in step 1690 leave the minimum row value $i_{min}$ unchanged and increment the maximum row value $i_{max}=i_{max}+1$.

For purposes of step 1690, treat a square as two triangular regions, one triangle bottom-down, the other triangle bottom up. Also because the processing trajectory is diagonal, treat each rectangle as three regions, one triangle bottom-down, one parallelogram, and one triangle bottom-up. This accounts for the various shapes of regions in FIGS. 9, 10A and 10B.

Operations proceed from step 1690 back to step 1630 to reset the row index i-prime i' equal to $i_{max}$ and column index j-prime j'to $j_{max}$.

An outer loop comprised of steps 1630 through 1690 surrounds the inner loop of steps 1660-1675. At the conclusion of operations of the outer loop, decision step 1640 determines that outer loop index $j_{max}$ is no longer greater than or equal to the lower limit $j_{min}$ of its index range and branches to a RETURN 1695. In the Triangle case outer loop index $j_{max}$ has gone below zero, the lower limit $j_{min}$ of its index range, and branches to RETURN 1695.

Having thus described an operational process embodiment, attention is directed back to each of FIGS. 9, 10A, 10B, and 10C with regions as specifically defined in this detailed description. In every case, the regions are in the shape of a square, parallelogram, or triangle, so that the double nested loop structure of FIG. 11 is sufficient or more than sufficient to encompass the much-simplified operational process. In this way, Pitch Enhancement is advantageously accomplished with many fewer process operations and attendant power dissipation and real-time burden.

FIG. 12 pictorially shows the target to be matched, namely target signal $T_g$ as a wavy electrical signal which is converted to digital form for digital processing according to an improved method that is suitably programmed in software. In a "single pulse search," a first single pulse is varied among the codebook first-track-specified row positions in the vector representing single pulse $p_i$ to find a "best" row position where the error function of FIG. 6 is minimized. Then keeping that first one pulse in its "best" row position, a second single pulse is introduced and varied among the codebook second-track-specified row positions in the vector representing single pulse $p_i$ to find a "best" row position for the second single pulse where the error function of FIG. 6 is minimized. Then keeping the first and second single pulses in their "best" position, additional single pulses are introduced up to the number of tracks in the codebook, if any more tracks exist in the codebook.

FIG. 13 shows a flow diagram of the single pulse search. Operations commence at BEGIN 1710 and proceed in a step 1720 to minimize the mean-square error of FIG. 6. Operations in step 1720 follow nested loops of processor operation. An inner loop moves the pulse, i.e. changes the pulse vector to new values on a given track in the codebook. A next outer loop goes to the next track and introduces an additional single pulse as discussed in the paragraph above. (In the SMV code, searching the codebooks does not explicitly involve software loops, but the process is suitably viewed as a loop for searching multiple codebooks.) A next outer loop goes to the next "Turn" meaning an additional search that starts with the pulse positions estimated in a previous codebook search, such as by the inner loops of FIG. 13. An outermost loop searches additional sub-codebooks. The result supplied in step 1730 from step 1720 is a fixed codebook excitation vector c which represents the estimated pulse positions of the respective pulses corresponding to the codebook tracks, whereupon RETURN 1740 is reached.

FIG. 14 shows a flow diagram of a different kind of pulse search, called 2-pulse sequential joint position search, or just sequential joint search. Operations commence at BEGIN 1810 and proceed in a step 1820 to minimize the mean-square error of FIG. 6. Operations in step 1820 follow different nested loops of processor operation. For a pair of pulses corresponding to two selected tracks of the codebook, an inner loop moves a pulse i2 among the pulse positions in the track having the greater number of pulse position entries compared to the other track in the two selected tracks. A next inner loop moves a pulse i1 among the pulse positions in that other track of the two selected tracks. A next outer loop goes to a next pair of tracks and moves a pair of pulses by executing the inner loops. The outermost loop goes to a next "Turn" meaning an additional search that starts with the pulse positions estimated in a previous codebook search, such as by the inner loops of FIG. 14. The result supplied in step 1830 from step 1820 is a fixed codebook excitation vector c resulting from sequential joint search. The excitation vector c represents estimated pulse positions of the respective pulses corresponding to the pairs of codebook tracks, whereupon RETURN 1840 is reached.

FIG. 15 illustrates a method called sequential joint search to match wavy electrical target signal $T_g$ of FIG. 12 with a digital form for digital processing according to an improved method herein suitably programmed in software. In a sequential joint search, pulses in a pair of tracks are varied among the codebook track-specified row positions in vectors representing pulses $p_i$ to find a "best" pair of row positions where the error function of FIG. 6 is minimized. Then keeping those first two pulses in their "best" row positions, a second pair of pulses is introduced and varied among the codebook second track-pair-specified row positions in vectors representing pulses $p_i$ to find a "best" pair of row position where the error function of FIG. 6 is minimized. The process is repeated until all pairs of the tracks are used up from the codebook.

FIG. 15 further goes on to illustrate Selective Joint Search for improving codebook searching. Selective Joint Search is an improved method for searching for best positions for pulses in pairs where the search is restricted to fewer than all the tracks in the codebook being searched. One embodiment restricts joint position search to 6 tracks out of an 8 track codebook. These 6 tracks correspond to the 6 pulses that contribute least to the Cost function, which is inversely related to the mean squared error criterion. Selective Joint Search is not found in SMV.

In FIG. 16, a comparison of flows for SMV on left with improved method herein on right is directed to Type 1 frames such as for Rate 1.

Type 1: For voiced stationary frames (Type 1), an example of the improved method 1950 at right in FIG. 16B has a BEGIN 1955 and then a step 1960 searches the one 8-track codebook, using a single pulse search in the first turn. Then a step 1970 finds the tracks for pulse positions contributing least to the Cost function of Equation (2). Next, a step 1980 of the method employs the special Selective Joint Search on the six tracks corresponding to the best six pulses out of eight for refinement, whence RETURN 1995 is reached.

Thus, for voiced stationary frames (Type 1) the improved method provides one (1) turn of Single pulse search followed immediately thereafter by Selective Joint Search. The concept of turn as defined by the SMV Standard is no longer meaningful for purposes of some of the embodiments. For Type 1 frames the improvement replaces four (4) turns of SMV prior execution with an improved method that requires only about half (about 50%) the computations.

Now look at the SMV flow at left in an unimproved method of FIG. 16A. In the standard SMV method of Joint Search for Turn 1 of Type 1 voiced stationary frames using the 8-track codebook: a START 1905 is followed by a step 1910 wherein Tracks (0,1), (2,3), (4,5), (6,7) are 2-pulse jointly searched in sequential fashion. A decision step 1915 determines that a second turn remains to be executed, and operations loop back to step 1910. In step 1910 for Turn 2: Tracks (1,2), (3,4), (5,6) are jointly searched in sequential fashion. See also FIG. 19 upper left sequential joint search, turns 1 and 2. Then a step 1920 refines the candidate pulse positions using single pulse search, followed by decision step 1925 which loops back to step 1920 for a second turn, whence operation reaches END 1930.

But in the Selective Joint Search approach used just after Turn 1 in the improved search shown as the lower portion of FIG. 19 and in FIG. 16B, the tracks selected on refinement are based on the Cost function criteria. For example, suppose that the six lowest contributions to the Cost function, ordered from least to most were from tracks 2, 5, 7, 8, 1, and 6. Then the Selective Joint Search approach searches track pairs (2,5) (7,8) (1,6) in that order, from least to most contribution to the Cost function.

Selective Joint Search thus picks or selects the possible candidates for the joint search to be conducted. Selective Joint Search specifically predicts or establishes which of the pulse tracks should be searched among the whole set.

An even further improved Selective Joint Search embodiment comprehended in the flow on right in FIG. 16B limits the number of pairs of tracks to two (2) instead of three (3) for purposes of Selective Joint Search. Also additional rules are imposed on the pair of tracks that are jointly refined.

A comparison of flows for SMV in FIG. 17A on left with improved method in FIG. 17B on right is directed to voiced non-stationary (Type 0) frames such as for Rate 1.

Type 0: For all other frames (Type 0), an unimproved method of FIG. 17A (and top line of FIG. 20) commences with a START 2005 and proceeds to step 2010 and decision step 2015 to single-pulse search the three 5-track sub-codebooks (each with a single turn for total of 3 turns). Then the method of FIG. 17A picks the best of the three sub-codebooks in a step 2020. Then that unimproved method searches the selected sub-codebook in a step 2025 with three time-consuming turns of sequential joint search, whence an END 2030 is reached.

Type 0: For all other frames (Type 0), an improved method uses Selective Joint Search as shown on right in FIG. 17B. The FIG. 17B improved method 2050 commences with BEGIN 2055 and proceeds to step 2060 and decision step 2070 to single-pulse search the three 5-track sub-codebooks (each with a single turn for total of 3 turns) as in FIG. 18. Then the method of FIG. 17B advantageously follows up in step 2080 not only with picking the best of the three sub-codebooks but also using the special Selective Joint Search procedure of identifying two pairs of tracks for the pulse positions contributing least to the Cost function and thus most in need of refinement. Then in a step 2090, Selective Joint Search advantageously refines those two pairs of tracks as in FIG. 19 with sequential joint search utilized so much less that only one-third the complexity is incurred.

For Type 0, the improved method on right in FIG. 17B thus replaces SMV's three turns of sequential joint search shown on left in FIG. 17A with one execution of the new Selective Joint Search for a savings of about two-thirds or 66% (not counting the previous sub-codebook searching turns).

For Type 0 frames, the Selective Joint Search on right in FIG. 17B instead refines two (2) pairs of tracks rather than six (6) pairs of tracks (6×2=12 tracks) in standard SMV. "Refine" and "refinement" for this purpose means searching each of the pairs with joint search and picking the pulses which maximize the Cost function. Six (6) pairs of tracks is equivalent to three (3) turns of Sequential Joint Search in Full Rate Type 0 frames. In standard SMV on left in FIG. 17A for Full Rate Type 0 frames, sequential joint search is done in 3 turns. In the first turn of standard SMV sequential joint search, Tracks (0,1) & (2,3) are refined. In the second turn of standard SMV sequential joint search, Tracks (1,2) & (3,4) are refined. In the third turn of standard SMV sequential joint search, Tracks (0,1) & (2,3) are refined. i.e. 6 pairs of tracks or 12 tracks are refined.

As noted in the previous paragraph, for Type 0 frames, the Selective Joint Search of the improved method on right in FIG. 17B instead refines two (2) pairs of tracks rather than six (6) pairs of tracks (6×2=12 tracks) in Standard SMV. In other words the Selective Joint Search improvement uses only four (4) tracks for Type 0 frames.

A turn of single-pulse search is performed on all five tracks in each sub-codebook beforehand. In other words, for each of three (3) sub-codebooks in Type 0 frames, one single turn search for each sub-codebook is performed independently. The sub-codebook that resulted in the highest value of the Cost function is selected as the best sub-codebook for further processing. In the single-pulse searching, the respective contributions to Cost function by each of the tracks in the selected sub-codebook were advantageously recorded and are retained, at least temporarily. These contributions are used to rank the tracks T=0, 1, 2, 3, 4 by contribution T(C0), T(C1), T(C2), T(C3), T(C4) from highest contribution track T(C0) to Cost function to lowest contribution track T(C4). Then the lowest-performing pair of tracks {T(C3), T(C4)} is refined first by joint search, and then the next lowest-performing pair of tracks {T(C2), T(C1)} is refined second by joint search. In this way, the Selective Joint Search improvement advantageously refines only two pairs of tracks (only 4 tracks) for searching Type 0 frames at this point instead of six pairs of tracks (12) tracks as in the Standard SMV. As a further advantage, the two (2) pairs of tracks selected in FIG. 17B for refinement in the remarkable Selective Joint Search are selected dynamically based on the Cost function.

In FIG. 18, various improved methods of codebook search are summarized.

In FIG. 18, operations commence with BEGIN 2105 of Selective Joint Search. Operations proceed in step 2110 to obtain a set of estimated pulse positions having a first number N of tracks of the estimated pulse positions. Next a step 2120 uses a Cost function measure to find a best subset of a second number n of pulse tracks fewer in number than the first number N wherein the subset of pulse tracks contributed less to the Cost function measure than any other subset of the pulse tracks equal in number to the second number n of pulse tracks. A succeeding step 2130 configures control data for controlling a subsequent pulse position search beginning in order with the estimated pulse tracks pertaining to the least-contributing subset of pulse tracks. This method embodiment yields refined estimated pulse positions. Then a step 2140 goes to and executes a sequential joint position search of FIG. 14, to do a subsequent pulse position search for refined estimated pulse positions of pulses in at least one pair of pulse tracks thus identified and established by Selective Joint Search.

Further in FIG. 18, the obtaining process includes a single-pulse position search 2150 for estimated pulse positions of pulses prior to BEGIN 2105 so that step 2110 is provided with the estimated pulse positions. Advantageously, only one turn of single-pulse position search is sufficient for Type 1 frames in the improved fast codebook search of FIG. 19 for Type 1 frames.

In FIG. 20, advantageously, only one turn of a single-pulse search of fast-selected single codebook is sufficient for Type 0 frames in a very fast embodiment of improved codebook search of FIG. 20 (bottom line). In that very fast embodiment for Type 0, the process selects by step 2170 of FIG. 18 a preferred sub-codebook from a number of sub-codebooks, and executes a single-pulse position search of the preferred sub-codebook to obtain the estimated pulse positions.

The sub-codebook chosen is a priori decided, in one embodiment, to be the second 5-Pulse sub-codebook for Rate 1, Type 0 frames of SMV (Table 5.6-3 of SMV Spec). The a priori choice in general selects the sub-codebook offering reduced computational complexity, which is less than for the extensive first SMV 5-Pulse sub-codebook (Table 5.6-2 of SMV Spec) and comparable to third SMV 5-Pulse sub-codebook. Also, the pulse positions structure of the second 5-Pulse sub-codebook is more flexible than 3rd subcodebook (Table 5.6-4 of SMV Spec) because the second 5-Pulse sub-codebook values span a wider range of numerical choices. Accordingly, the second 5-Pulse sub-codebook is a priori chosen and automatically selected at the beginning of the process of FIG. 20, last line, in this very fast embodiment.

In an alternative embodiment, the chosen sub-codebook is dynamically predetermined prior to the single-pulse search, based on input parameters to the sub-codebook search. The predetermination process utilizes information computed during signal modification in block 340 (FIG. 3) of the weighted speech signal. The modification of the weighted voiced speech is conducted on a variable subframe basis. The subframe size is related to pitch lag value and the location of the subframe within a frame. The number of variable subframes is calculated for each frame. Typically for stationary voiced (Type 1) frames the number of variable subframes is limited due to its relation to pitch lag value which is limited to minimum of 17. However for certain non stationary voiced (Type 0) frames, which occur rarely, the number of variable subframes are high. For Type 0 frames the information of number of variable subframes is utilized to conditionally eliminate two of three sub-codebook fixed code book single pulse searches.

The significance is that on a statistical basis and understanding of signal modification properties, it rarely happens that the number of variable subframes exceeds eight (8). Whenever that number exceeds eight (8), the sub-codebook is pre-selected. The complexity of signal modification increases with number of variable subframes. The increase in complexity in signal modification is reduced by pre-selection of the sub-codebook without affecting the quality of the speech.

In another fast embodiment of improved codebook search of FIG. 20 (middle line), the obtaining process in FIG. 18 applies a step 2160 to provide a plurality of single-pulse position searches of respective sub-codebooks prior to BEGIN 2105 and step 2110. Step 2160 identifies which one of the respective sub-codebooks is best in the sense of making the Cost function the highest in value. Then that best sub-codebook is selected. The estimated pulse positions resulting from the single-pulse position search of the sub-codebook thus identified or selected are the estimated pulse positions obtained for step 2110.

In FIG. 18, after the configuring in step 2130, the step 2140 executes sequential joint position search beginning with the estimated pulse positions pertaining to the least-contributing pulse tracks. This yields refined estimated pulse positions of the best subset of pulses.

In FIG. 19 (lower line) for Type 1 frames and FIG. 20 (lower two lines) for Type 0 frames, the Selective Joint Search examples use some or all of FIG. 18 steps 2110, 2120, 2130, 2140.

Correspondingly, and looking above and in FIG. 2, an electronic circuit includes a processor circuit and a storage circuit establishing voice coding for execution by the processor. These circuits are suitably practiced in integrated circuit 1100 and/or 1400 by using any one, some or all of audio block 1170, RISC, DSP, RAM and ROM.

The voice coding using Selective Joint Search of any of FIG. 18, and/or FIG. 19 (lower line) and/or FIG. 20 (either of the lower two lines) is operable to obtain a set of estimated pulse positions having a first number N of pulse tracks of the estimated pulse positions, use a cost function to find a subset including a second number n of pulse tracks fewer in number than the first number N wherein the subset of pulse tracks contributed least to the cost function relative to any other equally-numerous subset of n pulse tracks, and control a subsequent pulse position search beginning with the estimated pulse positions pertaining to that least-contributing subset of pulse tracks to yield refined estimated pulse positions.

In FIGS. 21-27, improved methods including special pre-searching based on pitch lag are described. A significant portion of computational complexity in SMV speech codec can be attributed to the fixed codebook search (FCS) that is done using multiple codebooks and signal warping. During short pitched frames the complexity of signal warping is high. Computational efficiency of FCS in stationary voiced (Type 1) frames of both half and full-rates of SMV is increased as described.

SMV is a type of Relaxed Code Excited Linear Prediction (RCELP) based speech codec wherein the coding process involves matching of a time warped speech signal rather than the original speech signal. The speech signal warping is typically of variable complexity and is high for speech signals containing short, higher pitches such as in female and child voices. The speech frames are classified as Stationary Voiced (Type 1) or Non-stationary voiced (Type 0) based on the signal characteristics.

The speech codec receives voice samples and generates an encoded speech packet for every frame (160 speech samples). A frame of speech is encoded into spectral envelope parameters and excitation parameters. The excitation parameters include adaptive code book index and fixed codebook indexes. As shown in FIGS. 4 and 5 and FIG. 12, the Fixed Codebook (FCB) indexes model the secondary excitation for the synthesis filter. The fixed codebook search (FCS) is believed to impose 30-40% of the computational complexity of the speech encoder.

Each pulse having a permitted pulse position tabulated in the pulse codebook is called a main pulse. In FIGS. 6, 21, 22, and 23, each main pulse can be repeated within the subframe, with an appropriate gain factor, on intervals corresponding to the pitch lag $l^P_{INT}$ of the subframe. In SMV, the pitch lag $l^P_{INT}$ value is greater than 16 for Half Rate Type 1 frames. Pulse insertion after the main pulse is called forward pitch enhancement, and pulse insertion before the main pulse is called backward pitch enhancement.

The gain factor of a pitch enhancement pulse is the ratio of the height of that pitch enhancement pulse to the height of the main pulse to which that pitch enhancement pulse pertains. In Stationary Voiced (Type 1) frames the gain factor of each forward and backward pitch enhancement pulse is typically high and closer to unity.

In FIG. 21, a Half Rate Type 1 subframe has pitch lag=18, gain factor of 0.9 and subframe length 53. For Main pulse at position 0, the forward enhancement pulses are located at position 18 with gain of 0.9 and position 36 with gain factor 0.81 (i.e., $0.9^2$).

In FIG. 22, the Main pulse is located at position 18. The backward enhancement pulse is located at position 0 with gain of 0.9 and forward enhancement pulse at position 36 with gain factor 0.9.

In FIG. 23, for Main pulse at position 36, the backward enhancement pulses are located at position 18 with gain of 0.9 and position 0 with gain factor 0.81 (i.e., $0.9^2$).

As seen from the above FIGS. 21, 22, 23, the secondary excitation contribution due to each main pulse with its pitch enhancement pulse(s), in the cases wherein the main pulse differs in relative position or is displaced by integer multiple of pitch lag, does not significantly vary and is not significantly different. The similarity of excitation structures or illustrated patterns of FIGS. 21-23 increases when the gain factor approaches unity. The excitation structures or excitation pulse ensembles are identical when the gain factors are all 1.0 (unity). The positions of the main pulse and the pitch enhancement pulses are substantially interchanged, and the heights of the main pulse and pitch enhancement pulses represent substantially similar intensity or amplitude as the main pulse has.

The gain factors are typically high and close to unity in FIGS. 21, 22, and 23 for stationary voiced (Type 1) frames. A special pre-search method, of FIG. 24 lower timeline and FIG. 25, exploits this near-unity aspect to further reduce the complexity significantly for Half Rate Type 1 frames. Only one among main pulse positions (e.g., as in FIGS. 21-23) differing by integer multiple of pitch lag is selected. In other words, among FIGS. 21, 22, and 23, for instance, only one of those three FIGS. 21-23 is selected as the pulse pattern to include into a reduced-size Fixed codebook FCB. The pitch enhancement pulses associated with the selected main pulse position are, in effect, selected along with that main pulse position.

The extensive FCB of conventional SMV has numerous triples and pairs of main pulses that differ by integer multiple of pitch lag. A much smaller FCB is constructed, by the special pre-search just described, from the extensive FCB of conventional SMV. Then operations proceed to perform a 2-pulse joint search much more efficiently on the much smaller FCB because what in effect amounts to redundancy in the extensive FCB of conventional SMV is obviated and selected away.

The candidate main pulse selected maximizes a cost function or criterion such as epsilon tilde of equation (3A) according a special pre-search process is described later hereinbelow. An example of the improved method reduces the complexity of FCS 2-pulse search for Half Rate Type 1 frames by up to nearly 90% when the signal warping complexity is high in very short pitch speech signals. The search complexity is reduced when the pitch lag is small.

In FIGS. 24-27, improved FCS search space reduction methods dynamically control the complexity of Fixed codebook search in Stationary voiced (Type 1) frames. The search complexity is related to the pitch or pitch lag: the lower the pitch or pitch lag the higher the complexity of signal warping. Also, the higher the pitch or pitch lag the lower the complexity of signal warping.

In FIG. 25, the special pre-search procedure is further simplified by introducing a condition 2310 testing whether the pitch lag is less than 49 for Half Rate Type 1 frames, and the special pre-search procedure is performed when that condition is met.

In Full Rate Type 1, conventional SMV uses an 8 pulse FCS. The conventional SMV searching involves two turns of Sequential Joint Pulse Search followed by refinement by two turns of single pulse search. This is described in detail in 3GPP2 C.S0030-0. See upper time line of FIG. 19.

FIGS. 26 and 27 depict an improved method for algebraic codebook search space reduction in Full Rate Type 1 frames that improves over conventional SMV and also application Ser. No. 11/231,643. In FIG. 19, lower time line herein, shows a search procedure in said application that executes Single pulse search to set initial pulse positions and follows with Selective Joint Search.

In the improvements of FIGS. 26 and 27, further complexity reductions are achieved by introducing a test for a condition that the pitch lag $l^P_{INT}$ value is less than 33. Moreover, a special pre-search procedure 2550, analogous to the special pre-search described herein for Half Rate 2-pulse pre-search steps 2330-2340, is performed for Full Rate when a condition 2510 of pitch lag less than 33 is met. Joint pulse search method 2560 is applied over the pre-searched candidates.

Description now turns to building-blocks for understanding the improved processes used herein. As noted earlier hereinabove, the fixed code book search (FCS) involves analysis-by-synthesis to find a fixed-codebook excitation vector c, which minimizes a mean-square error measure epsilon:

$$\epsilon=\|T_g-gHc\|^2 \tag{1}$$

H is a matrix. Each column of matrix H includes the impulse response to a corresponding given main pulse position and any pitch enhancement pulse(s) associated therewith. By solving Equation (1) for the optimal gain and substituting the optimal gain into Equation (1), minimizing epsilon $\epsilon$ is equivalent to maximizing a cost function epsilon-tilde:

$$\tilde{\varepsilon}=\frac{((T_g)^T Hc)^2}{\|Hc\|^2}=\frac{((H^T T_g)^T c)^2}{c^T H^T Hc} \tag{2}$$

Next, define $b_{Tg}=(H^T T_g)^T$ and y=Hc:

$$\tilde{\varepsilon}=\frac{(b_{Tg}c)^2}{y^T y}. \tag{3A}$$

An exhaustive search procedure over all combinations of main pulse positions would be optimal but is ordinarily computationally very expensive. In conventional SMV, a sub-optimal iterative search procedure is deployed for finding the secondary excitation (fixed codebook excitation). The procedure searches for the best pulse position of each pulse or a pair of pulses, while keeping all the other pulses at their previously determined positions. After the locations for all the pulses in a particular codebook are searched, the procedure can be repeated for further refinement of the pulse locations. The repeated refinement is called a "turn". During turn 0, the initial locations for the pulses in the codebook are determined.

A conventional SMV iterative search procedure is based on the linearity of the elements in the numerator and the denominator. A vector c− is defined to include all the other pulses in the sub-codebook, except the i-th pulse so that $c_i=c^-+p_i$. Vector $p_i$ is a vector that mathematically represents the main pulse as a singleton one (1) entry in FIG. 6 positioned at one of the track locations permitted by the FCB. Zeroes fill the $p_i$ vector everywhere else, and the whole $p_i$ vector is also called a pulse for convenience.

Define $y^-=Hc^-$. Then $y=y^-+Hp_i$.

For the additional $i^{th}$ pulse, Equation (3A) is written as Equation (24) for epsilon tilde sub-i (compare Equation (5.6.11.2-1) of SMV document C.S0030-0 v. 2.0):

$$\tilde{\varepsilon}_i=\frac{(b_{Tg}c)^2}{\|y\|^2}=\frac{[b_{Tg}(c^-+p_i)]^2}{(y^-+Hp_i)^T(y^-+Hp_i)}=\frac{[(b_{Tg}c^-)+b_{Tg}p_i]^2}{\|y^-\|^2+2(y^-)^T Hp_i+\|Hp_i\|^2} \tag{24}$$

The conventional SMV iterative search procedure is based on the pre-calculation of the terms $b_{Tg}p_i$, $Hp_i$, and $\|Hp_i\|^2$ for any main pulse location permitted by FCB in the subframe. Superscript-T means matrix transpose (transposition of all rows and columns). The three terms in the final denominator of Equation (24) are all scalars. The evaluation of the numerator and the denominator of epsilon tilde $\tilde{\epsilon}_i$ for pulse $p_i$ calculates the correlation $(y^-)^T Hp_i$ between $y^-$ and $Hp_i$, and then does 3 additions.

To reduce the search complexity in the case of 2-pulse sub-codebook (used for Rate ½ Type 1 frames), a conventional SMV pre-search procedure is performed to identify a set of candidates for further search. Conventional SMV pre-search identifies a specified number $N_{pre}$=16 or 19 (respectively depending on whether pitch lag $P_{INT}$ value is less than thirty (30) or not in SMV list 5.6.11.7-1) of candidate pulse locations in each of the two tracks that maximize a criterion called epsilon hat. Criterion epsilon hat is expressed in Equation (25), which is Equation (5.6.11.7-2) of SMV document C.S0030-0 v. 2.0 for epsilon hat:

$$\hat{\varepsilon}_i=\frac{(b_{Tg}p_i)^2}{\|Hp_i\|^2} \tag{25}$$

With the set of pre-searched candidates from conventional SMV pre-search 2220, the codebook is searched in FIG. 24, upper time line, with a first search turn 2230 with the iterative search algorithm based on a joint position search for two pulses where a pair of pulses is jointly searched. The joint position search is followed by single pulse search occupying and introducing the burden of a second turn 2240 with iterative search algorithm based on a position search for a single pulse.

The conventional SMV pre-search procedure is computationally intensive and expensive due to searching 16 or 19 best candidates that maximize the error criterion in equation (25). The subsequent conventional joint pulse search is computationally intensive because computation of $2(y^-)^T Hp_i$ involves a product of two vectors and number of pulse position combinations is very high. Further refinement using single pulse search procedure is also computationally intensive because this involves calculation of the $2(y^-)^T Hp_i$ term. 2 pulse search is believed to consume about 60% of the Fixed Codebook Search complexity in Half Rate Type 1 frames.

Each main pulse (from the fixed sub-codebook) can be repeated within the subframe, with an appropriate gain factor, on intervals corresponding to the pitch lag of the subframe. As noted hereinabove, pulse insertion after the main pulse is called forward pitch enhancement, and pulse insertion before the main pulse is called backward pitch enhancement. The pre-calculation of $b_{Tg}p_i$, $Hp_i$, and $\|Hp_i\|^2$ include both the forward pitch enhancement and the backward pitch enhancement.

FIG. 24 lower time line 2250, and FIG. 25 depict an example of improved methods for Half Rate 2 pulse fixed codebook search (FCS). In FIG. 24, lower time line 2250, the fixed codebook search (FCS) for Half Rate Type 1 frames is made computationally more efficient in a step 2260 by pre-computing a correlation Phi matrix for the impulse response matrix H in a pre-computation and by a special pre-search method. The computation of the correlation Phi matrix $\phi$ is substantially simplified by Incremental Generation as described elsewhere herein. Each of the identified pulse positions is identified by special pre-search and assigned to the same Track (FCB pulse position row) in which each identified pulse position was originally situated. In this way, the special pre-search 2260 cuts down redundancy in the FCB as further described herein and eliminates more burdensome conventional SMV pre-searching 2220 of the candidate positions. Using the pre-computed correlations, then joint search 2270 is performed. The joint search 2270 eliminates single pulse refinement 2240 of FIG. 24 upper time line 2210.

The joint search 2270 tries all of the possible joint search combinations among the subset of pulse positions identified by special pre-search 2260 in FIG. 24 as detailed, for example in steps 2320-2350 of FIG. 25. The computational complexity is substantially reduced, among other reasons, because first the possible joint search combinations among the subset amount to a much more computationally satisfactory number and, second, because the joint search 2270 is based on pre-computed Phi Matrix and no refinement turn 2240 is needed.

In FIG. 25, operations commence with a BEGIN 2305 and proceed to a decision step 2310 to determine whether the pitch lag is less than 49. If so (Yes) in step 2310, operations begin special pre-search beginning at BEGIN 2320.

Next, a step 2330 applies an evaluation criterion to evaluate the main pulse as pulse $p_i$ for each of the respective related main pulse positions exemplified in FIGS. 21, 22, 23 one after the other or in parallel depending on embodiment. The more computationally intensive conventional SMV pre-search 2220 is obviated at this pre-search step 2330 thereby reducing processor load. At selection step 2340, the main pulse position winner is the one main pulse position selected from FIG. 21, FIG. 22 or FIG. 23 that wins the best evaluation value using the evaluation criterion.

For example, among main pulse positions 0,18,36 if position 18 maximizes the criterion epsilon tilde, then position 18 is selected as a pre-selected candidate of FIG. 24 step 2260. Similarly, the same procedure is applied for all main pulse positions over the fixed codebook that differ by integer multiples of the pitch lag. In the special pre-search, step 2330 is thus applied repeatedly over the codebook in a manner similar to that applied to the particular main pulse positions of FIGS. 21, 22, 23. The winner of step 2340 is also found repeatedly in a suitable operational loop, whereupon operations proceed to a RETURN 2350 from the special pre-search.

To minimize the already-low overhead due to the special pre-searching 2330-2340, the special pre-searching 2330-2340 is performed as noted above provided the pitch lag value is less than 49 in decision step 2310. If the pitch lag is 49 or greater in step 2310, then operations branch from step 2310 to the RETURN 2350 from special pre-search.

After special pre-search RETURN 2350, a joint search 2360 of FIG. 25 on the pre-searched candidates is readily performed corresponding to FIG. 24 step 2270. A cost function such as epsilon tilde is evaluated for every pair of Track locations in TABLE 3 (or rightmost two columns of TABLE 2). The pair of Track locations conferring the best-evaluated (e.g., maximum value) outcome from the cost function or criterion is identified and selected as the search result of joint search 2360. Advantageously, this joint search 2360 is even more rapidly performed in some embodiments using the pre-computed Phi Matrix from pre-computation and pre-search 2260. The joint search 2360 completes the process, free of single-pulse search. Single-pulse search is thus eliminated.

The description next even more fully details the special pre-search with tabular examples of various special pre-search embodiments.

In conventional SMV, the FCB for Rate ½ Type 1 defines the track locations in a 53/54-sample subframe (type-1 frames) for 2 pulse searching as shown in TABLE 1.

TABLE 1

| PULSE POSITIONS IN RATE ½ TYPE 1 SMV | |
|---|---|
| Pulse 1 | All numbers 0-10, all even numbers from 12-52 inclusive |
| Pulse 2 | All odd numbers from 1-11 inclusive<br>All numbers 12-22 inclusive<br>All odd numbers 23-51 inclusive. |

Each track has thirty-two (32) pulse positions or track locations permitted to a main pulse. Two main pulses Pulse 1 and Pulse 2 are permitted the respective track locations (pulse positions) tabulated in this sub-codebook.

For Rate ½ Type 1 frames, consider an example of pitch lag=22 and Subframe length of 53. For improved 2 pulse codebook search, an improved selection of candidate pulse position is performed based on the individual pulse maximizing the cost function among pulse positions from TABLE 1 differing by the integer pitch lag value as organized into successive rows of TABLE 2. For example among (1, 23, 45) differing by integer pitch lag value 22, if position at 1maximizes the cost function, then the position at 1 is selected for further refinement.

Below TABLE 2 gives a hypothetical example of pulse positions selected as winning (generating best criterion value, e.g., highest epsilon tilde) from among pulse positions differing by integer pitch lag value 22 in this example.

TABLE 2

| WINNING PULSE POSITIONS | | | | | |
|---|---|---|---|---|---|
| Competing pulse positions | | | Winning pulse Position | Pulse 1 has Winning Entry in SMV FCB | Pulse 2 has Winning Entry in SMV FCB |
| 0 | 22 | 44 | 22 | 22 | 22 |
| 1 | 23 | 45 | 1 | 1 | 1 |
| 2 | 24 | 46 | 2 | 2 | |
| 3 | 25 | 47 | 47 | | 47 |
| 4 | 26 | 48 | 26 | 26 | |
| 5 | 27 | 49 | 27 | | 27 |
| 6 | 28 | 50 | 6 | 6 | |
| 7 | 29 | 51 | 7 | 7 | 7 |
| 8 | 30 | 52 | 8 | 8 | |
| 9 | 31 | | 31 | | 31 |
| 10 | 32 | | 10 | 10 | |
| 11 | 33 | | 11 | | 11 |
| 12 | 34 | | 34 | 34 | |
| 13 | 35 | | 35 | | 35 |
| 14 | 36 | | 36 | 36 | |
| 15 | 37 | | 15 | | 15 |
| 16 | 38 | | 38 | 38 | |
| 17 | 39 | | 17 | | 17 |
| 18 | 40 | | 18 | 18 | 18 |
| 19 | 41 | | 19 | | 19 |
| 20 | 42 | | 42 | 42 | |
| 21 | 43 | | 43 | | 43 |

The extensive FCB of conventional SMV has numerous triples and pairs of main pulse positions that differ by an integer multiple of pitch lag in the same row as shown in the first three columns of TABLE 2. Gain factors are near unity for main pulse positions in each same row of TABLE 2. Thus, redundancy is recognized in the extensive FCB of conventional SMV.

The special pre-search method 2330-2340 herein constructs much a smaller FCB by selecting the winning entry in the row and tabulating the winning entry in the same row, fourth column of TABLE 2. The winning entry may correspond to a track position allowed for Pulse 1 in the extensive FCB of TABLE 1, or to a track position allowed for Pulse 2 in the extensive FCB, or to a track position allowed for both Pulse 1 and Pulse 2 in the extensive FCB. Entries in the rightmost two columns in TABLE 2 are also provided to establish to which pulses (Pulse 1, Pulse 2 or both) the winning entries of the fourth column of TABLE 2 correspond.

In a row where Pulse 1 has the winning pulse position of the fourth column of TABLE 2 as an entry in the extensive FCB of SMV for Pulse 1 of TABLE 1, then the winning pulse position of the fourth column of TABLE 2 is tabulated in the fifth column for Pulse 1 in TABLE 2. In a row where Pulse 2 has the winning pulse position of the fourth column of TABLE 2 as an entry in the extensive FCB of SMV for Pulse 2, then the winning pulse position of the fourth column is tabulated in the sixth (rightmost) column for Pulse 2 in TABLE 2.

Thus, in this example of the special pre-search, modified tracks of TABLE 3 are defined by the subset of entries constituted by only the winning candidate positions for each Pulse 1 and Pulse 2. For the above defined winning pulse position candidates the tracks of the effectively reduced FCB for Rate ½ Type 1 are selected to have entries as shown in TABLE 3. The entries of TABLE 3 are the same as the rightmost two columns of TABLE 2 sorted in numerical order of winning pulse positions pertaining to Pulse 1 and Pulse 2.

TABLE 3

| PULSE POSITIONS EXAMPLE AFTER SPECIAL PRE-SEARCH | |
|---|---|
| Pulse 1 | 1, 2, 6, 7, 8, 10, 18, 22, 26, 34, 36, 38, 42 |
| Pulse 2 | 1, 7, 11, 15, 17, 18, 19, 22, 27, 31, 35, 43, 47 |

The above candidate pulse positions of TABLE 3 are searched by joint search 2270 of FIG. 24, also designated step 2360 of FIG. 25. In the given example, TABLE 3 has thirteen (13) entries for each of Pulse 1 and Pulse 2. The number of entries in practice may be equal or unequal as between Pulses and may vary in number depending on the original entries of the extensive FCB and the actual winning entries determined by the special pre-search for any given actual frame and pitch lag. The sorting to provide TABLE 3 facilitates perusal and operations of some embodiments. In other embodiments, the sorting is omitted, and the rightmost two columns (fifth, sixth) of TABLE 2 are used directly for the subsequent joint search 2360.

In this example, the number of combinations is reduced from 32×32=1024 derived from TABLE 1 to 13×13=169 derived from TABLE 3. The special pre-search method thus represents and confers a reduction of about 84% (~84%) in the number of combinations of pulse positions which an exhaustive joint search covers. The larger number of entries for either pulse in the first pair of pulse Track locations shown in TABLE 1 is thirty-two (32). The larger number of entries for either pulse in the second set of pulse Track locations of TABLE 3 is thirteen (13).

Half Rate conventional SMV pre-searches to get 16 or 19 track locations. By contrast, the example of TABLE 3 executes special pre-search 2330-2340 to get 13 or so track locations. The substantial improvements are obtained using special pre-search compared to conventional method because the type and amount of computations in the special pre-search of TABLE 3 differ favorably from the type and amount of computations of the conventional SMV pre-search.

In conventional SMV for Rate ½ Type 1 frames, the fixed codebook search is performed using Impulse response vectors directly as in Equation (24). The improved joint search 2360 utilizes the impulse response energy Correlations (Phi Matrix) for even further reducing the complexity of the joint search 2360 which already benefits from the reduced FCB of TABLE 3. With the Phi Matrix, the computational complexity to evaluate each pair of pulse positions is far less when compared to using the impulse responses vectors directly. The pre-computation of impulse response vectors correlations (Phi Matrix) in step 2260 is additional. The computational savings it brings to joint search 2360 is far higher than the additional Phi Matrix computational complexity of step 2260 in Rate ½ Type 1. Limiting the number of backward pitch enhancements, as in FIG. 8, significantly reduces the worst case complexity of Phi Matrix computation.

Second, conventional SMV pre-searching of 16 or 19 pulse locations from 32 candidates involves sorting. The sorting complexity drastically increases with the number of candidates to be picked. For an example, one can compare complexity of picking 1 maximum out of 32 numbers versus identifying a larger and larger plurality (e.g., 4) maxima out of the same 32 numbers. However, in the special pre-search 2330-2340 example of TABLE 3, the candidate pulse is picked by candidate pulse position maximizing cost function among two, three or four (or more) pulse positions differing by integer pitch lag values. Since this special pre-search 2340 selection method picks one candidate for each set of pulse positions differing by integer pitch lag values, it is much simpler and more efficient.

Significant computational savings result from use of Pre-computed correlations represented by the Phi Matrix. During low pitch lag values the computational complexity of Phi Matrix is relatively higher compared to higher pitch lag values. When Phi Matrix complexity is high, the intelligent pre-selection of special pre-search 2330-2340 reduces the complexity of 2 pulse codebook search significantly and overall reduces the complexity in otherwise-high-complexity frames for Rate ½ Type 1.

The special pre-search procedures used herein for Half Rate (FIGS. 24-25) and Full Rate (FIGS. 26-27) recognize that in Stationary Voiced frames the gain factor is typically high and closer to unity. The search methods of FIGS. 24-27 use this substantial uniformity of the gain factor to reduce the computational complexity significantly. In the pre-search process of FIG. 25, one pulse position among multiple pulse positions differing by integer multiple value of pitch lag is selected. The selection of candidate pulse position among main pulse positions differing by integer pitch lag is selected based on winner maximizing a suitable cost function such as epsilon tilde.

Also, special pre-searching in the methods of FIGS. 24-27 is based on pitch lag decision steps 2310 and 2510 for stationary voiced (Type 1) frames and significantly reduces the complexity for fixed codebook search.

Matrix H in || Hpi ||^2 has its entries represent the response to each main pulse accompanied by any forward and/or backward pitch enhancement pulse(s). Notice that the expression || Hpi ||^2 is the same thing as the corresponding i-indexed Phi Matrix main diagonal entry Φ(i,i) by definition of the Phi Matrix. Phi Matrix is generated in step 2260 and/or 2410 by Incremental Generation herein prior to the special pre-searching in the examples of FIGS. 24-27.

For simplicity, no other version of matrix H need be used in this embodiment, but this does not rule out use of other versions of matrix H in other forms of the improved process. For ease of computation each impulse response to any and each forward and backward pitch enhancement pulse is added to the impulse response of the filter to the main pulse to constitute matrix H. Hence impulse responses based on different numbers of pitch enhancement pulses are used in matrix H depending on or based on the pitch lag value.

In this example, the epsilon-tilde criterion of Equation (3A) is used for the special pre-search procedure in this embodiment. Other embodiments suitably use a different cost function or evaluation criterion to achieve similar results.

In Rate ½ 1 Type 1 frames one of the sub-codebooks has two tracks. Each track contains 32 possible candidate pulse positions. Depending on the pitch lag value and winning candidate in the special pre-search, the possible candidate positions can be reduced significantly as shown in TABLE 2. Also, more pitch enhancement pulses are introduced, given a smaller pitch lag value, so the special pre-search conversely and compensatingly produces even a smaller proportion of pulse position winners compared to the number of pulse positions that are pre-searched. The different particular winning candidates that might be identified by the special pre-search can result in differing numbers of pulse positions in the respective Tracks for pulses 1 and 2. In this way, the reduction in computational complexity may vary somewhat from run to run of the special pre-search.

The following TABLE 4 compares approximate computational complexity reduction of an example of special pre-search and improved 2 pulse joint search of FIG. 25 compared to exhaustive search. Note the product expressions entered in the rows of the Search Combinations column of TABLE 4. There, the first factor refers to a typical number of pre-searched candidates in the first track of the Half Rate Type 1 fixed codebook and second factor refers to typical number of pre-searched candidates in the second track of the codebook. The number of pre-searched candidates in first and second tracks need not be identical as pulse positions in each track differ and the procedure is signal dependent.

TABLE 4

COMPUTATIONAL COMPLEXITY IMPROVED 2-PULSE FCS FOR HALF RATE TYPE 1 FRAMES

| Pitch Lag | Search Combinations | % reduction |
|---|---|---|
| >48 | 32 * 32 = 1024 | 0% |
| 45 | 27 * 28 = 756 | 26% |
| 40 | 23 * 24 = 552 | 46% |
| 35 | 22 * 22 = 484 | 53% |
| 30 | 19 * 19 = 361 | 65% |
| 25 | 16 * 15 = 240 | 76% |
| 20 | 13 * 13 = 169 | 83% |
| 17 | 11 * 10 = 110 | 89% |

Perusal of TABLE 4 shows that computational complexity is reduced when the pitch lag is less than 49. Accordingly, the decision step determines whether the pitch lag is less than a number N where N is 49 in step 2310 of the example of FIG. 25. Note further that the computational complexity reduction progressively increases with lower and lower values of the pitch lag below pitch lag 49. Accordingly, various embodiments in step 2310 suitably use different number for N than 49. Even embodiments having numbers N close to 17 in step 2310 provide some computational complexity reduction.

A category of embodiments in a quite satisfactory range for the number N in step 2310 is suitably also identified based on a statistical consideration of the frequency distribution of pitch lag values. For the step 2310 condition Pitch Lag<N, a category of embodiments use a pre-determined number N from among any of the numbers in the range thirty-five (35) to forty-nine (49).

Assume the statistical distribution of pitch lags is uniform (constant probability of occurrence of any pitch lag value in range 17-53). Then a number N at the lower end thirty-five (35) of the range provides execution of the special pre-search steps 2330 and 2340 with an average percent (%) reduction of 71% (half-way between 53% and 89% for N=35 down to N=17) in half the pitch lags and omits an average reduction of about 25% in the other half of the pitch lags (N=36 up to N=53).

Thus, the overall expected reduction using a number as low as N=35 over time is estimated to be about 35% or more on average. This calculation is equal to the 71% reduction times 0.5 (cumulative probability of the pitch lags below N=35). Table 4 is similarly used to estimate the average reduction of various embodiments having N established anywhere in the range of pitch lags 17 to 53/54.

The threshold in pitch lag in step 2310 substantially offsets the already quite efficient special pre-search operations of 2330-2340 for selection of candidate positions from each track for further joint pulse refinement. For example if pitch lag<25 were used, the probability over time of performing the special pre-search procedure for minimizing the number of search candidates is greatly reduced but still significant. The desirable impact of the special pre-search procedure would be available for pitch lag values below 25 and absent for pitch lag values between 25 and 53 and the latter might be occurring on average over time in a substantial proportion. On the other hand, when the special pre-search is used for pitch lag<51, which is closer to subframe length, for example, the pre-search may not reduce the codebook significantly when pitch lag is closer to subframe length for purposes of reducing operations in the subsequent joint search to justify the time spent in special pre-search to select candidate positions from each track. The threshold pitch lag value N can be varied to have different values for different embodiments with only minor or no change in coder speech quality while varying the amount of reduction in the complexity for codebook search.

Discussion now turns to Full Rate Type 1 frames and improved method examples in FIGS. 26-27 and another special pre-search embodiment such as 2550 for such frames.

In conventional SMV, the FCB for Rate 1 Type 1 defines the tracks for eight (8) pulse searching of a 40 sample subframe as shown in TABLE 5 using information from Table 5.6-5 of SMV Spec.

TABLE 5

PULSE POSITIONS IN RATE 1 TYPE 1 SMV

| Pulse | Track Locations |
|---|---|
| 1 and 5 | 0, 2, 5, 7, 10, 12, 15, 17, 20, 22, 25, 27, 30, 32, 35, 37 |
| 2 and 6 | 1, 6, 11, 16, 21, 26, 31, 36 (every $5^{th}$ number) |
| 3 and 7 | 3, 8, 13, 18, 23, 28, 33, 38 (every $5^{th}$ number) |
| 4 and 8 | 4, 9, 14, 19, 24, 29, 34, 39 (every $5^{th}$ number) |

Note that eight main pulses are used. Tabulated pairs of the pulses have the same permitted track locations for each pulse in the pair. Each track has either sixteen (16) or eight (8) pulse positions or track locations permitted to a main pulse.

For Rate 1 Type 1 frames, consider an example of pitch lag=18 and Subframe length of 40. For improved 8 pulse codebook search, an improved selection of candidate pulse positions from each track is selected based on the individual pulse maximizing the cost function among pulse positions from TABLE 5 differing by the integer pitch lag value as organized into successive rows of TABLE 6. For example among (1, 19, 37) differing by integer pitch lag value 18, if position at 19 maximizes the cost function, then position at 19 is selected for further refinement.

TABLE 6 gives a hypothetical example of pulse positions selected as winning (generating best criterion value, e.g., highest epsilon tilde) from among pulse positions differing by integer pitch lag value 18 in this example.

TABLE 6

| HYPOTHETICAL WINNING PULSE POSITIONS RATE 1 TYPE 1, LAG 18 | | | | | | | |
|---|---|---|---|---|---|---|---|
| Competing pulse positions | | | Winning pulse Position | Pulse 1/5 has Winning Entry in SMV FCB | Pulse 2/6 has Winning Entry in SMV FCB | Pulse 3/7 has Winning Entry in SMV FCB | Pulse 4/8 has Winning Entry in SMV FCB |
| 0 | 18 | 36 | 36 | | 36 | | |
| 1 | 19 | 37 | 19 | | | | 19 |
| 2 | 20 | 38 | 20 | 20 | | | |
| 3 | 21 | 39 | 39 | | | | 39 |
| 4 | 22 | 40 | 4 | | | | 4 |
| 5 | 23 | | 23 | | | 23 | |
| 6 | 24 | | 6 | | 6 | | |
| 7 | 25 | | 25 | 25 | | | |
| 8 | 26 | | 8 | | | 8 | |
| 9 | 27 | | 27 | 27 | | | |
| 10 | 28 | | 28 | | | 28 | |
| 11 | 29 | | 11 | | 11 | | |
| 12 | 30 | | 12 | 12 | | | |
| 13 | 31 | | 31 | | 31 | | |
| 14 | 32 | | 14 | | | | 14 |
| 15 | 33 | | 15 | 15 | | | |
| 16 | 34 | | 34 | | | | 34 |
| 17 | 35 | | 17 | 17 | | | |

The special pre-search method herein constructs much a smaller FCB by selecting the winning entry in the row and tabulating it in the same row, fourth column of TABLE 6. The winning entry may correspond to a track position for Pulse 1/5 or 2/6 or 3/7 or 4/8 in the extensive FCB since the track locations do not overlap in TABLE 5. Entries in the rightmost four columns in TABLE 6 are also provided to establish to which pulses (Pulse 1/5, 2/6, 3/7 or 4/8) the winning entries of the fourth column of TABLE 6 correspond.

Thus, in this example of the special pre-search for Full Rate Type1, modified tracks of TABLE 7 are defined by the subset of entries constituted by only the winning candidate positions or substantially or mostly including the winning candidate positions. For the above defined winning pulse position candidates the tracks of the effectively reduced FCB for Rate 1 Type 1 are selected to have entries as shown in TABLE 7. The entries of TABLE 7 are the same as the rightmost four columns of TABLE 6 sorted in numerical order of winning pulse positions pertaining to Pulses 1/5, 2/6, 3/7 and 4/8.

TABLE 7

| PULSE POSITIONS EXAMPLE AFTER PRE-SEARCH, RATE 1, TYPE 1 | |
|---|---|
| Pulse | Track Locations |
| 1 and 5 | 12, 15, 17, 20, 25, 27 |
| 2 and 6 | 6, 11, 31, 36 |
| 3 and 7 | 8, 23, 28 |
| 4 and 8 | 4, 14, 19, 34, 39 |

For Full Rate, Type 1, the above candidate pulse positions of TABLE 7 are then efficiently searched with Selective Joint Search as described in connection with FIG. 18 single pulse position search 2150 followed by Selective Joint Search steps 2110, 2120, 2130, 2140. Because of the reduced FCB represented by TABLE 7 a number of search types are feasible for different embodiments and among them, Selective Joint Search is quite useful, efficient and effective. In the given example, TABLE 7 has tracks for eight main pulses, and track locations include six (6) entries for Pulses 1 and 5, four (4) entries for Pulses 2 and 6, three (3) entries for Pulses 3 and 7, and five (5) entries for Pulses 4 and 8.

In this example, the number of combinations in the joint search is greatly reduced. Conventional SMV sequential joint position search of FIG. 16A step 1910 would search tracks (1,2), (3,4), (5,6), (7,8) in Turn 1 of FIG. 19, upper time-line, and then tracks (2,3), (4,5), (6,7) in Turn 2 of FIG. 19, upper time-line, for an estimated total of search pairs 16×8+8×8+16×8+8×8+8×8+8×16+8×8=640 in C.S0030-0 (multiplying numbers of entries in successive pairs of tracks).

By contrast, for Full Rate Type 1, the example of improved search 2560 using the Full Rate reduced FCB of TABLE 7 resulting from special pre-search 2550 would involve Selective Joint Search on TABLE 7 with the calculation based on 6×4+3×5=39 (or some average product of number of entries for Pulse 1/5 and Pulse 2/6 tracks plus product for Pulse 3/7 and Pulse 4/8 tracks derived from the reduced FCB). The special pre-search method 2550 of FIG. 27 thus delivers, and this time for Full Rate confers on joint search 2560, a dramatic reduction in the number of combinations of pulse positions to search compared to conventional SMV.

FIGS. 26 and 27 show an improved method 2400 and a process flow 2500.

In FIG. 26, the autocorrelation Phi matrix is pre-computed by Incremental Generation. Special pre-search 2410 is performed as described in connection with the TABLES 5, 6 and 7 herein. Then one turn of single pulse search is performed followed by selective joint search 2420 is executed on the Reduced FCB produced by the special pre-search, completing the Fixed Codebook search (FCS) for a Rate 1 Type 1 frame.

In FIG. 27, operations for Rate 1 Type 1 commence with BEGIN 2505 and proceed to a decision step 2510 to determine whether the Pitch Lag is less than a predetermined number N, such as 33.

The threshold N=33 for Rate 1 step 2510 is picked on the basis of subframe size 40 and considering the % reduction starts to significantly ramp from zero and progressively increase when the pitch lag is less than 33. Other embodiments suitably provide another value of N for operation. By analogy with the Rate ½ consideration of TABLE 4 in this respect, an analogous quite-satisfactory range for N in Rate 1 for condition Pitch Lag<N some other embodiments is a number N selected from the range N=25 to N=33 inclusive. This range is selected since pitch lag twenty-five (25) is halfway down from pitch lag 33 to pitch lag 17. In both Rate ½ and Rate 1, the predetermined number N is between approximately fifty percent (50%) and approximately ninety percent (90%) of the subframe size. In other words, the predetermined number N established for some, although not necessarily all, embodiments of single-rate and variable-rate speech coders is between approximately fifty percent (50%) and approximately ninety percent (90%) of the subframe size.

When decision step 2510 determines Pitch Lag less than N (Yes), then operations go to the special pre-search process 2550 for Full Rate (Rate 1) Type 1 frames operating in the manner described herein in connection with TABLES 5, 6 and 7. Pre-search process 2550 is also similar or analogous to the pre-search 2330-2340 in FIG. 25 for Half Rate Type 1 frames and as described in connection with TABLES 1-3.

For example, among main pulse positions 0,18,36, if position 36 maximizes an evaluation criterion such as epsilon tilde, then position 36 is selected as a pre-selected candidate in FIG. 27 step 2550. Similarly, the procedure is applied for all main pulse positions over the codebook differing by integer multiple pitch lag values. As shown in TABLE 6, the winning pulse positions are allocated to the same pulses to which they originally pertain in the extensive FCB of SMV. The special pre-search 2550 is thus applied repeatedly row-by-row as in TABLE 6 and as indicated by loop arrow 2555. In this way, procedure 2550 reduces redundancy over the codebook FCB in a manner like that applied to the particular main pulse positions of FIGS. 21, 22, 23.

Following special pre-search 2550, step 2560 executes any computationally efficient type of pulse position search over the pre-search candidates from the Pulse related rows on the right side of TABLE 6, whereupon a RETURN 2570 is reached. This pulse position search 2560 is suitably a joint search rapidly performed using the pre-computed Phi Matrix, for instance. Joint pulse position search 2560 is suitably performed on unreduced FCB in some embodiments, and in other embodiments other pulse position search types that approximate the same results with fewer calculations are also suitably used. As described hereinabove in connection with TABLES 6 and 7, the method of Selective Joint Search of FIG. 18 uses steps 2150, 2105, 2110, 2120, 2130, 2140 to rapidly search the reduced FCB resulting from the special pre-search 2550.

In case decision step 2510 determines No, that the Pitch Lag is not less than N (e.g., N=33), then operations go from step 2510 to a Selective Joint Search 2520 of FIG. 18 for Rate 1 Type 1, 8-pulse FCS depicted in FIG. 19 lower time line. This joint search 2520 is suitably and rapidly performed using the Phi Matrix pre-computed by Incremental Generation on the unreduced Fixed Codebook of TABLE 5 or Rate 1 Type 1, for instance. After search 2520, RETURN 2570 is reached. In this way, step 2510 bypasses the special pre-searching 2550 except when the special pre-searching 2550 and joint search 2560 confers a complexity reduction.

In FIG. 27, the speech coder is thus operable to perform a first type of search process 2520 and alternatively a special pre-search 2550 followed by a second type of search 2560. In some embodiments, the second type of search is the same in concept as the first type but carried out on the reduced FCB (fixed codebook) resulting from special pre-search 2550. In some other embodiments, the second type of search is different in concept from the first type of search and the second type of search is carried out on the reduced FCB.

The special pre-search 2550 confers a process efficiency advantage in a portion of cases identifiable by a condition on a parameter of speech, such as pitch lag less than N for instance. The decision step 2510 is further operable to determine the existence of the condition on the parameter of speech and activate the pre-search 2550 followed by the second type of search 2560. Otherwise, decision step 2510 determines that the condition on the parameter of speech is absent and performs the first type of search process 2520 instead.

In one example, epsilon tilde of Equation (24) is used for the cost function throughout for special pre-searches for Half Rate and for Full Rate, for single pulse search 2150 for Full Rate, and for both joint searches 2360 and 2560 for Half Rate and Full Rate.

In this example of improved method for Rate ½ Type 1, the Phi Matrix is not only pre-computed but pre-computed by Incremental Generation. Moreover, the improved method conditionally limits the maximum number Pmax of backward pitch enhancements to two (2). Thus, the methods of FIGS. 24-25 are compatible and utilized with the methods of FIG. 8. Phi Matrix is utilized for generating epsilon tilde so that joint searching 2360 operates even more rapidly on the reduced FCB of TABLE 3 for Half Rate, and likewise joint search 2560 operates even more rapidly on reduced FCB of TABLE 7 for Full Rate.

In this example of improved method, Rate ½ Type1, 2 pulse reduced-codebook search 2360 involves exhaustive search if pitch lag is greater than or equal to 49 (pitch lag>=49). Otherwise, if the pitch lag decision test 2310 is not met in this example, all other codebooks/sub codebooks do not need to receive an exhaustive search by joint search 2360 in the sense of searching all pulse position combinations, although some embodiments do suitably permit exhaustive joint search.

At Rate 1, in this example of improved method, when the joint search 2560 is performed, a single pulse search first decides by Cost function which rows to then joint search. (See FIG. 19 lower timeline and FIG. 18 step 2150 and steps 2105-2140). Because the FCB is reduced by special pre-search 2550, the joint search 2560 is significantly reduced in complexity, time consumed, and energy dissipation, and increased in speed.

In this example, the special pre-search 2550 of FIG. 27 maximizes criterion epsilon tilde for Full Rate, and special pre-search of steps 2330-2340 in FIG. 25 maximizes epsilon hat for Half Rate. Since, for example, special pre-search is done for two, three or four pulse positions (per TABLE 2 row or per TABLE 6 row) that differ by integer pitch lag values, the complexity is minimal. The subsequent joint search (e.g., over TABLE 3 or TABLE 7) maximizes criterion epsilon tilde for Full Rate, and epsilon tilde for Half Rate.

In this example of FIG. 25 improved method for Half Rate Type 1, two-pulse codebook, the Half Rate codebook search efficiently occurs and does not involve any Selective Joint search of FIG. 18 steps 2110-2140. The selective Joint Search does not apply because there are only two tracks to be searched so no selection of track pairs is needed. The two tracks are suitably searched in any appropriate manner such as joint search. At Rate ½, the joint search 2360 is directly done in this example without any single pulse search preceding the joint search because there are only two tracks to be searched.

In FIG. 27 for Full Rate, in this example, the subsequent joint search 2560 is not exhaustive and does use FIG. 18 search 2150 and Selective Joint Search steps 2110-2140.

In another example of improved method, epsilon hat equation (25) is used as an evaluation criterion or cost function to obtain results effectively like those epsilon tilde except that in the context, epsilon hat is used for computing cost function to evaluate for only one pulse candidate and can be very swiftly generated. Epsilon tilde for only one pulse position is represented as epsilon hat.

Use of epsilon hat works as well as epsilon tilde for evaluating one pulse position because substituting c−=0 and y−=Hc−=0 into Equation (24) yields Equation (25). Each value of epsilon hat is very rapidly generated based on Equation (25).

Note that in a improved process example of generating the cost function, such as epsilon hat according to Equation (25), that the H vectors for different numbers of the backward pitch enhancements are provided and selected for searching each row of TABLE 2 and/or TABLE 6 in the special pre-search 2330-2340 and/or 2550.

In the improved process example using TABLE 2 and/or TABLE 6, some of the rows have three entries of main pulse positions to maximize over and select from as in Equation (26A). The rest of the rows have two entries. For rows having two entries the maximum for selection by the process is given by Equation (26B).

$$\mathrm{MAX}[\hat{\varepsilon}_i, \hat{\varepsilon}_{i+lP_{INT}}, \hat{\varepsilon}_{i+2\times lP_{INT}}] \quad (26A)$$

$$\mathrm{MAX}[\hat{\varepsilon}_i, \hat{\varepsilon}_{i+lP_{INT}}] \quad (26B)$$

The winning pulse position in the fourth column of TABLE 2 and/or TABLE 6 is the value of subscripted main pulse position i or $(i+l^P_{INT})$, or $(i+2\times l^P_{INT})$ in Equation (26A) or Equation (26B) corresponding to the cost function value that is determined to be maximum.

Note that epsilon hat $\hat{\varepsilon}_i$ is an example of a cost function. The cost function uses the appropriate impulse vector $H_p^0$, $H_p^1$, or $H_p^2$ depending on whether the number $P_m$=0, 1 or 2 of backward pitch enhancement pulses is zero or one (or two if applicable) for a given main pulse position tabulated in a row of TABLE 2 or TABLE 6. Note that the superscripts $P_m$=0, 1 or 2 on the $H_p$ impulse vectors represent which H impulse response vector to use depending on number $P_m$ of backward pitch enhancements and do not represent exponentiation. Each $H_p$ impulse vector includes the effect of any forward enhancement pulses that also fit in the subframe given the main pulse position.

Index i represents a given first column main pulse position in the first column of TABLE 2 or TABLE 6. Looking at TABLES 2 and 6 first three columns at left, the cost function is evaluated using $H_p^0(i)$ in the first (leftmost) column of TABLE 2 or TABLE 6 where the main pulse position index i is too small to permit of a backward pitch enhancement pulse, using $H_p^1(i+l^P_{INT})$ in the second table column where the main pulse position $i+l^P_{INT}$ is large enough to permit exactly one backward pitch enhancement pulse, and using $H_p^2(i+2\times l^P_{INT})$ in the third table column where the main pulse position $i+2\times l^P_{INT}$ is large enough to permit exactly two backward pitch enhancement pulses.

In other words, the maximum function MAX uses impulse vectors $H_p^{Pm}(\ )$ using all values for the superscript $P_m$ that satisfy the inequality $$i+P_m\times l^P_{INT}<L_{SF} \tag{27}$$

The expression $i+P_m\times l^P_{INT}$ represents a main pulse position in the subframe and tabulated in a given row of TABLE 2 and/or TABLE 6. In one example, TABLE 2 and TABLE 6 are each constructed from top to bottom so that if a main pulse position $i+P_m\times l^P_{INT}$ is used in any row, it is not used in a succeeding row. Thus, a track position is used in only one of the rows or groups in the table. Also, no row has a single pulse position, because then there is no need for maximization. Equation (27) signifies that the process embodiment constrains the main pulse positions $i+P_m\times l^P_{INT}$ to lie within the subframe having subframe length $L_{SF}$.

Epsilon tilde is also suitable when evaluating two pulse positions in joint search. Any suitable criterion such as epsilon tilde or epsilon hat is useful in the special pre-search 2330-2340 of FIG. 25 and in the special pre-search 2550 of FIG. 27.

In Half Rate Type 1 Pitch Lag<49, after the special pre-search 2330-2340 of FIG. 25, an example of joint search 2360 searches every one of the m×n pairs (e.g., 13×13). In Half Rate Type 1 Pitch Lag>=49, this example of improved method does not do conventional SMV pre-search to find 16 or 19 pulse locations in each of the two tracks that maximize epsilon hat. Under these circumstances all the 32×32 combinations are searched. Computational efficiency gains over conventional SMV are achieved through pre-computed Correlations (Phi Matrix) as even further improved by Incremental Generation herein.

The following TABLE 8 compares numbers of pulse combinations searched using various approaches for Full Rate Type 1 frames for each subframe.

TABLE 8

COMPUTATIONAL COMPLEXITY 2-PULSE FCS FOR FULL RATE TYPE 1 FRAMES

| Approach | Pulse combinations searched per subframe | % reduction |
|---|---|---|
| Standard SMV | 800 | 0% |
| S.N. 11/231,643 (TI-38348) | 336 | 58% |
| Method of FIGS. 26-27 (pitch lag = 20) | ~144 | 82% |

The exact pulse combinations searched per subframe for various versions of the improved methods are likely to be data dependent.

Some embodiments apply a further explicit pitch gain threshold condition in step 2310 and 2510 that the gain factors exceed a threshold $g_t$ such as 0.80 (or other number approximating unity) before applying the special pre-searches 2330-2340 and 2550 to a given row in TABLE 2 or TABLE 6 respectively. Such embodiments provide some more entries for the reduced FCB that are thus not eliminated from the extensive FCB when the gain threshold condition is not met. Accordingly, the computational complexity is less reduced than when the gain factors are assumed approximately unity for all rows, but the complexity is still improved. In this way, the improved methods are robustly varied for different speech conditions.

Still other embodiments bypass the special pre-search if the gain factors for too many rows are below the threshold. Put another way, some embodiments identify a plurality of groups and provide a count related to a number of the groups for which the gain factors exceed a threshold. Then the special pre-search on the main pulse positions is bypassed when the number of groups $N_g$ for which the gain factors are below the threshold for gain factors is less than a predetermined second threshold number $N_t$ of groups, that is when $N_g<N_t$. In some typical speech coders, the gain factor is a constant of all tracks and is either above the threshold or below it. The above statements in this paragraph are applicable when this assumption does not apply.

The computational complexity of signal warping is high for short pitched voiced and low for high pitched stationary voices. The improved pre-search and search method embodiments confer significant complexity reductions during short, higher pitched stationary voiced frames and significantly reduce worst case complexity of the speech coding.

Recognizing the gain factors are about equal among pitch enhancement pulses relative to their main pulse provides a shortcut to finding pairs or triplets of track locations in the codebook that can be efficiently pre-searched to reduce redundancy in the codebook and thereby provide a reduced-size codebook for subsequent search. The selected best-evaluated track location numbers are assigned or allocated to subsets of track location numbers respectively corresponding to the sets of track location numbers in the codebook for the pulses to which each selected track location number pertains.

In one general perspective, some embodiments identify sets of different track locations for main pulses that have approximately the same evaluation on a criterion, and store the track location of the main pulse having the most favorable evaluation in each set. One way of identifying such sets is recognizing that different track locations spaced apart by the pitch lag do in fact identify precisely such sets. A redundancy detected in the FCB includes entries where first main pulse has a first track location and a first pitch enhancement pulse has a second track location and that ensemble (of first main pulse and first pitch enhancement pulse) has approximately the same evaluation on the criterion as a second main pulse having the second track location and a second pitch enhancement pulse having the first track location. It may happen that a more optimal combination of pulse positions exists than results from the reduced FCB. However, for practical purposes and according to confirmation as described herein by testing by the skilled worker, the approximation to perfect optimality is close enough for practical purposes and for quite satisfactory speech quality.

In more complex ensembles, a redundancy detected includes FCB entries pertaining to respective first, second and third main pulses each having at least two associated pitch enhancement pulses, wherein the first main pulse with a first track location and at least first and second pitch enhancement pulses in track locations, has approximately the same evaluation as the second main pulse having the track location of the first pitch enhancement pulse, and further has approximately the same evaluation as the third main pulse having the track location of the second pitch enhancement pulse.

Other embodiments apply a suitably-different rule based on knowledge about the redundant features in the FCB to group the FCB into the sets of track locations for main pulses that have approximately the same evaluation on the criterion. Still further embodiments evaluate all the track locations on the criterion, organize the track locations into sets defined by tiers of approximately equal evaluation received on the criterion, and then store the track location of the main pulse having the most favorable evaluation in each set.

Put another way, in some embodiments the speech coder is operable to generate evaluation numbers corresponding the track location numbers based on an evaluation criterion, to organize the evaluation numbers into tiers of approximately equal evaluation received on the criterion, and to assign the track location numbers to the groups corresponding to the tiers in which their evaluations lie. The track location number respectively receiving a favorable evaluation, or even most favorable evaluation, in each tier is stored into the reduced codebook.

In yet further embodiments, the tiers are analyzed to ascertain one or more rules, and any conditions on those rules, governing the groupings into tiers. Then the rules and any conditions are programmed as a process embodiment to group the FCB and evaluate the track locations on the criterion to generate a reduced FCB.

Still other embodiments omit the evaluation on a criterion for making the selection from each row in TABLE 2 and/or TABLE 6. For instance, a selection is made round-robin or randomly, or by any other suitable selection process to select one or two of the track locations in each Table row having three or more entries and select one of the track locations in each Table row having two entries and in this way generate a reduced codebook. Where the criterion evaluations would have been about the same for track locations across any one Table row, the criterion evaluation is regarded in this group of embodiments as less important at pre-search time wherein the law of averages itself selects about half of the track locations that would have received the most favorable criterion evaluation in a Table row. Also, where the speech coder is a variable rate speech coder, different embodiments as described herein are suitably implemented for pre-searching different codebooks applicable to different rates.

The improved methods and structures are suitably included individually and together in any speech coders and codecs of SMV, ACELP, RCELP and other various codec types to which they are applicable. The manner of application of the improved methods and structures is made suitable to the different Rates and frame Types and other categorizations as specified and employed in each particular codec employing the teachings herein.

The improved methods and structures are verified by software and hardware testing as well as subjective speech testing. At each Rate in which the improved search methods are provided, the skilled worker suitably tests the subjective quality of speech under various speech signal levels and background conditions to verify that quality of speech is maintained.

A few preferred embodiments have been described in detail hereinabove. It is to be understood that the scope of the invention comprehends embodiments different from those described yet within the inventive scope. Microprocessor and microcomputer are synonymous herein. Processing circuitry comprehends digital, analog and mixed signal (digital/analog) integrated circuits, ASIC circuits, PALs, PLAs, decoders, memories, non-software based processors, and other circuitry, and digital computers including microprocessors and microcomputers of any architecture, or combinations thereof. Internal and external couplings and connections can be ohmic, capacitive, direct or indirect via intervening circuits or otherwise as desirable. Implementation is contemplated in discrete components or fully integrated circuits in any materials family and combinations thereof. Various embodiments of the invention employ hardware, software or firmware. Block diagrams of hardware are suitably used to represent processes and process diagrams and vice-versa. Process diagrams herein are representative of flow diagrams for operations of any embodiments whether of hardware, software, or firmware, and processes of manufacture thereof.

While this invention has been described with reference to illustrative embodiments, this description is not to be construed in a limiting sense. Various modifications and combinations of the illustrative embodiments, as well as other embodiments of the invention may be made. The terms "including", "includes", "having", "has", "with", or variants thereof are used in the detailed description and the claims to denote non-exhaustive inclusion in a manner similar to the term "comprising". It is therefore contemplated that the appended claims and their equivalents cover any such embodiments, modifications, and embodiments as fall within the true scope of the invention.

What is claimed is:

1. An electronic circuit comprising storage circuitry; and a speech coder coupled with the storage circuitry to have a codebook with sets of track location numbers for respective pulses, the speech coder operable to identify a group of track location numbers in the codebook substantially equally spaced from each other by a pitch lag amount, and make a selection from the group of track location numbers of a selected track location number;

wherein the track location numbers represent main pulse positions accompanied by pitch enhancement, and the speech coder further operable to pre-compute autocorrelations by incremental generation and to generate and pre-search on a plurality of the groups of main pulse positions to maximize a criterion of evaluation, wherein the main pulse positions in each group are substantially interchanged with their pitch enhancements, and to perform one turn of joint search with the pre-computed autocorrelations, the joint search substantially based on main pulse positions selected in the pre-search.

2. The electronic circuit claimed in claim 1 wherein the speech coder is further operable to evaluate a criterion of speech approximation for each track location number in the group so that the selection supplies a single track location number having the most favorable evaluation of the criterion.

3. The electronic circuit claimed in claim 1 wherein the speech coder is further operable to repeat for different groups each with track location numbers substantially equally spaced from each other by the pitch lag amount, to obtain selected track location numbers respectively from the groups as a pre-search result.

4. The electronic circuit claimed in claim 3 wherein the speech coder is further operable to assign the selected track location numbers to subsets of track location numbers respectively corresponding to and being a subset of the corresponding sets in the codebook of track location numbers for the pulses.

5. The electronic circuit claimed in claim 4 wherein the speech coder is further operable to evaluate all pairs of track locations having a first track location from a first one of the subsets and a second track location from a second one of the subsets, and to select the best evaluated combination.

6. The electronic circuit claimed in claim 3 wherein the speech coder is further operable to joint search the selected track location numbers to complete a search.

7. The electronic circuit claimed in claim 1 wherein the speech coder is further operable to organize the selected track location numbers into more than two subsets, to evaluate the subsets and joint search on the subsets evaluated most in need of refinement.

8. The electronic circuit claimed in claim 1 wherein the speech coder has a condition of operation on the group that speech be of a voiced stationary type.

9. The electronic circuit claimed in claim 1 wherein the speech coder is selectively operable at a higher rate and a lower rate.

10. The electronic circuit claimed in claim 1 wherein the track location numbers in the group correspond to respective locations of main pulses each with pitch enhancement.

11. The electronic circuit claimed in claim 1 wherein the speech coder is further operable to repeat for different groups each with track location numbers substantially equally spaced from each other by the pitch lag amount, to obtain selected track location numbers respectively from the groups, wherein each track location is used in only one of the groups.

12. The electronic circuit claimed in claim 1 wherein the speech coder is further operable to divide at least some speech into subframes having a subframe length and is further operable to repeat for different groups each with track location numbers substantially equally spaced from each other by the pitch lag amount, to obtain selected track location numbers respectively from the groups, and the track location numbers in each group lie within the subframe length.

13. The electronic circuit claimed in claim 1 wherein each pitch enhancement has a gain factor relative to its main pulse, and the speech coder is operable to provide a count related to a number of the groups for which the gain factors exceed a gain factor threshold.

14. The electronic circuit claimed in claim 13 wherein the speech coder is operable to bypass the pre-search based on a condition substantially that the count is less than a predetermined count threshold.

15. The electronic circuit claimed in claim 1 wherein the pre-compute of the autocorrelations includes conditional limitation of a number of backward pitch enhancement pulses based on a condition on pitch lag.

16. An electronic circuit comprising storage circuitry; and a speech coder coupled with the storage circuitry to have a codebook with sets of track location numbers for respective pulses, the speech coder operable to identify a group of track location numbers in the codebook substantially equally spaced from each other by a pitch lag amount, and make a selection from the group of track location numbers of a selected track location number, wherein the speech coder has a condition of operation on the group that the pitch lag amount be less than a predetermined number.

17. The electronic circuit claimed in claim 16 wherein the predetermined number in the condition is between 50% and 90% of a subframe size.

18. The electronic circuit claimed in claim 16 wherein the predetermined number in the condition is between 35 and 49 inclusive for a subframe size substantially approximating 53.

19. The electronic circuit claimed in claim 16 wherein the predetermined number in the condition is between 25 and 33 inclusive for a subframe size substantially approximating 40.

20. An electronic circuit comprising storage circuitry; and a speech coder coupled with the storage circuitry to have a codebook with sets of track location numbers for respective pulses, the speech coder operable to identify a group of track location numbers in the codebook substantially equally spaced from each other by a pitch lag amount, and make a selection from the group of track location numbers of a selected track location number, wherein the speech coder has a condition of operating on the group that a gain factor of pitch enhancement exceed a predetermined level.

21. An electronic circuit comprising storage circuitry; and a speech coder coupled with the storage circuitry to have a codebook with sets of track location numbers for respective pulses, the speech coder operable to identify a group of track location numbers in the codebook substantially equally spaced from each other by a pitch lag amount, and make a selection from the group of track location numbers of a selected track location number, wherein the speech coder is operable to evaluate a criterion of speech approximation as a function for each track location number in the group by applying a plurality of instances of the function respectively evaluated based on different impulse vectors respectively pertaining to different numbers of backward pitch enhancements.

22. A method of speech coding with a codebook with sets of track location numbers for respective pulses, the method comprising identifying a group of track location numbers in the codebook substantially equally spaced from each other by a pitch lag amount; and selecting from the group of track location numbers a selected track location number; and conditioning operation on the group that the pitch lag amount be less than a predetermined number.

23. The method claimed in claim 22 further comprising evaluating a criterion of speech approximation for each track location number in the group, and the selecting operation selecting a single track location number having the most favorable evaluation of the criterion as a pre-search result.

24. The method claimed in claim 22 further comprising repeating for different groups each with track location numbers substantially equally spaced from each other by the pitch lag amount, to obtain selected track location numbers respectively from the groups.

25. The method claimed in claim 24 further comprising assigning the selected track location numbers to subsets of track location numbers respectively corresponding to and being a subset of the corresponding sets in the codebook of track location numbers for the pulses.

26. The method claimed in claim 25 further comprising evaluating all pairs of track locations having a first track location number from a first one of the subsets and a second track location number from a second one of the subsets, and selecting the best evaluated combination.

27. The method claimed in claim 22 wherein the speech coding uses subframes having a subframe size, and the method further comprising conditioning operation on the group that the pitch lag amount be less than a predetermined number wherein the predetermined number lies in a range between 50% and 90% of the subframe size.

28. A telecommunications device comprising a modem;

speech input circuit for converting first audible speech into a first electrical form; and a speech coder coupled to the speech input circuit and operable with a codebook with sets of track location numbers for respective pulses, the speech coder operable to identify a group of track location numbers in the codebook substantially equally spaced from each other by a pitch lag amount, and make a selection from the group of track location numbers of a selected track location number for speech coding information, the speech coder coupled to supply the speech coding information to said modem;

wherein the track location numbers represent main pulse positions accompanied by pitch enhancement, and the speech coder further operable to pre-compute autocorrelations by incremental generation and to generate and pre-search on a plurality of the groups of main pulse positions to maximize a criterion of evaluation, wherein the main pulse positions in each group are substantially interchanged with their pitch enhancements, and to perform one turn of joint search with the pre-computed autocorrelations, the joint search substantially based on main pulse positions selected in the pre-search.

29. The telecommunications device claimed in claim 28 wherein said modem includes a wireless cellular telephone modem.

30. The telecommunications device claimed in claim 28 further comprising a speech output circuit for converting a second electrical form into second audible speech, and a speech decoder coupled to said modem to decode speech coding information, of a type selected as aforesaid and received by the modem, into the second electrical form and coupled to the speech output circuit.

31. A method of speech coding with an original codebook with sets of track location numbers for respective pulses, the method comprising reducing redundancy in the codebook by identifying groups of different track location numbers in the codebook regardless of set that have approximately the same evaluation;

selecting a track location number from each group; and storing the selected track location numbers to subsets of track location numbers respectively corresponding to the sets of track location numbers for the respective pulses, whereby to store a reduced-size codebook;

wherein the track location numbers represent main pulse positions accompanied by pitch enhancement, and the speech coder further comprising pre-computing autocorrelations by incremental generation and to generate and pre-search on a plurality of the groups of main pulse positions to maximize a criterion of evaluation, wherein the main pulse positions in each group are substantially interchanged with their pitch enhancements, and to perform one turn of joint search with the pre-computed autocorrelations, the joint search substantially based on main pulse positions selected in the pre-search.

32. An electronic circuit comprising storage circuitry; and a speech coder coupled with the storage circuitry and having a codebook and wherein the speech coder is operable to determine a parameter of speech and to perform a first type of search on the codebook and alternatively a pre-search of the codebook followed by a second type of search on results of the pre-search, the pre-search conferring a process efficiency advantage in a portion of cases identifiable by a condition on the parameter of speech, and the speech coder is further operable to determine the existence of the condition on the parameter of speech and activate the pre-search followed by the second type of search, and otherwise determine that the condition on the parameter of speech is absent, and bypass the pre-search and perform the first type of search process on that codebook instead.

33. The electronic circuit claimed in claim 32 wherein the condition on the parameter of speech includes pitch lag less than a threshold.

34. The electronic circuit claimed in claim 32 further comprising a modem;

a speech input circuit for converting audible speech into an electrical form; and said speech coder coupled to said speech input circuit, said speech coder further coupled to provide encoded speech information responsive to said first type and second type of search to said modem, whereby to provide a telecommunications device.

35. A method of speech coding with a codebook wherein the method comprises determining a parameter of speech;

determining the existence of a condition on the parameter of speech and thereupon activating a pre-search of the codebook followed by a particular search on results of the pre-search, the pre-search and the particular search conferring a process efficiency advantage over an alternative type of search process in a portion of cases identifiable by the condition on the parameter of speech; and otherwise determining that the condition on the parameter of speech is absent, and bypassing the pre-search and performing the alternative type of search process on that codebook instead.

* * * * *

UNITED STATES PATENT AND TRADEMARK OFFICE

CERTIFICATE OF CORRECTION

PATENT NO. : 7,571,094 B2
APPLICATION NO. : 11/311976
DATED : August 4, 2009
INVENTOR(S) : Chanaveeragouda V Goudar It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 730 days.

Signed and Sealed this

Seventh Day of September, 2010

David J. Kappos

David J. Kappos
*Director of the United States Patent and Trademark Office*